US007227503B2

(12) United States Patent
Baba et al.

(10) Patent No.: US 7,227,503 B2
(45) Date of Patent: Jun. 5, 2007

(54) ANTENNA DEVICE FOR MOTOR VEHICLE

(75) Inventors: Yuji Baba, Minato-ku (JP); Tatsumi Tokuda, Minato-ku (JP)

(73) Assignee: Nippon Sheet Glass Company, Limited, Tokyo (JP)

( * ) Notice: Subject to any disclaimer, the term of this patent is extended or adjusted under 35 U.S.C. 154(b) by 13 days.

(21) Appl. No.: 11/182,640

(22) Filed: Jul. 15, 2005

(65) Prior Publication Data

US 2006/0012532 A1 Jan. 19, 2006

(30) Foreign Application Priority Data

Jul. 16, 2004 (JP) ..... 2004-210359

(51) Int. Cl.
*H01Q 1/32* (2006.01)

(52) U.S. Cl. ..... 343/713; 343/711

(58) Field of Classification Search ..... 343/713, 343/711, 712

See application file for complete search history.

(56) References Cited

U.S. PATENT DOCUMENTS 6,215,450 B1 * 4/2001 Oka ..... 343/713

6,229,493 B1 * 5/2001 Iijima ..... 343/713

FOREIGN PATENT DOCUMENTS

JP 2003-500870 7/2003

* cited by examiner

*Primary Examiner*—Hoang V. Nguyen
(74) *Attorney, Agent, or Firm*—RatnerPrestia

(57) ABSTRACT

A glass antenna device having an AM and FM antennas provided on a rear window glass panel on which a defogger is formed is provided, the sensitivity and directivity of the device being improved. The device comprises a defogger provided on a rear window glass panel of the motor vehicle, an AM antenna provided in a space other than the defogger on the rear window glass panel, an FM antenna provided in a space between the defogger and the AM antenna on the rear window glass panel, a two-input amplifier for amplifying signals received by the AM and FM antennas, an AM lead wire for connecting between a feeding terminal of the AM antenna and the amplifier, an FM lead wire for connecting between a feeding terminal of the FM antenna and the amplifier, and an inductor inserted in the AM lead wire near to the AM feeding terminal.

6 Claims, 78 Drawing Sheets

24
22
12b
26
12b
12a
10
12
14
14b
14a
18b
16b
16c
16d
16
16a
18a
20

92MHz

93MHz

94MHz

95MHz

96MHz

97MHz

98MHz

99MHz

100MHz

101MHz

102MHz

103MHz

104MHz

105MHz

88MHz

89MHz

90MHz

91MHz

92MHz

93MHz

94MHz

95MHz

98MHz

99MHz

100MHz

101MHz

102MHz

103MHz

104MHz

105MHz

106MHz

107MHz

108MHz

88MHz

89MHz

90MHz

91MHz

92MHz

93MHz

96MHz

97MHz

98MHz

99MHz

100MHz

101MHz

102MHz

103MHz

104MHz

105MHz

96MHz

97MHz

98MHz

99MHz

100MHz

101MHz

102MHz

103MHz

104MHz

105MHz

106MHz

107MHz

108MHz

90MHz

91MHz

92MHz

93MHz

94MHz

95MHz

96MHz

97MHz

98MHz

99MHz

100MHz

101MHz

102MHz

103MHz

92MHz

93MHz

94MHz

95MHz

96MHz

97MHz

98MHz

99MHz

100MHz

101MHz

102MHz

103MHz

104MHz

105MHz

88MHz

89MHz

90MHz

91MHz

92MHz

93MHz

96MHz

97MHz

98MHz

99MHz

100MHz

101MHz

102MHz

103MHz

104MHz

105MHz

106MHz

107MHz

108MHz

ANTENNA DEVICE FOR MOTOR VEHICLE

BACKGROUND OF THE INVENTION

1. Field of the Invention

The present invention relates to an antenna device comprising a glass antenna formed on a window glass panel of a motor vehicle, particularly to an antenna device comprising a glass antenna formed on a rear window glass panel on which a defogger is provided.

2. Related Art

In Japanese Patent Publication No. P2003-500870A, there is disclosed a glass antenna device for a motor vehicle comprising an AM antenna and an FM antenna on a rear window glass panel provided with a defogger for defogging. FIG. 1 shows the glass antenna device disclosed in the above-described publication.

In this glass antenna device, an AM antenna 12, an FM antenna 14, and a defogger 16 are formed on a rear window glass panel 10.

The AM antenna 12 is composed of an antenna pattern consisting of a plurality of linear conductors arranged in a horizontal direction like a fork shape. The sensitivity of the AM antenna 12 is determined by the area of an antenna pattern thereof, so that the AM antenna 12 is provided in such a manner that the antenna pattern occupies the most part of a space above the defogger 16 on the rear window glass panel 10.

The FM antenna 14 is formed by one linear conductor extending in a horizontal direction on a space between the antenna 12 and the defogger 16.

The defogger 16 comprises bus-bars 16*a* and 16*b* arranged oppositely in an up and down direction on both sides of the rear window glass panel 10, a plurality of heating lines 16*c* arranged in a horizontal direction between the bus-bars 16*a* and 16*b*, and a short-circuit line 16*d* to connect the plurality of heating lines. The bus-bars 16*a* and 16*b* are connected to a direct-current (DC) power supply 20 through choke coils 18*a* and 18*b*, respectively.

A feeding terminal 12*a* of the AM antenna 12 is connected through a lead wire 12*b* to a two-input amplifier 22, and a feeding terminal 14*a* of the FM antenna 14 is connected through a leas wire 14*b* to the amplifier 22. The amplifier 22 is connected to a radio set (not shown) through a coaxial cable 24.

When the AM and FM antennas 12 and 14 are provided in a space other than the defogger on the rear window glass panel 10 and the two-input amplifier 22 is used, the directivity of the FM antenna is remarkably degraded in a given angle. This is due to the fact that while the sensitivity of the FM antenna is tuned by the length of the FM antenna element including the lead wire, a capacitive coupling to heating lines of the defogger, and a capacitive coupling to the AM antenna, the directivity of the FM antenna is affected by the approaching of the AM antenna to a motor vehicle body.

SUMMARY OF THE INVENTION

It is therefore an object of the present invention to improve the directivity of the FM antenna in a glass antenna device having the AM and FM antennas provided on a rear window glass panel on which a defogger is formed.

A first aspect of the present invention is an antenna device for a motor vehicle comprising a defogger provided on a rear window glass panel of the motor vehicle; an AM antenna provided in a space other than the defogger on the rear window glass panel; an FM antenna provided in a space between the defogger and the AM antenna on the rear window glass panel; a two-input amplifier for amplifying signals received by the AM and FM antennas; an AM lead wire for connecting between a feeding terminal of the AM antenna and the amplifier; an FM lead wire for connecting between a feeding terminal of the FM antenna and the amplifier; and an inductor inserted in the AM lead wire near to the AM feeding terminal; wherein the inductor opens the AM lead wire in a high frequency to cut off a signal from the AM antenna when a signal received by the FM antenna is amplified by the amplifier.

A second aspect of the present invention is an antenna device for a motor vehicle comprising a defogger provided on a rear window glass panel of the motor vehicle; an AM antenna provided in a space other the defogger on the rear window glass panel; an FM antenna provided in a space between the defogger and the AM antenna on the rear window glass panel; a two-input amplifier for amplifying signals received by the AM and FM antennas; a terminal base provided near to the feeding terminal of the AM antenna on the rear window glass panel; an inductor provided between the feeding terminal of the AM antenna and the terminal base; an AM lead wire for connecting between the terminal base and the amplifier; and; an FM lead wire for connecting between a feeding terminal of the FM antenna and the amplifier; wherein the inductor opens the AM lead wire in a high frequency to cut off a signal from the AM antenna when a signal received by the FM antenna is amplified by the amplifier.

A third aspect of the present invention is an antenna device for a motor vehicle comprising a defogger provided on a rear window glass panel of the motor vehicle; an AM antenna provided in a space other than the defogger on the rear window glass panel; an FM antenna provided in a space between the defogger and the AM antenna on the rear glass window panel; a two-input amplifier for amplifying signals received by the AM and FM antennas; a feeding terminal of the AM antenna provided with an inductor; an AM lead wire for connecting between a feeding terminal of the AM antenna and the amplifier; and an FM lead wire for connecting between a feeding terminal of the FM antenna and the amplifier; wherein the inductor opens the AM lead wire in a high frequency to cut off a signal from the AM antenna when a signal received by the FM antenna is amplified by the amplifier.

It is preferable in the glass antenna devices described above that the inductance of the inductor is in the range of 1.0 μH–6.8 μH.

According to the glass antenna device for a motor vehicle of the present invention, a good directivity of the FM antenna is obtained by inserting the inductor in the AM lead wire, because the inductor opens the AM lead wire in a high frequency to present the directivity of the FM antenna from being affected by the AM antenna. A good directivity of the FM antenna means herein that the sensitivity of the FM antenna is 15 dB or more, preferably 20 dB or more, more preferably 30 dB or more is held at the entire perimeter in an approximately horizontal direction.

BEST MODE FOR CARRYING OUT THE INVENTION

Figure 1:
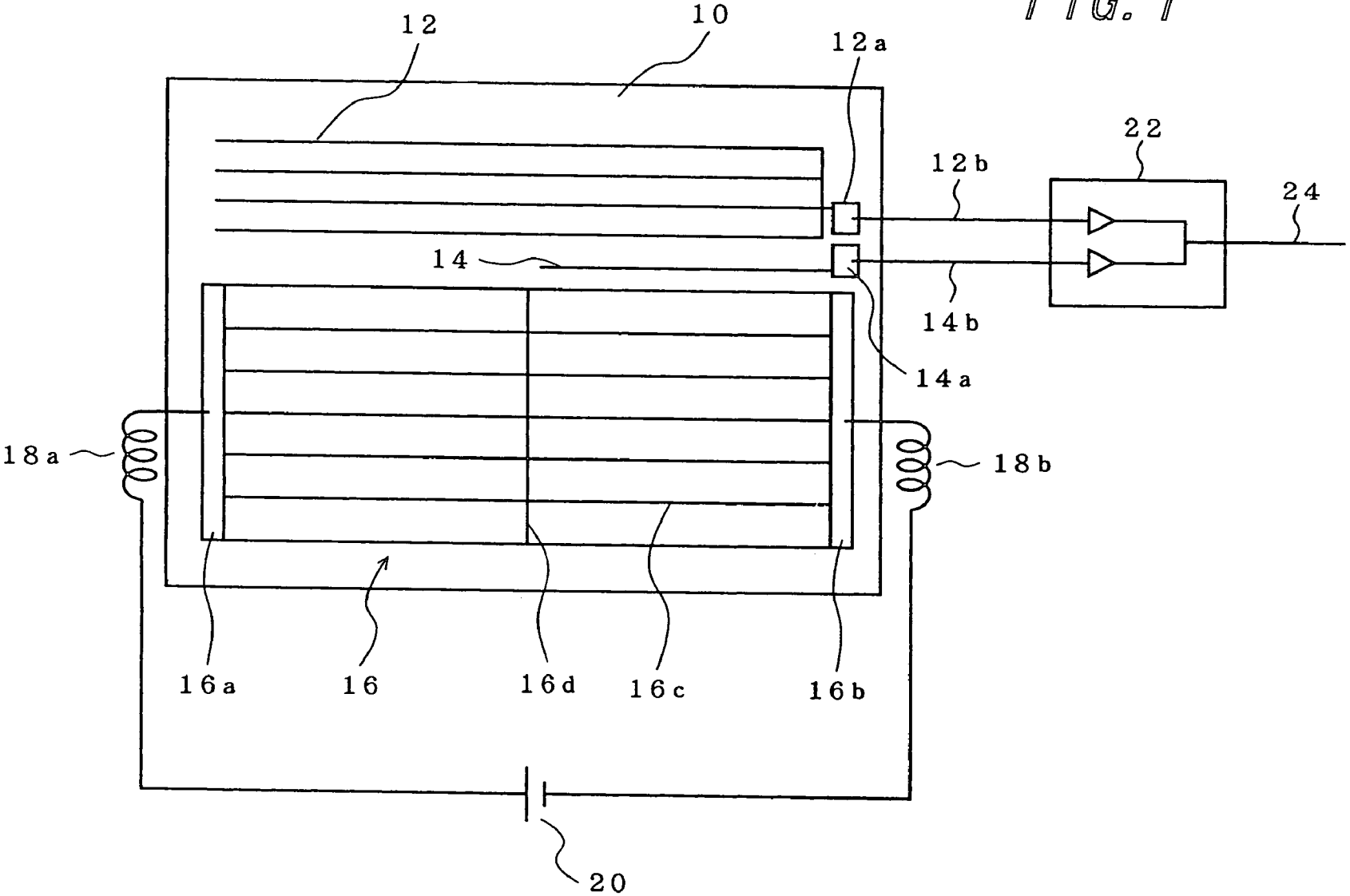
FIG. 1 shows a conventional glass antenna device for a motor vehicle.
Figure 2:
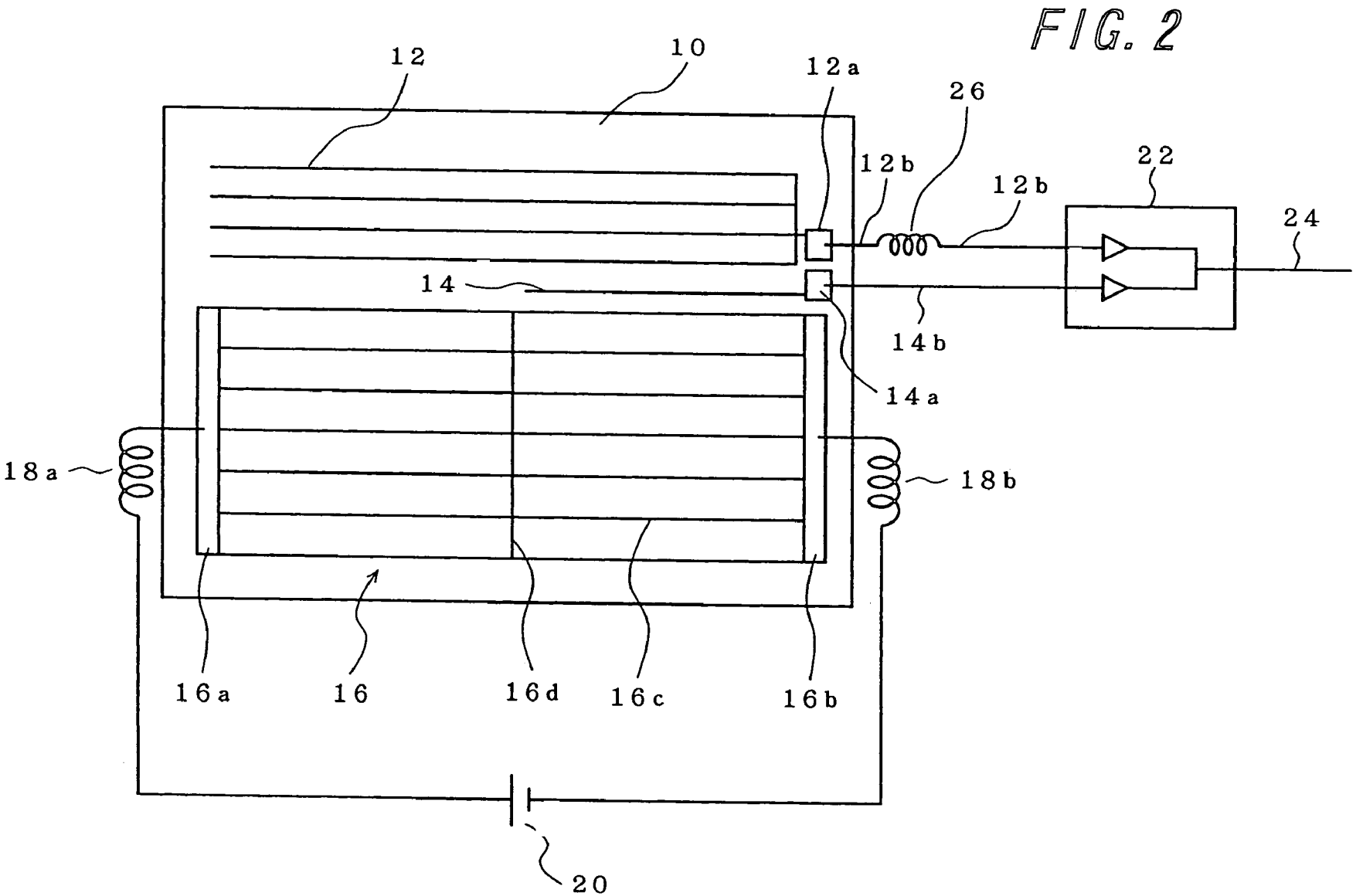
FIG. 2 shows a glass antenna device for a motor vehicle in accordance with the present invention.

Reference to FIG. 2, there is shown a glass antenna device of an embodiment in accordance with the present invention. An inductor 26 is inserted in the lead wire 12*b* between the AM feeding terminal 12*a* and the two-input amplifier 22 in the glass antenna device shown in FIG. 1. The residual structure in FIG. 2 is the same as that in FIG. 1. Therefore, the same component in FIGS. 1 and 2 is designated by the same reference numeral.

The purpose of the inductor 26 is to open the AM lead wire 12*b* in a high frequency. If the AM lead wire 12*b* is opened in a high frequency, the high frequency received by the AM antenna may be cut off by the inductor to avoid an adverse effect to the directivity of the FM antenna 14.

It is preferable that the inductor 26 is provided at a position near to the feeding terminal 12*a* of the AM antenna 12. This is due to the fact that if a capacitive coupling is generated between the AM lead wire 12*b* (between the inductor 26 and the feeding terminal 12*a*) and the FM lead wire 14*b* arranged in proximity to each other, the high frequency received by the AM antenna 12 is connected to the FM lead wire 14*b* through the generated coupling capacitor prior to the high frequency being cut off by the inductor 26. Therefore, when the inductor 26 is provided in the two-input amplifier 22, the effect of the inductor may not be essentially obtained.

An AM bandwidth is in the range of 500 kHz–1.6 MHz, an FM bandwidth (in Japan) is in the range of 76 MHz–90 MHz, and an FM bandwidth (in foreign counties) is in the range of 88 MHz–108 MHz. In order to open the AM lead wire 12*b* in a high frequency, the inductor 26 is required to have a high impedance to the FM bandwidth.

The values of effective inductance of the inductor were measured. The fork-shaped AM antenna 12 was constructed by nine linear conductors each having approximately 100 cm arranged in parallel at 2 cm intervals and each one end thereof being connected together. The FM antenna 14 was structured by one linear conductor of approximately 27 cm length. The distance between the AM antenna 12 and the defogger 16 was approximately 3 cm, and the distance between the FM antenna 14 and the defogger 16 was approximately 0.5 cm.

The length of the AM lead wire 12*b* in which the inductor 26 was inserted was 24.5 cm, and the length of the FM lead wire 14*b* was 20 cm. The length of the AM lead wire 12*b* between the feeding terminal 12*a* and the inductor 26 was 4 cm. The structure of the AM lead wire 12*b* in which the inductor 26 is inserted will be described later with reference to FIG. 17.

The motor vehicle provided with the above-described antenna device was set in an electric wave dark room and rotated around 360° to measure the sensitivity and directivity for an FM wave coming from an approximately horizontal direction (the elevation angle was approximately 2°). The sensitivity and directivity was measured for each case of the inductance L of the inductor 26 such as 0.68 μH, 1.0 μH, 2.2 μH, 3.9 μH, 6.8 μH or 8.2 μH. For comparison, the sensitivity and directivity of the glass antenna device having no inductor was measured. It is noted that the sensitivity was designated by a dipole (=60 dB) ratio sensitivity (dB). The measuring was carried out in such a manner that the FM wave was varied in a unit of 1 MHz in the range of 88 MHz–108 MHz.

Figure 3A:
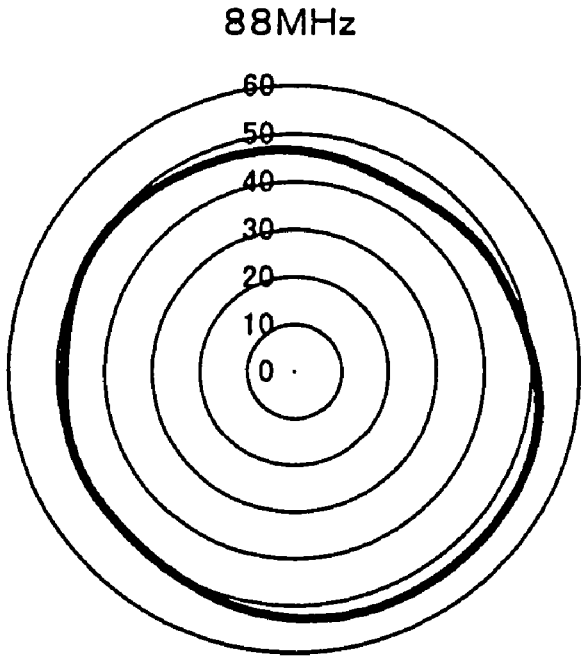
FIGS. 3A–3U show the measured directivity for a glass antenna device having no inductor, respectively.
Figure 3B:
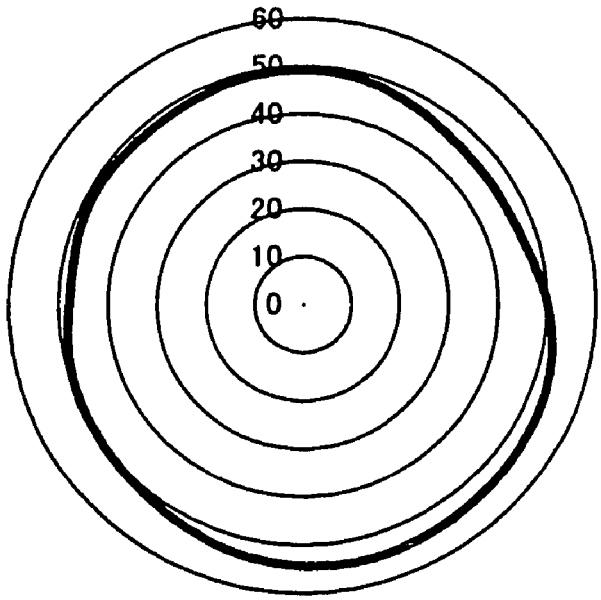
Figure 3C:
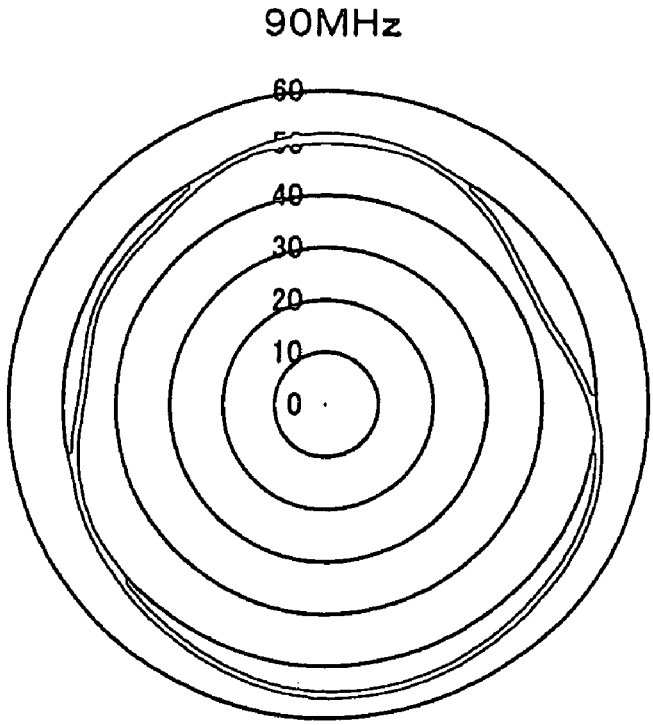
Figure 3D:
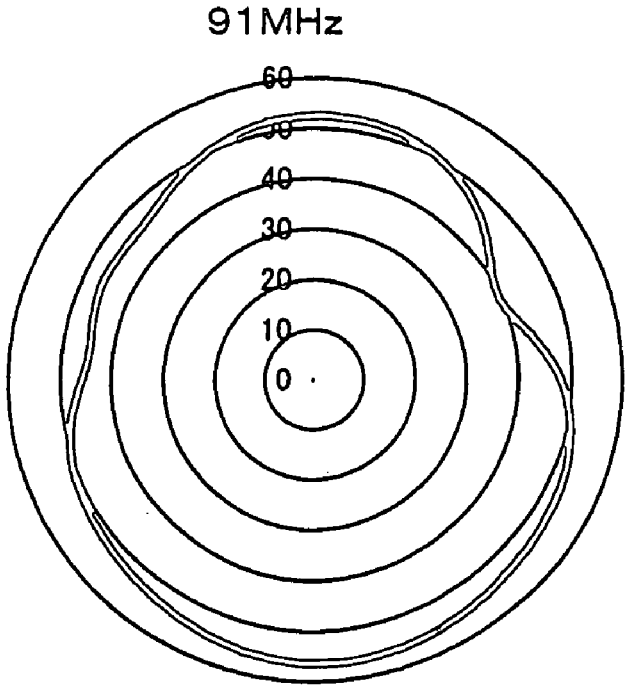
Figure 3E:
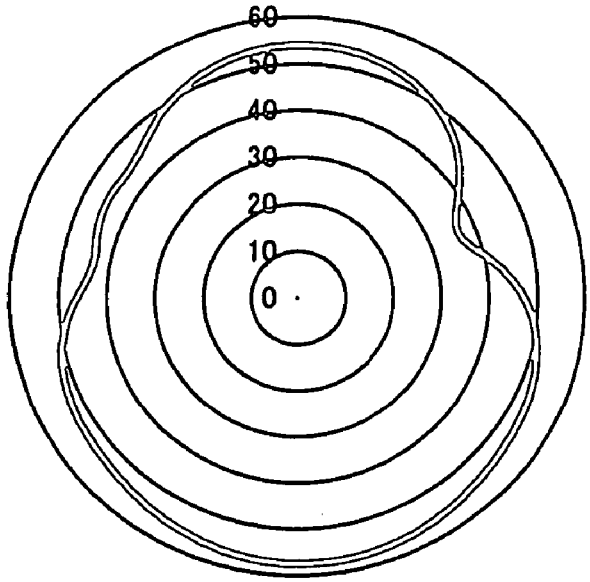
Figure 3F:
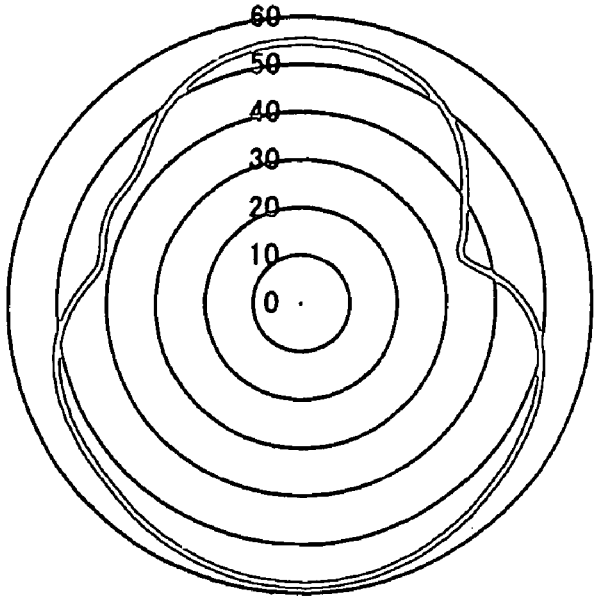
Figure 3G:
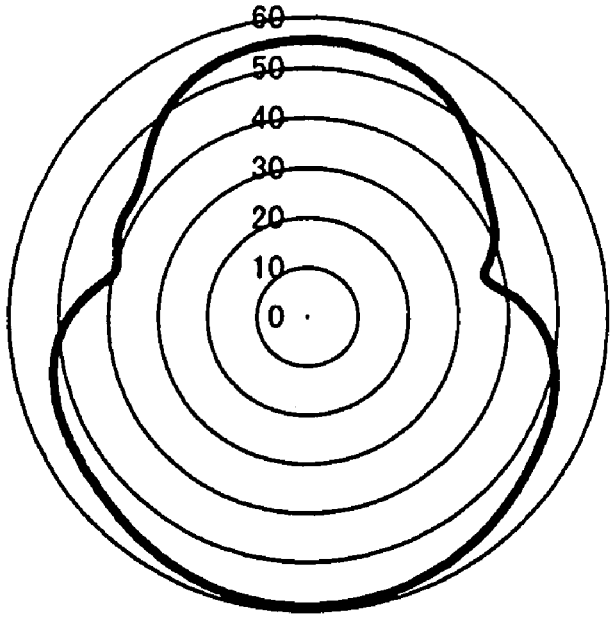
Figure 3H:
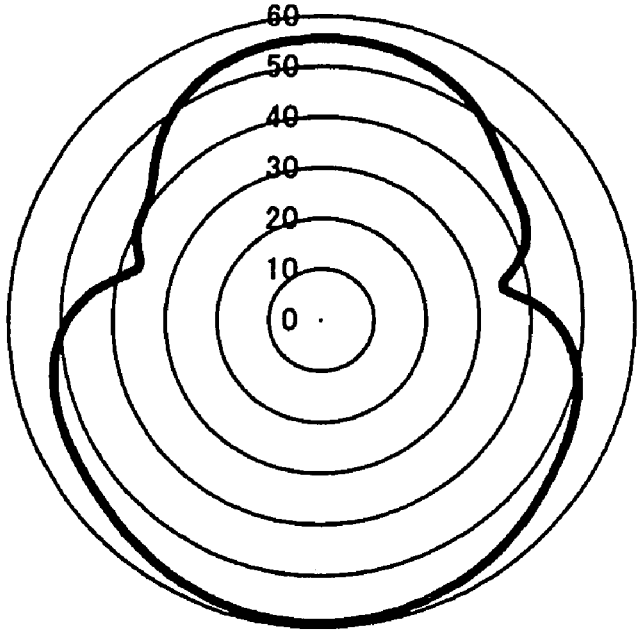
Figure 3I:
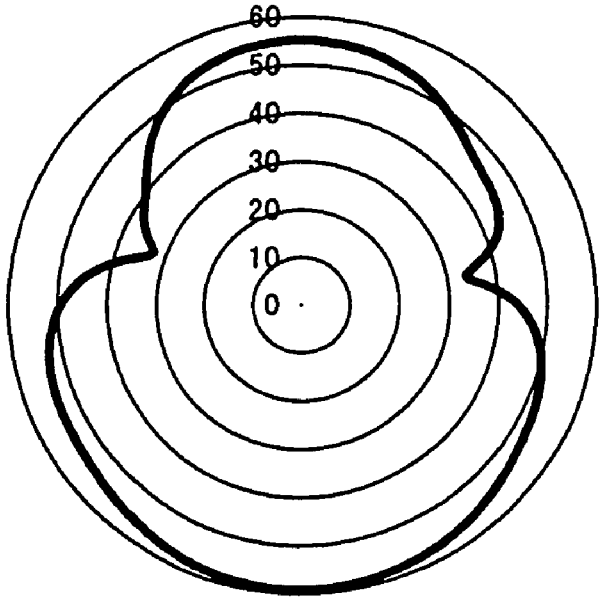
Figure 3J:
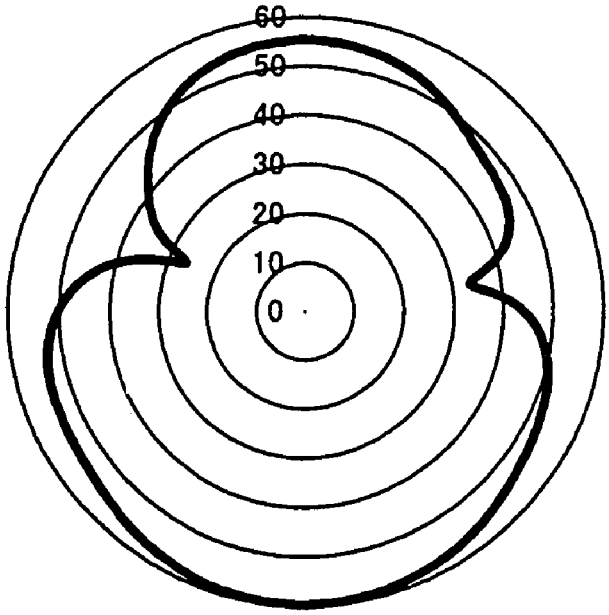
Figure 3K:
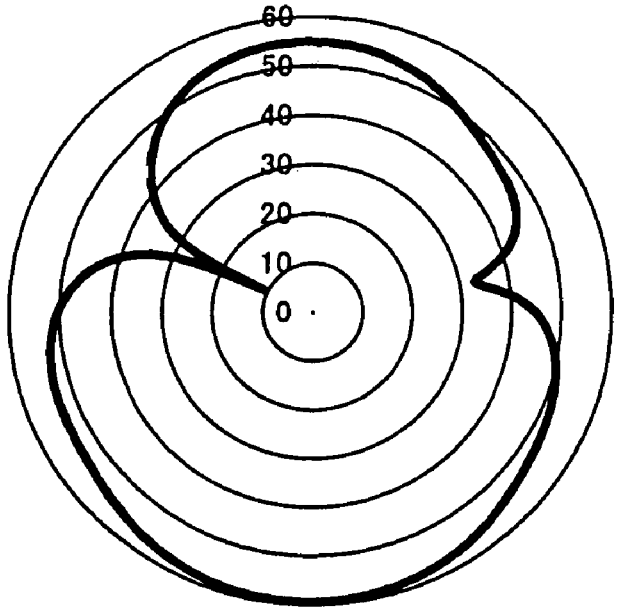
Figure 3L:
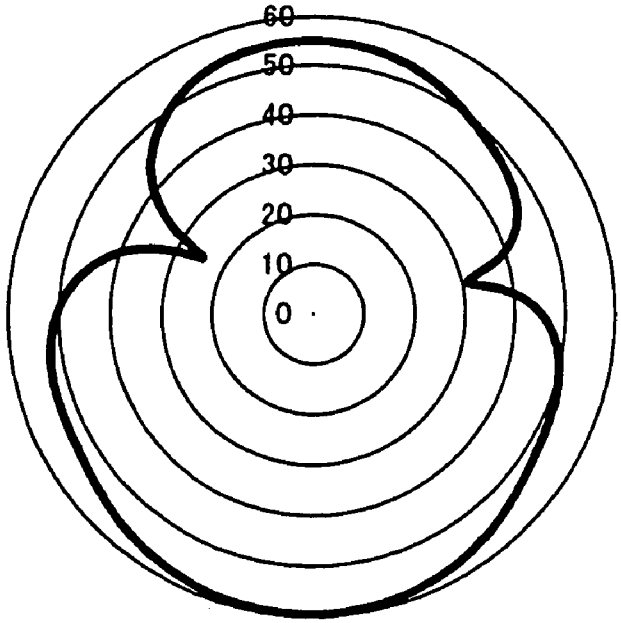
Figure 3M:
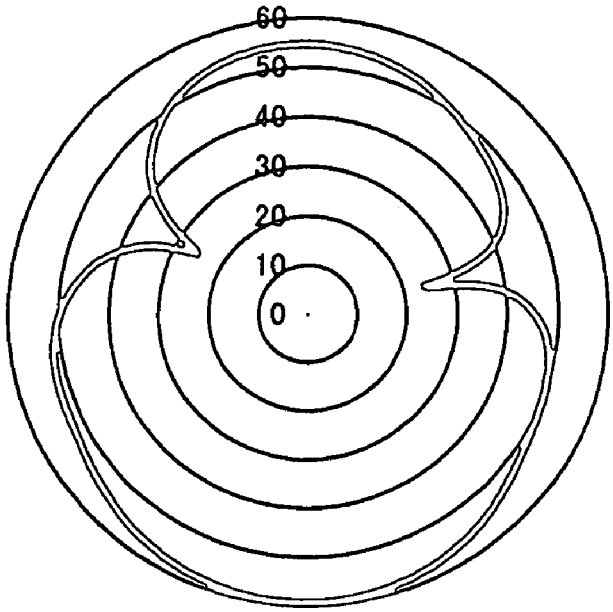
Figure 3N:
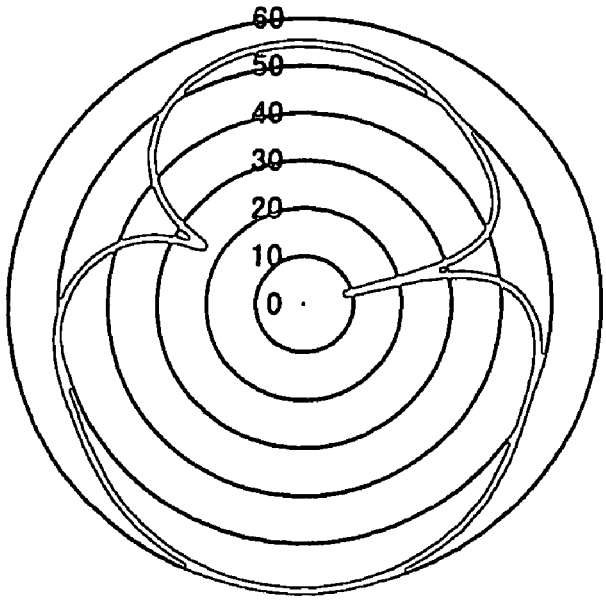
Figure 30:
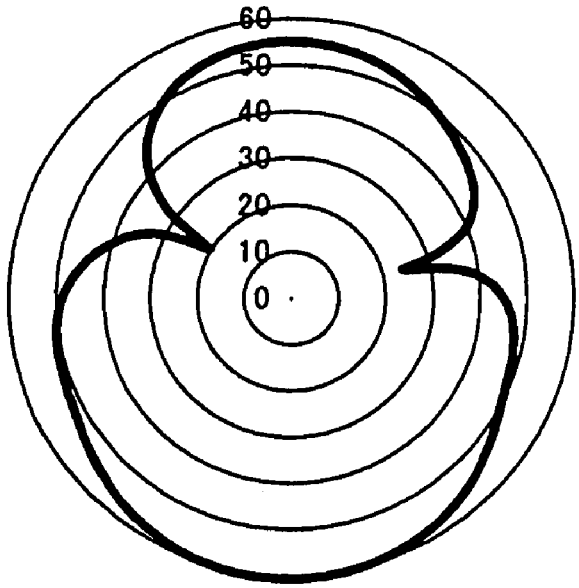
Figure 3P:
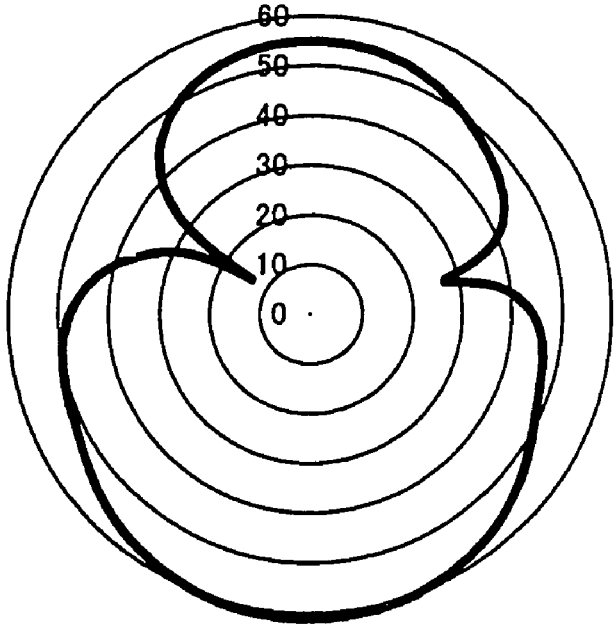
Figure 3Q:
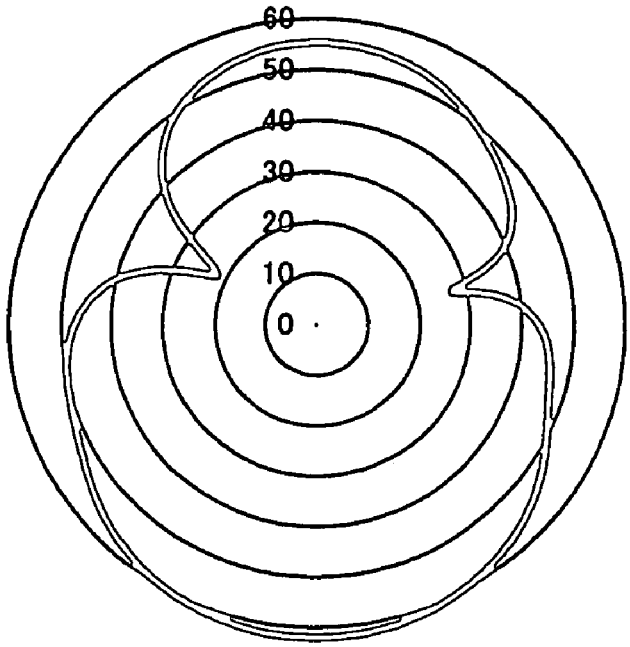
Figure 3R:
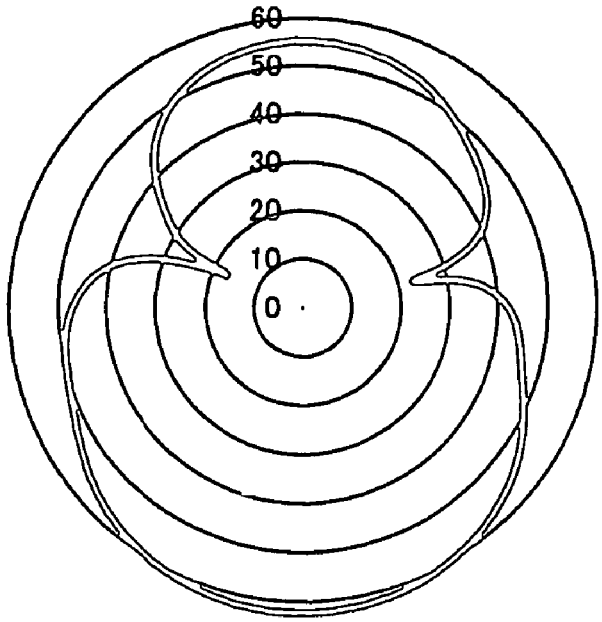
Figure 3S:
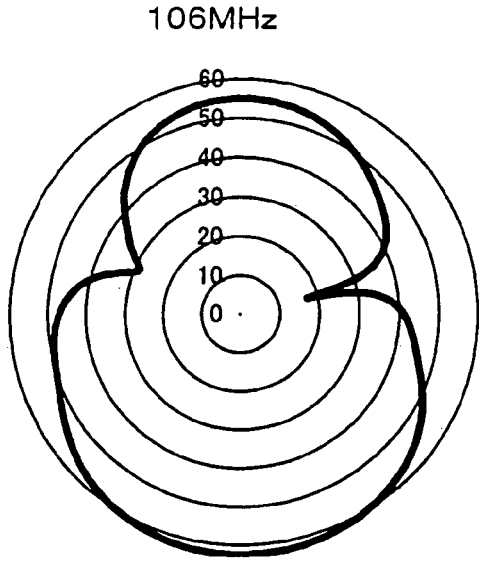
Figure 3T:
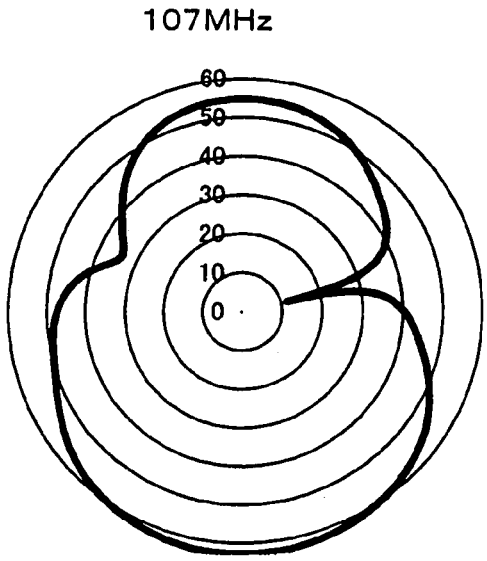
Figure 3U:
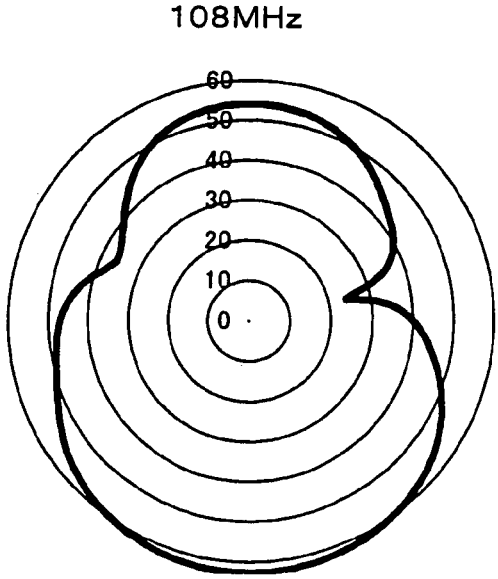

FIGS. 3A–3U shows the sensitivity and directivity measured for the glass antenna device having no inductor, respectively. Apparent from the measured results, the drop of the directivity for the glass antenna device having no inductor is observed.

Figure 4A:
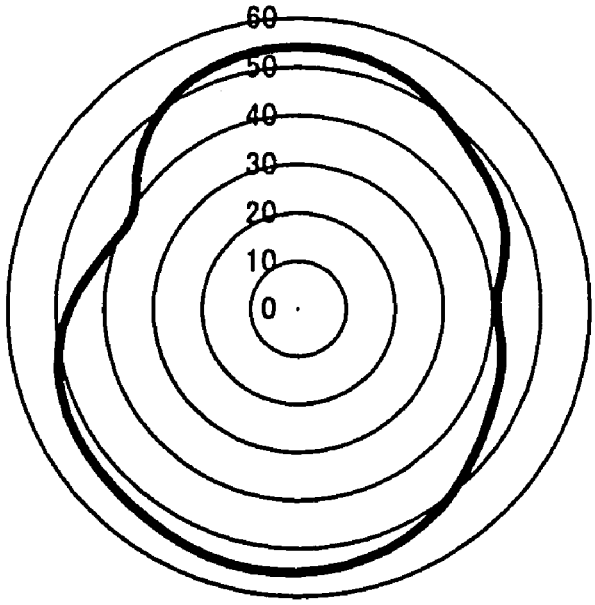
FIGS. 4A–4U show the measured directivity for a glass antenna device having an inductor of 0.68 H, respectively.
Figure 4B:
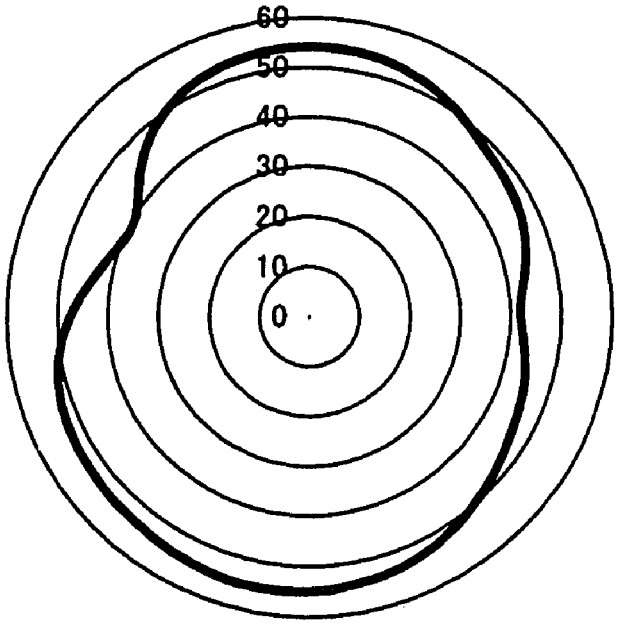
Figure 4C:
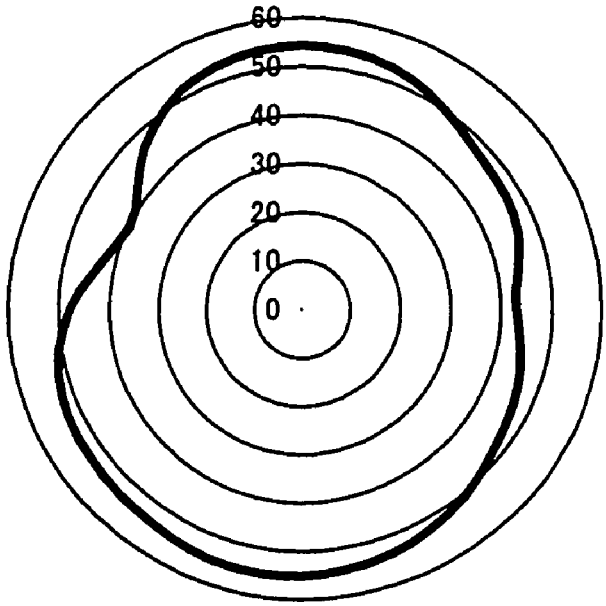
Figure 4D:
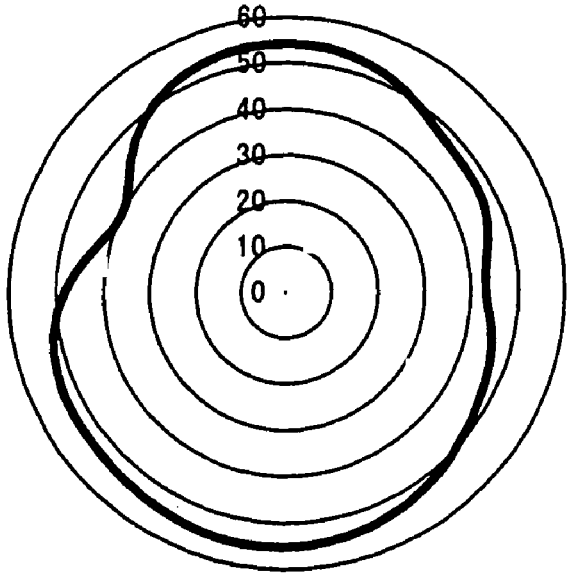
Figure 4E:
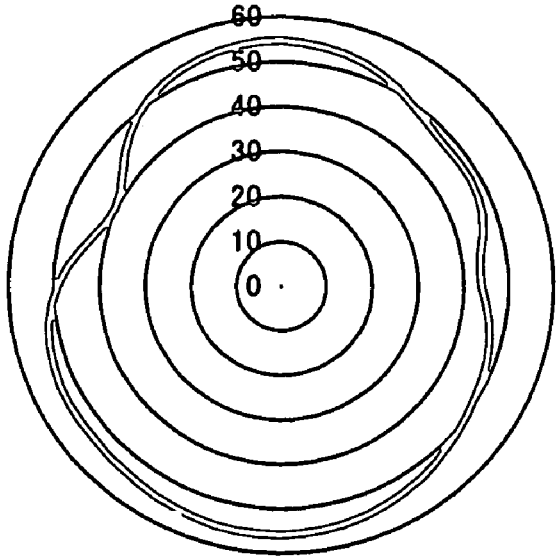
Figure 4F:
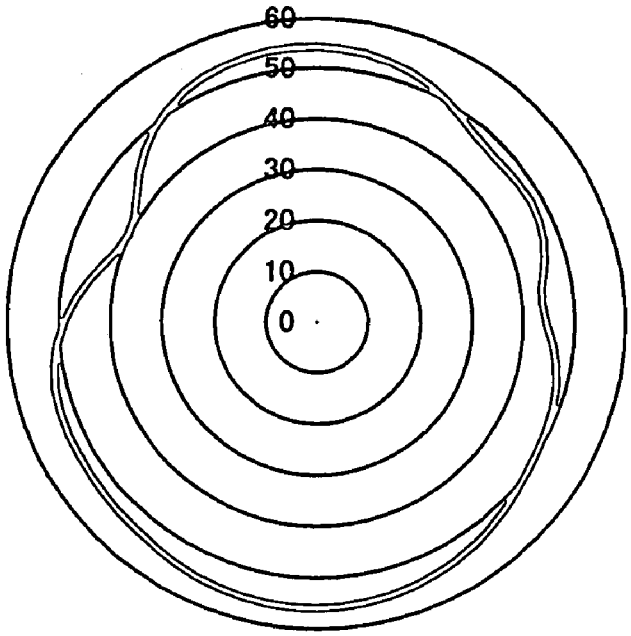
Figure 4G:
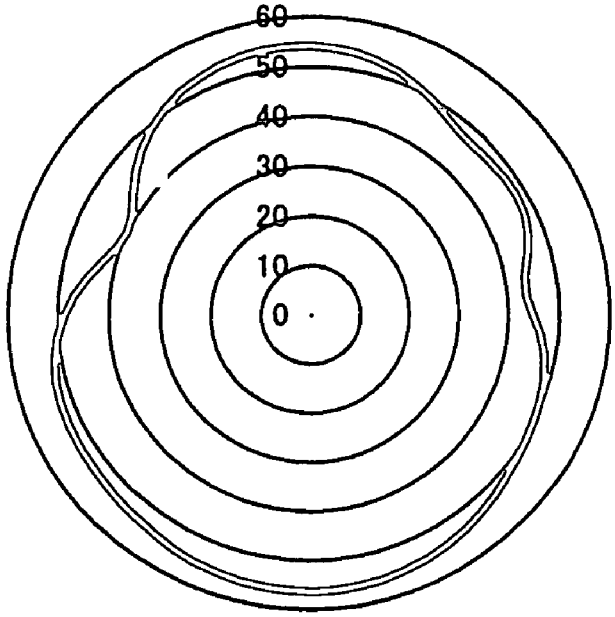
Figure 4H:
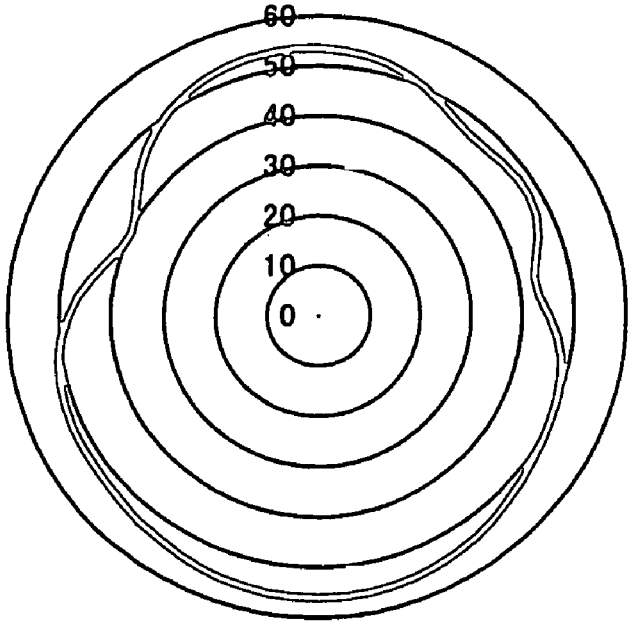
Figure 4I:
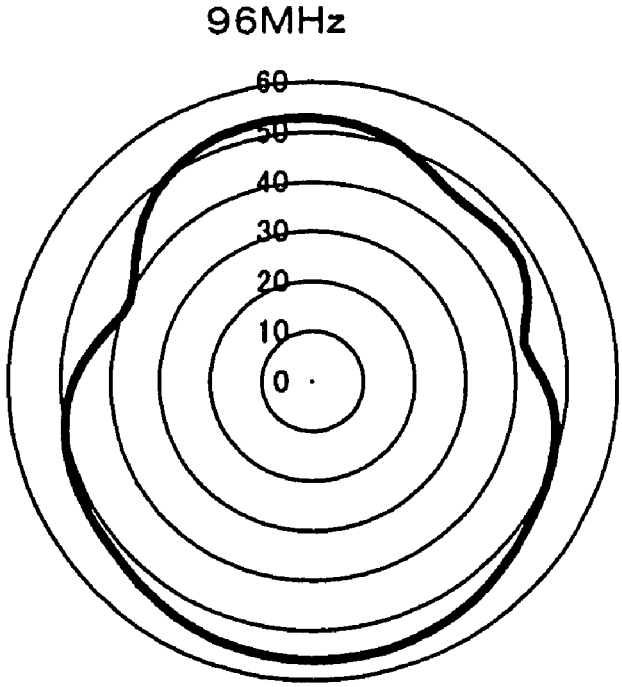
Figure 4J:
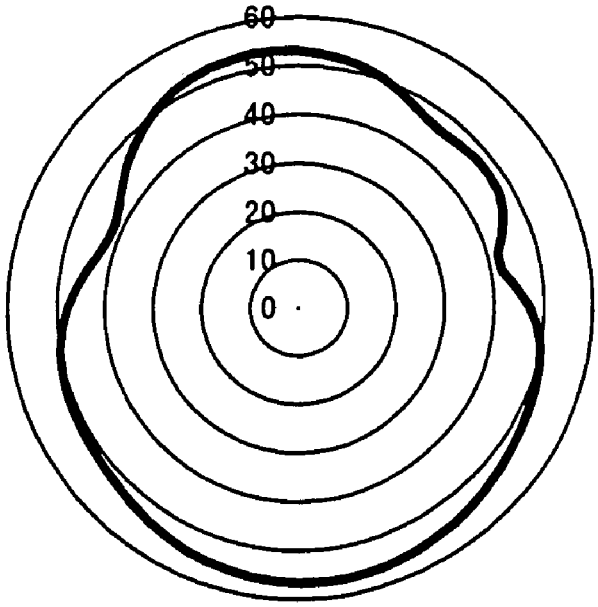
Figure 4K:
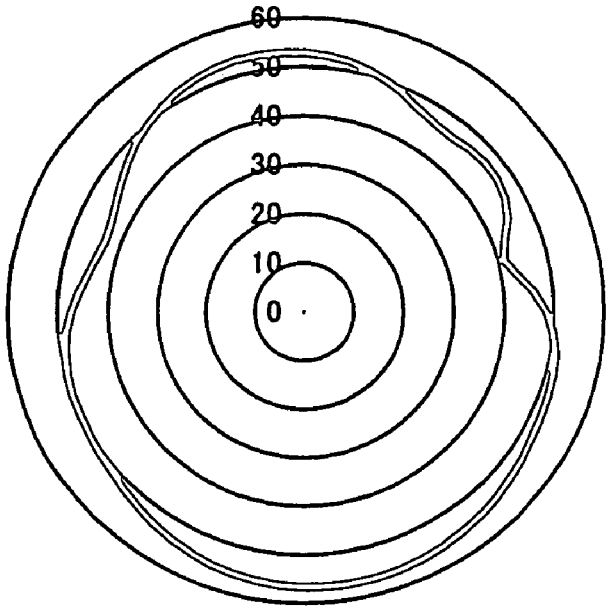
Figure 4L:
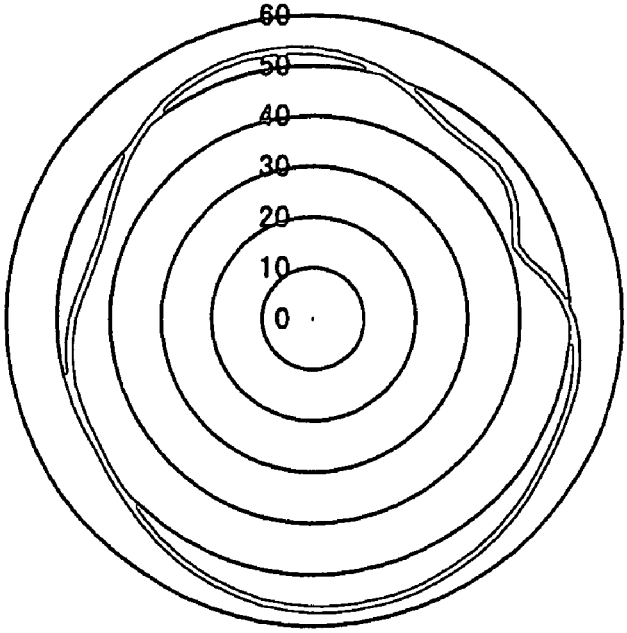
Figure 4M:
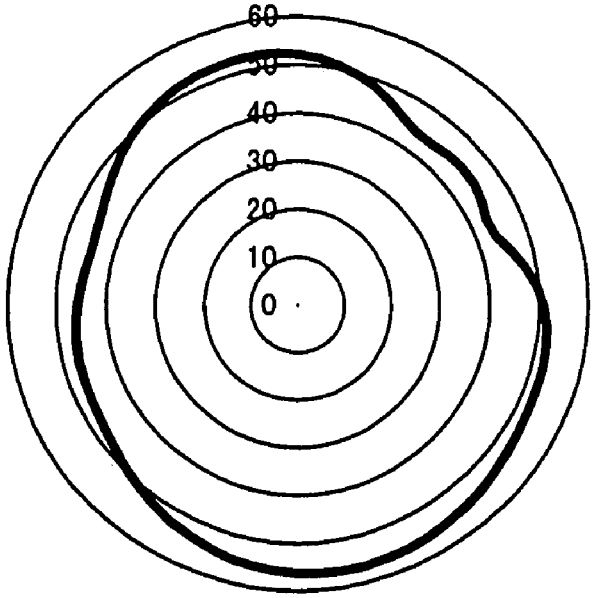
Figure 4N:
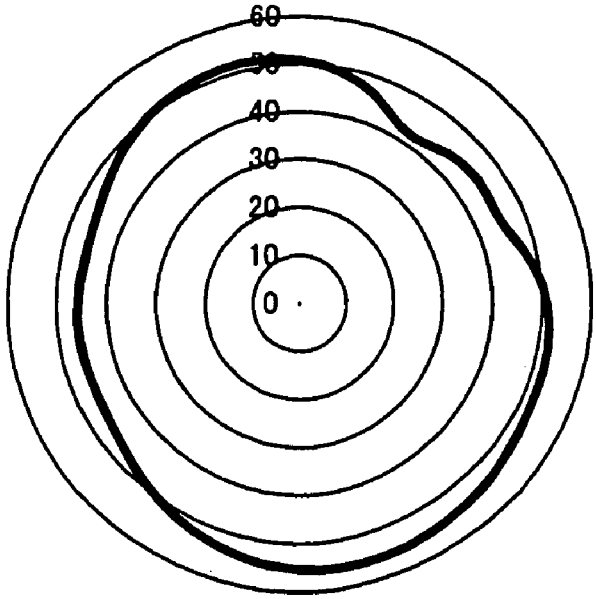
Figure 40:
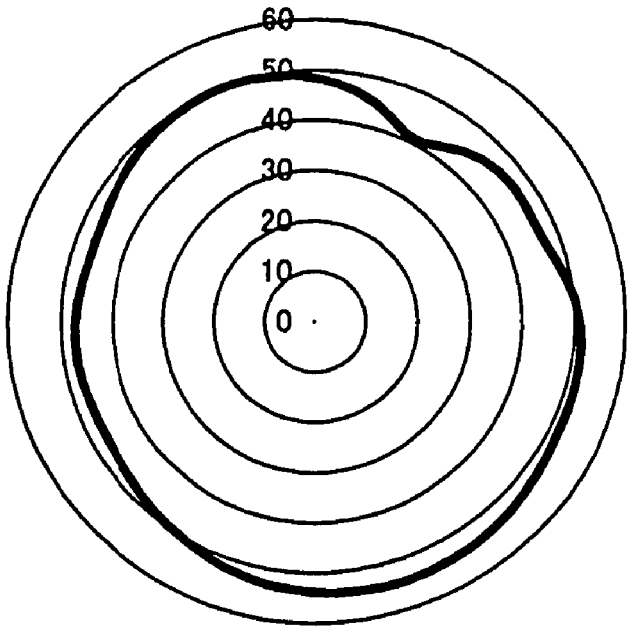
Figure 4P:
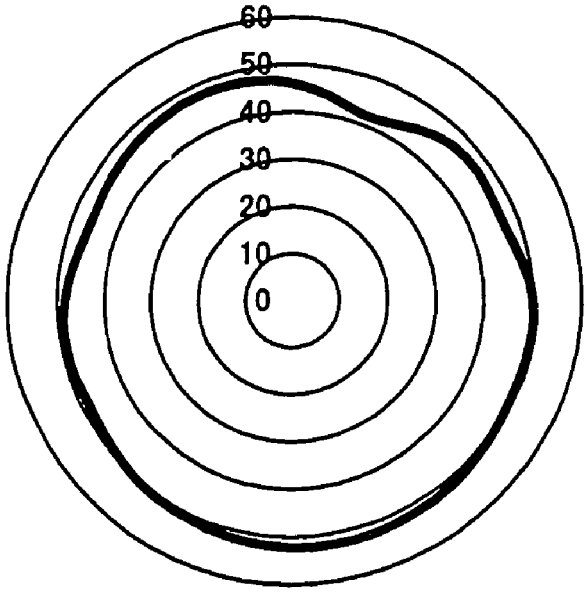
Figure 4Q:
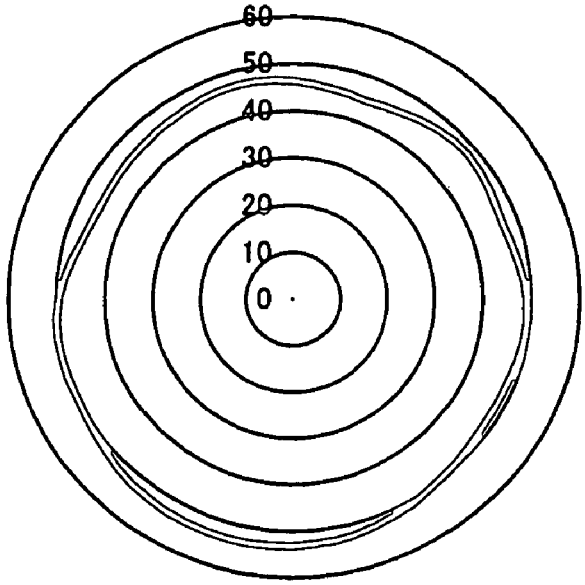
Figure 4R:
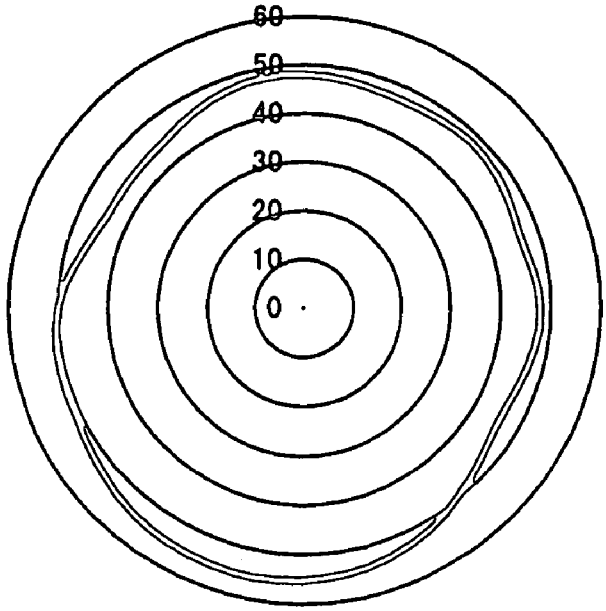
Figure 4S:
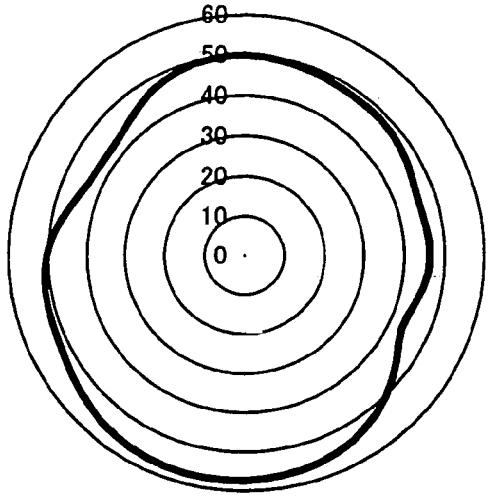
Figure 4T:
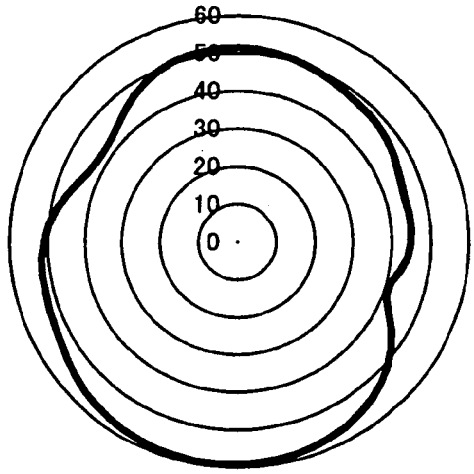
Figure 4U:
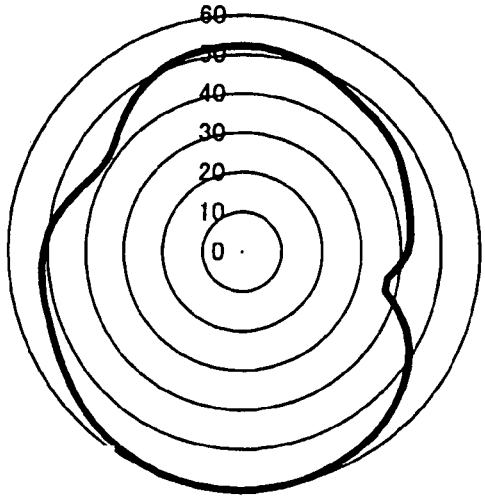

FIGS. 4A–4U show the sensitivity and directivity for the glass antenna device having the inductor 26, the inductance L thereof being 0.68 μH, respectively.

Figure 5A:
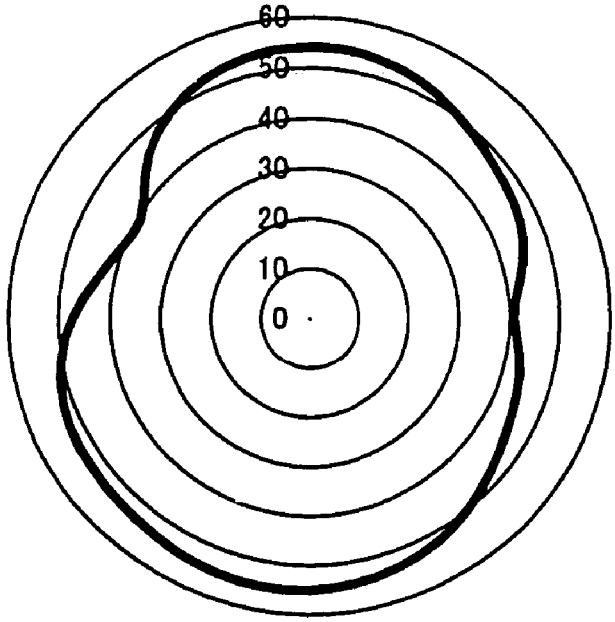
FIGS. 5A–5U show the measured directivity for a glass antenna device having an inductor of 1.0 μH, respectively.
Figure 5B:
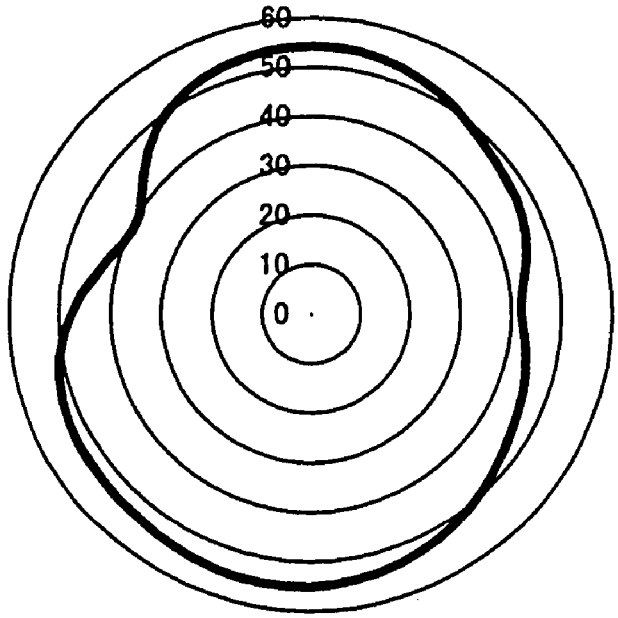
Figure 5C:
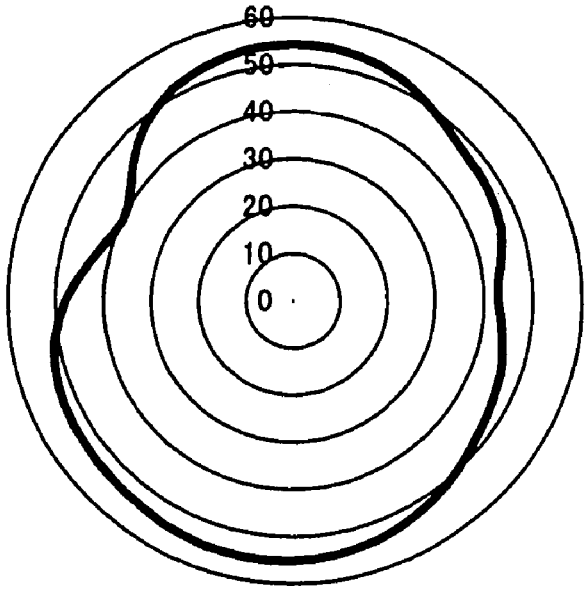
Figure 5D:
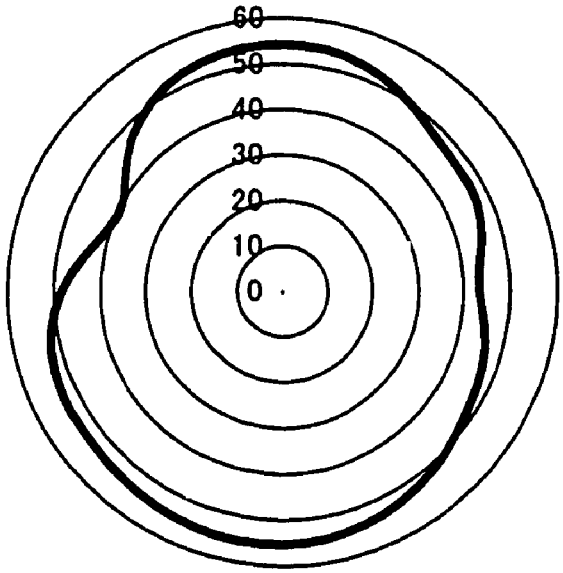
Figure 5E:
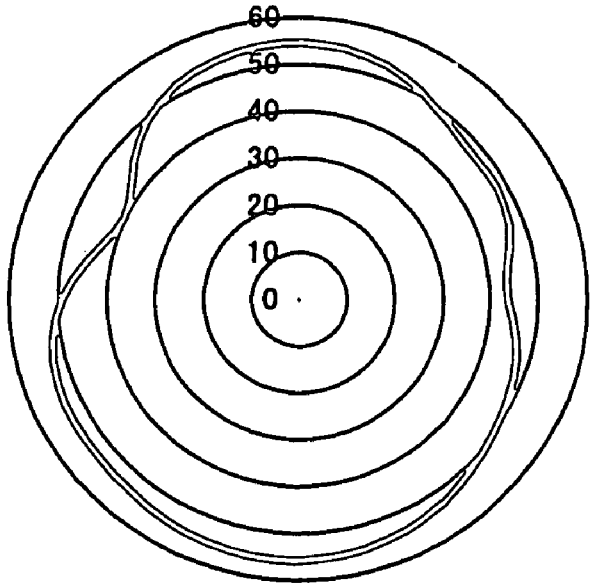
Figure 5F:
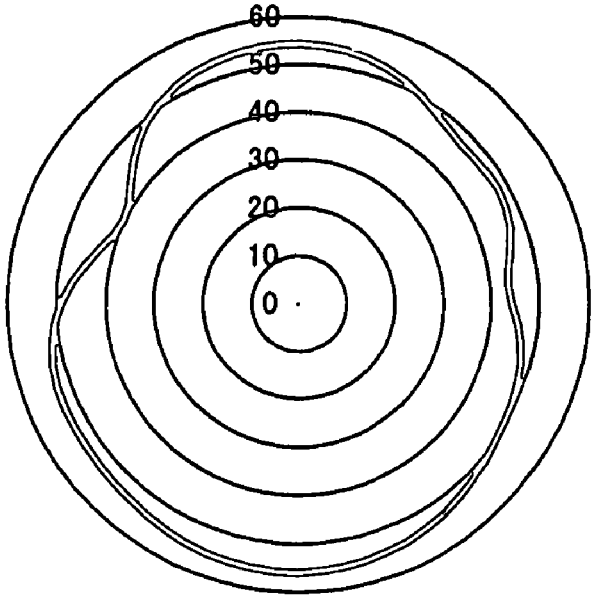
Figure 5G:
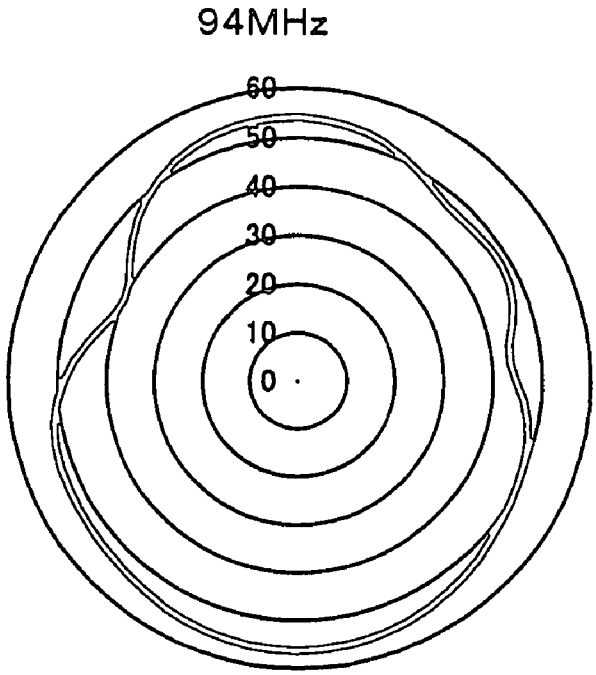
Figure 5H:
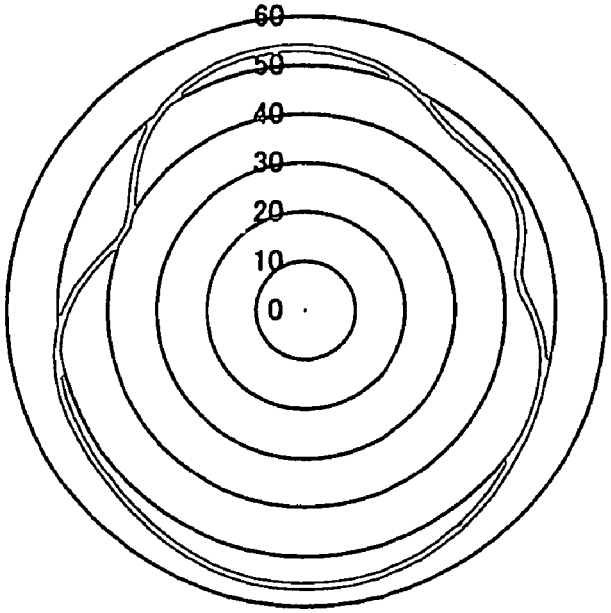
Figure 5I:
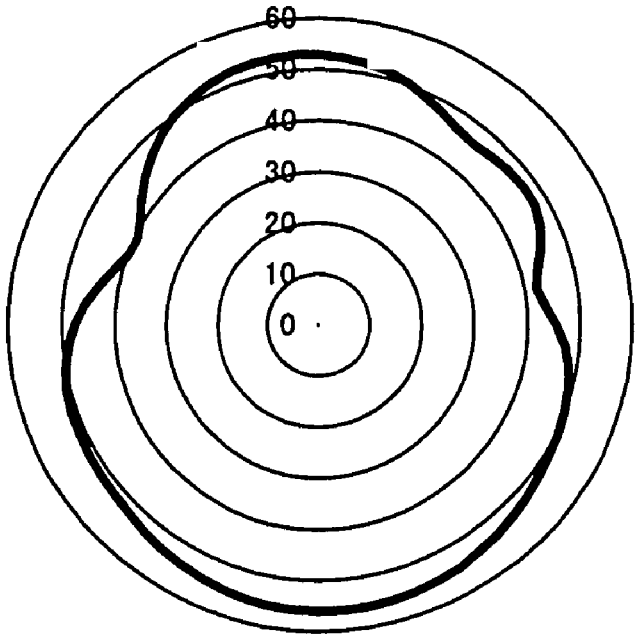
Figure 5J:
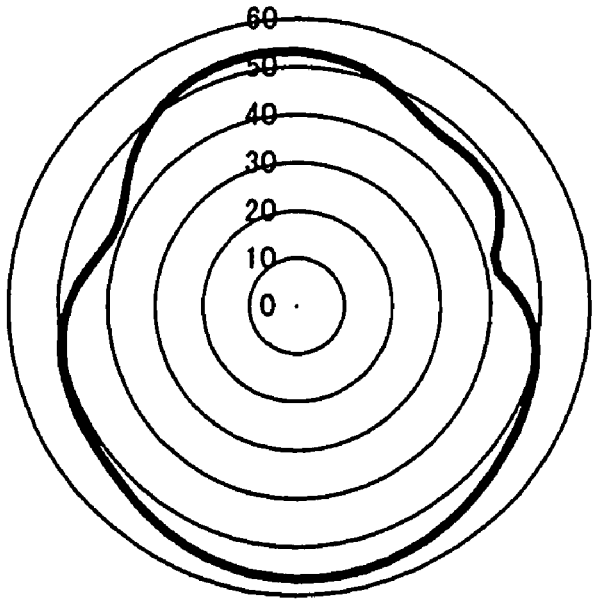
Figure 5K:
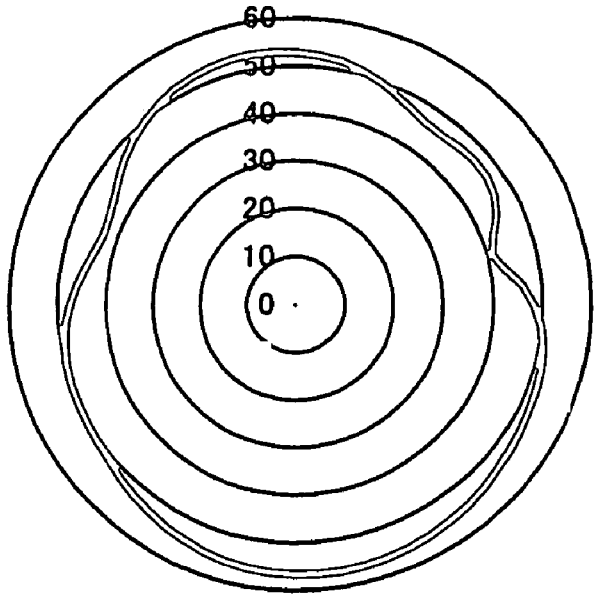
Figure 5L:
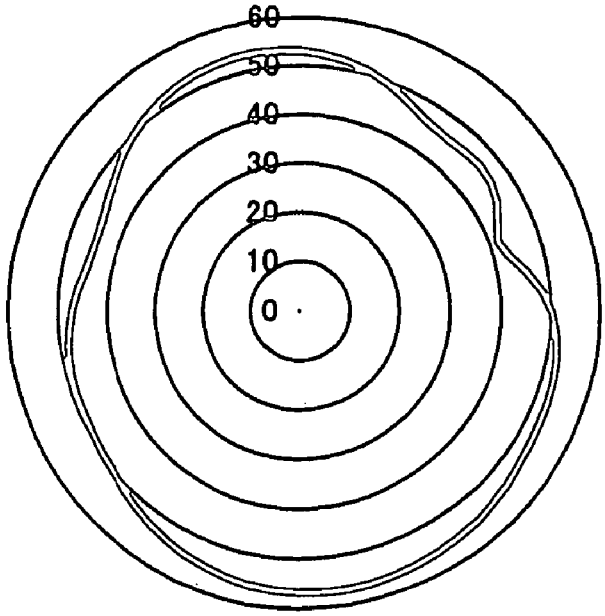
Figure 5M:
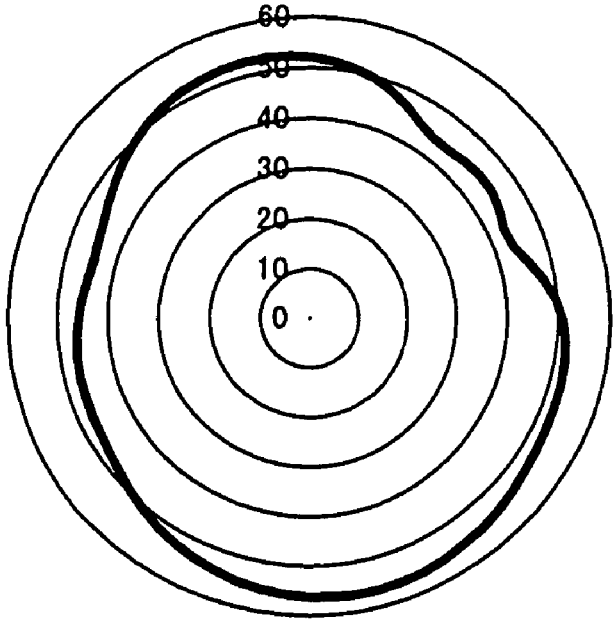
Figure 5N:
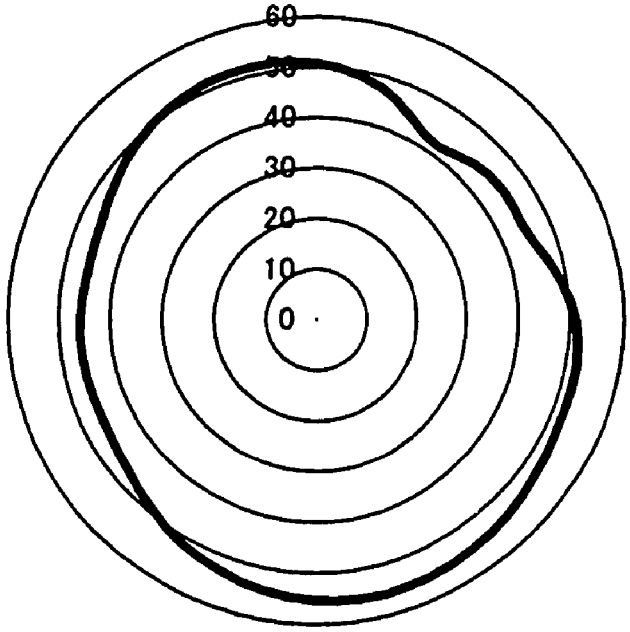
Figure 50:
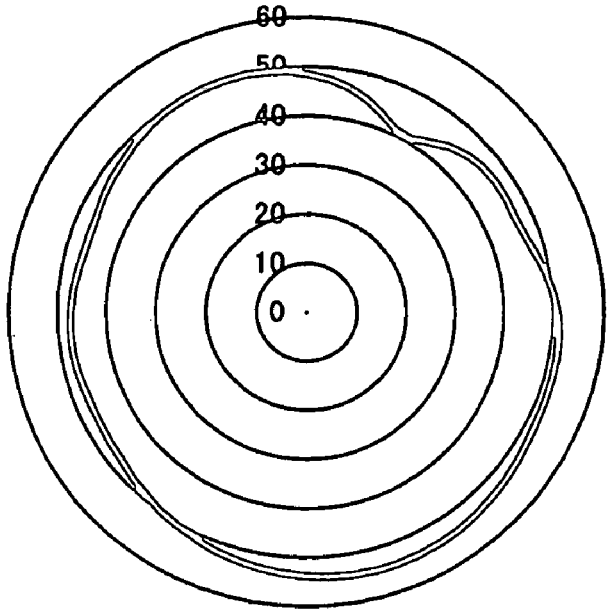
Figure 5P:
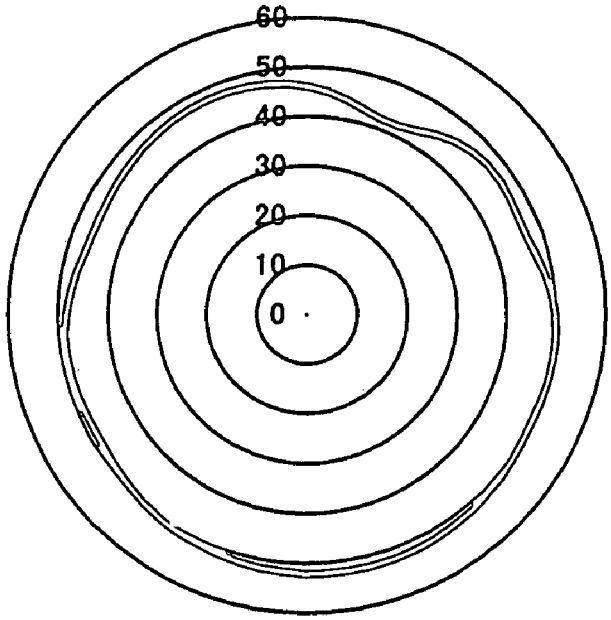
Figure 5Q:
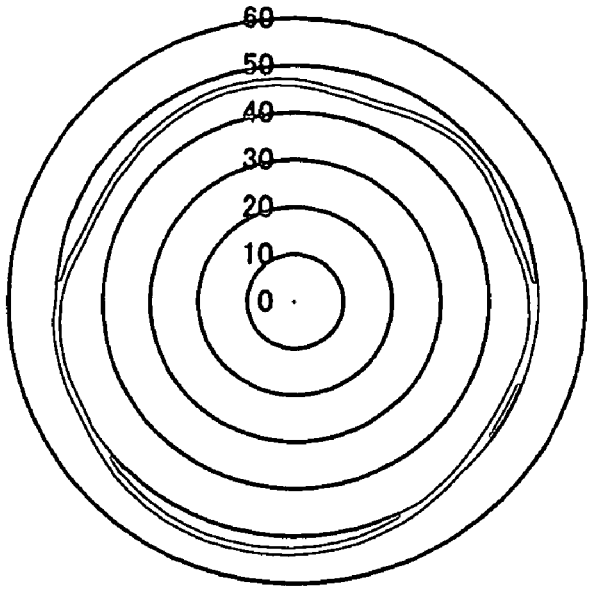
Figure 5R:
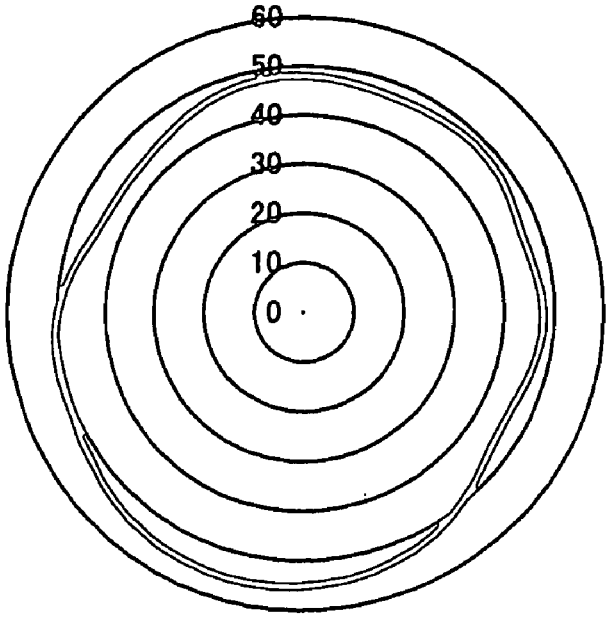
Figure 5S:
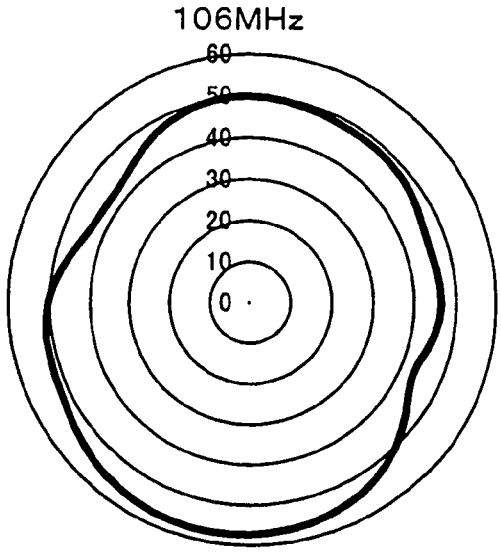
Figure 5T:
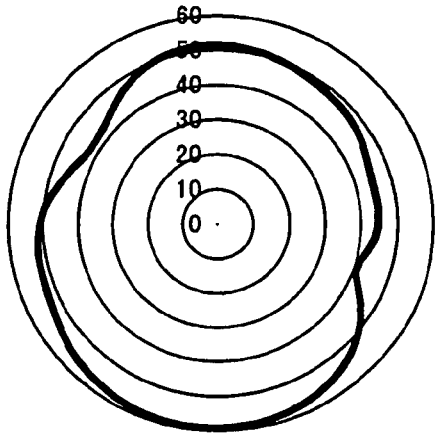
Figure 5U:
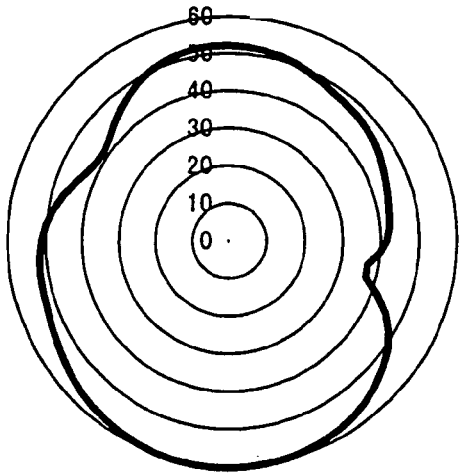

FIGS. 5A–5U show the sensitivity and directivity for the glass antenna device having the inductor 26, the inductance L thereof being 1.0 μH, respectively.

Figure 6A:
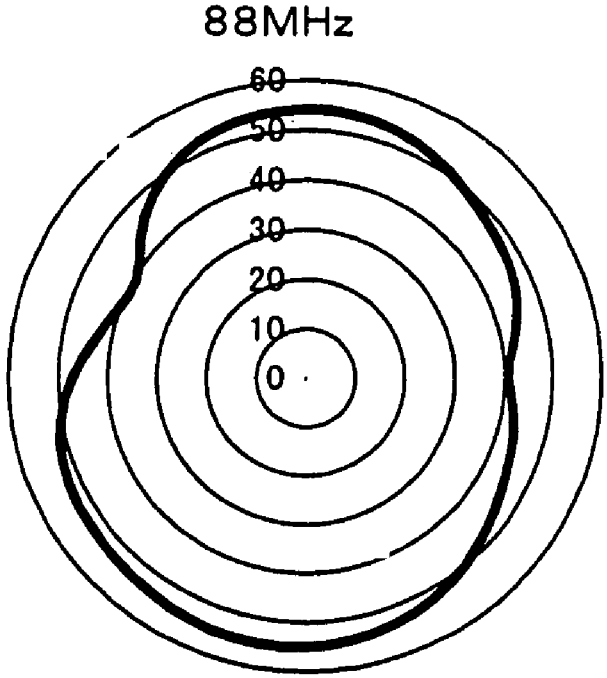
FIGS. 6A–6U show the measured directivity for a glass antenna device having an inductor of 2.2 μH, respectively.
Figure 6B:
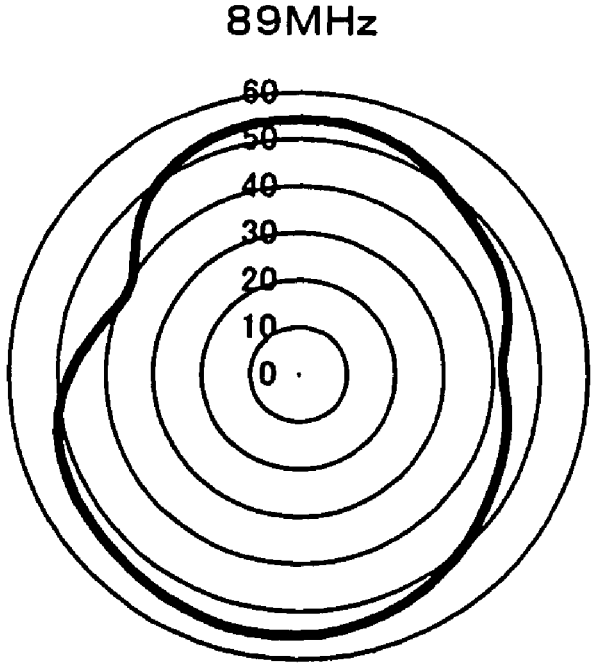
Figure 6C:
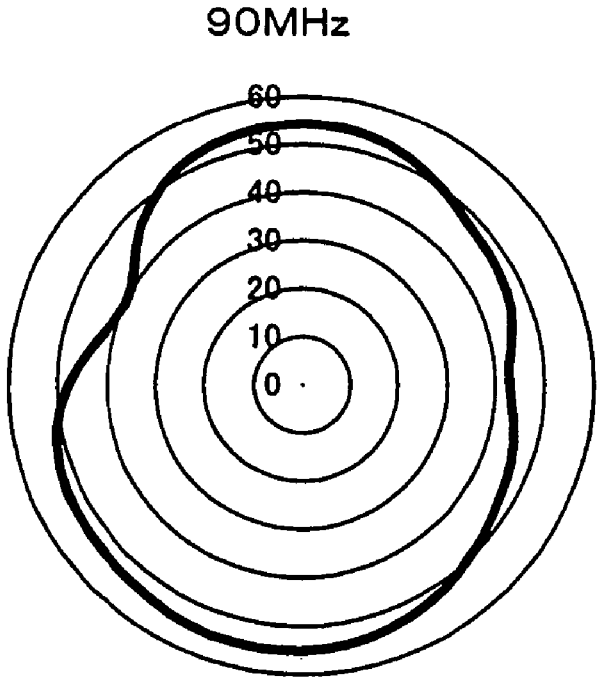
Figure 6D:
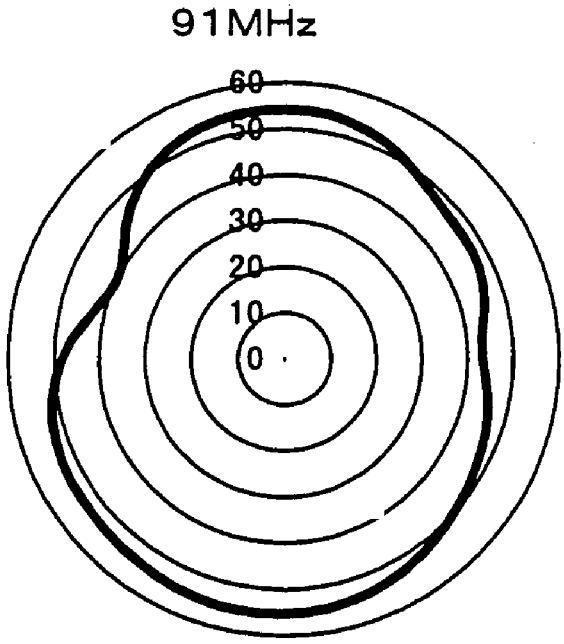
Figure 6E:
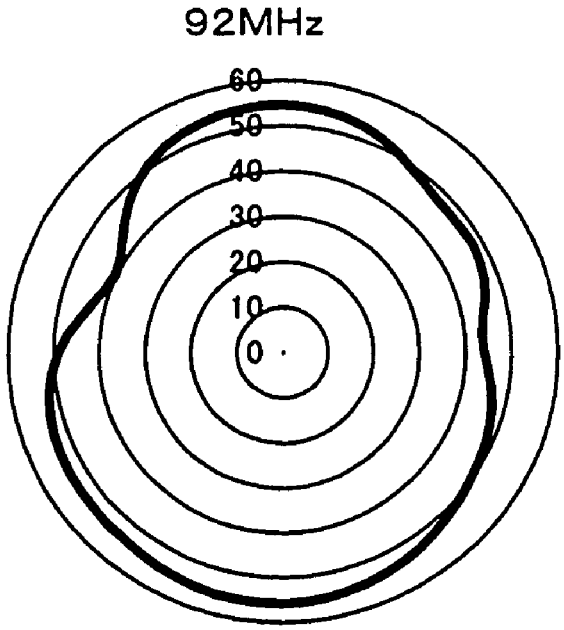
Figure 6F:
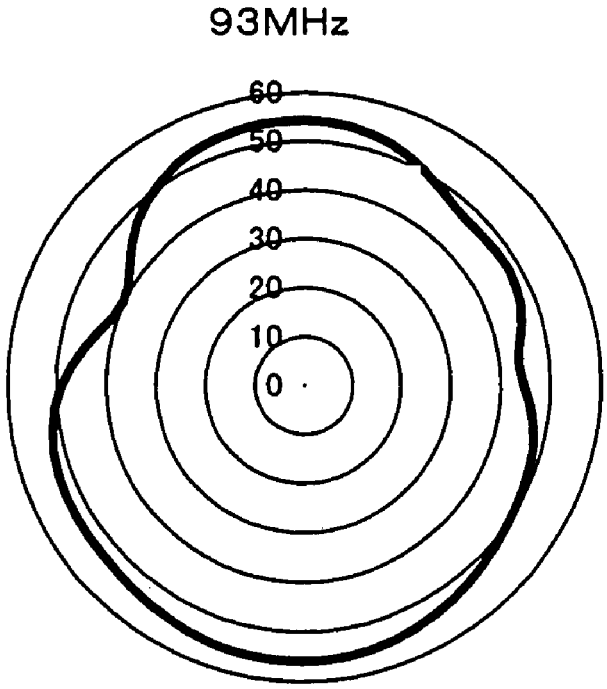
Figure 6G:
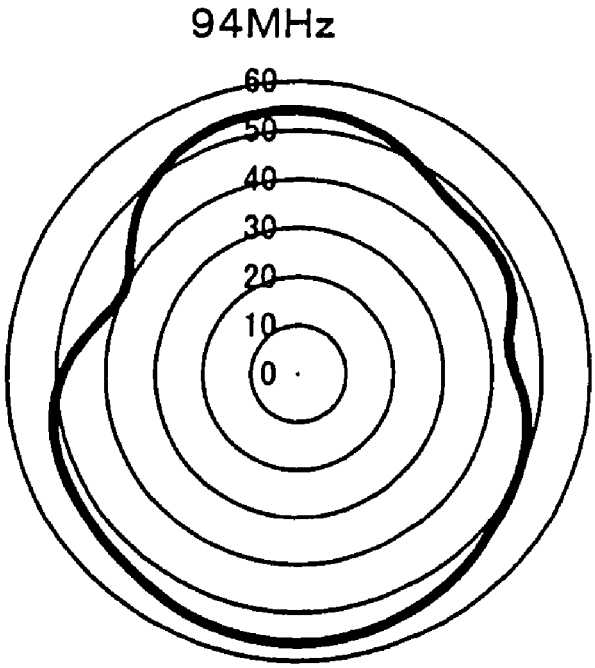
Figure 6H:
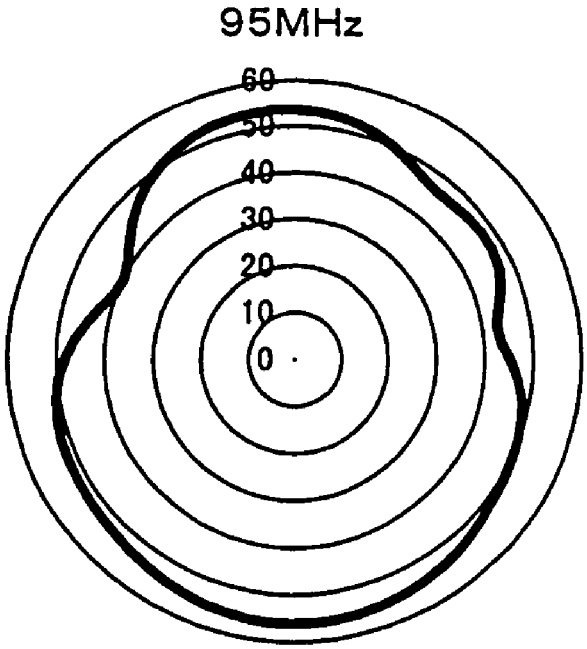
Figure 6I:
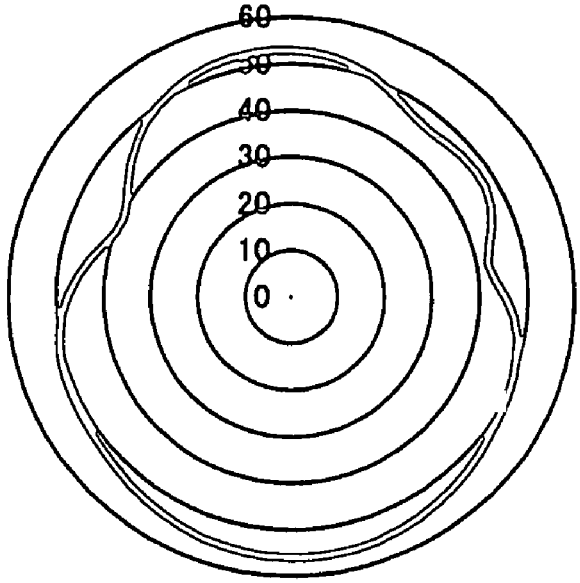
Figure 6J:
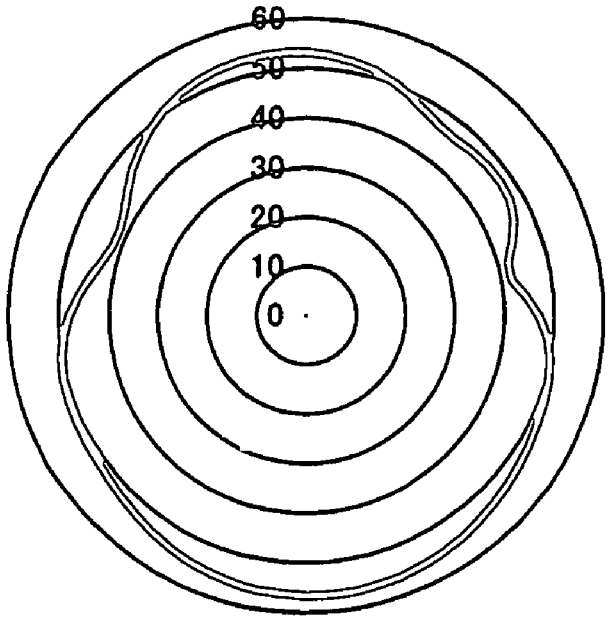
Figure 6K:
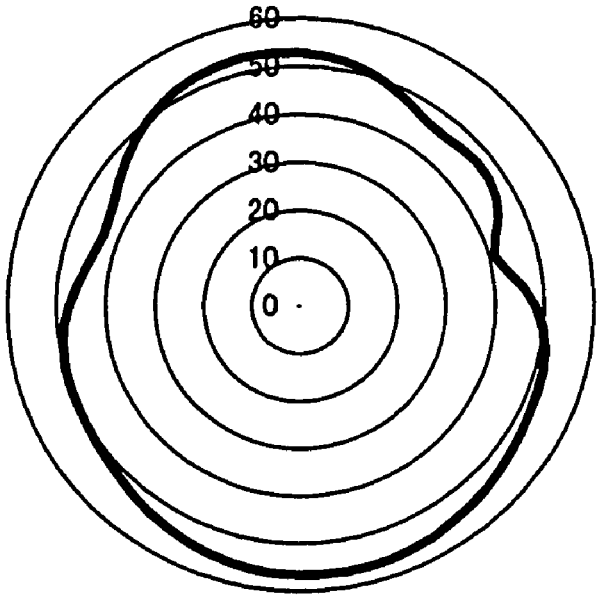
Figure 6L:
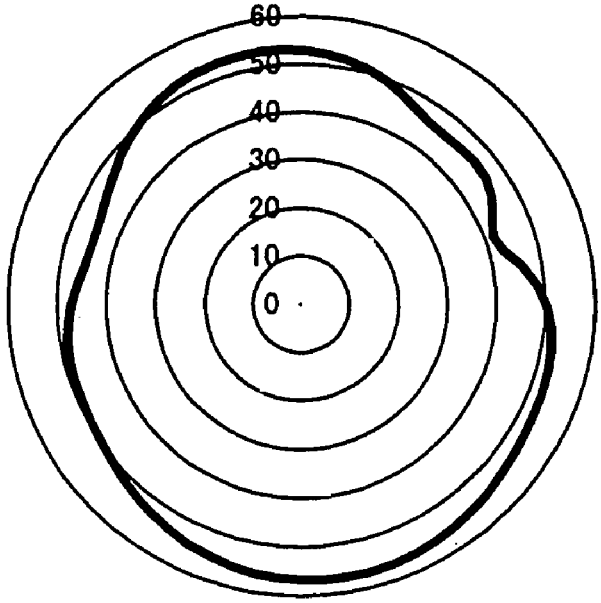
Figure 6M:
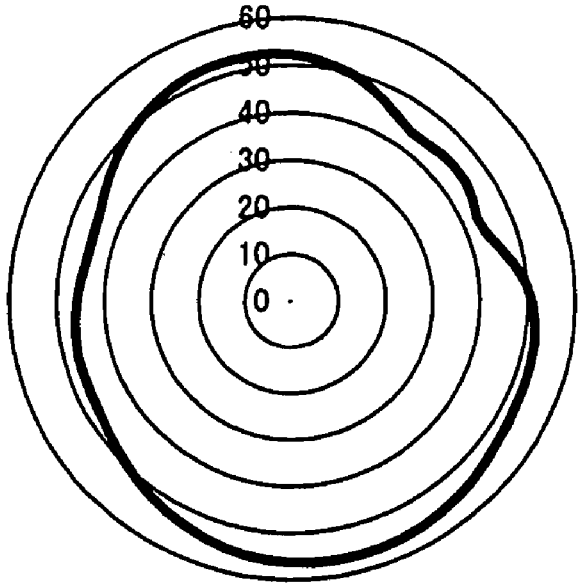
Figure 6N:
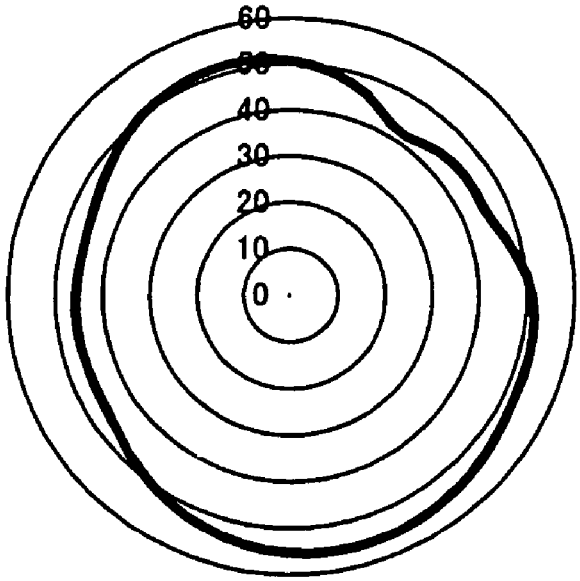
Figure 60:
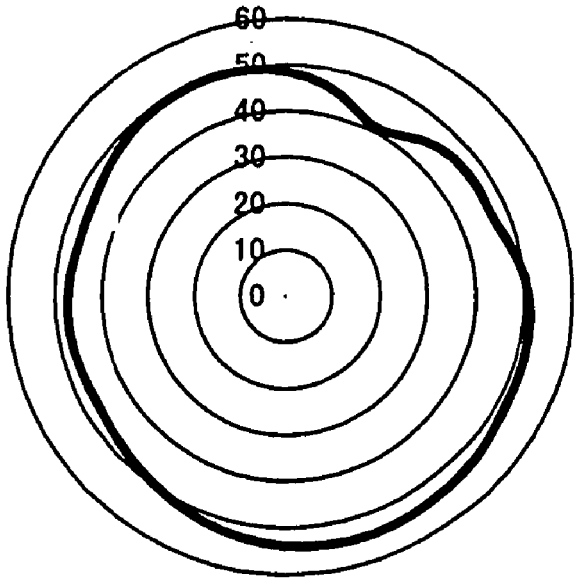
Figure 6P:
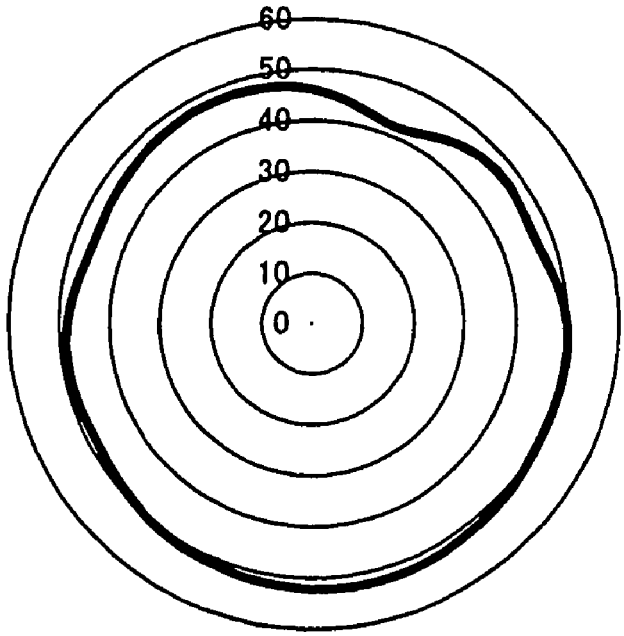
Figure 6Q:
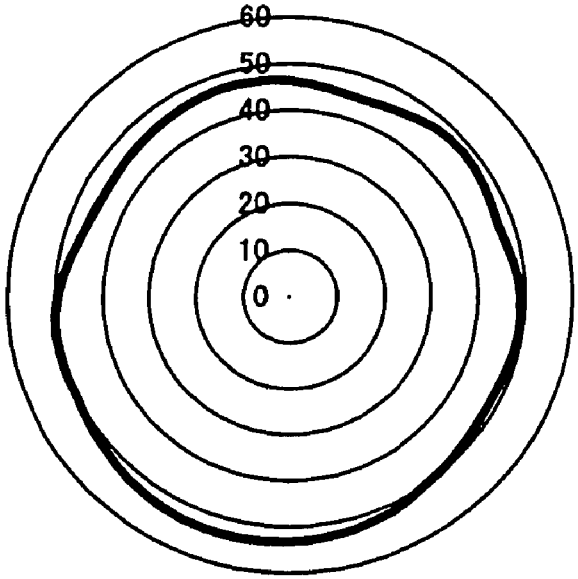
Figure 6R:
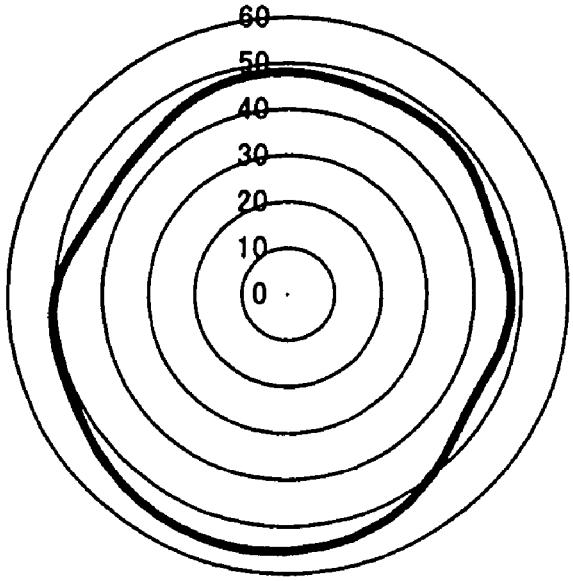
Figure 6S:
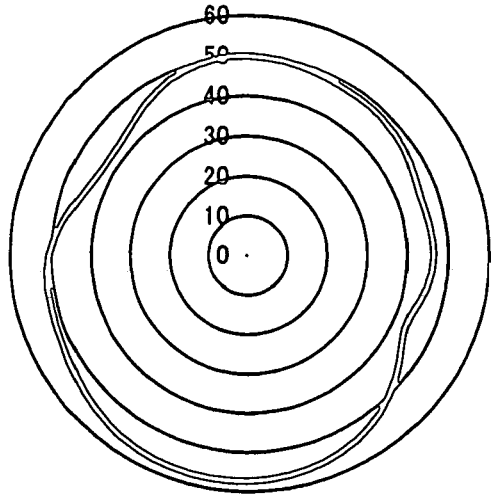
Figure 6T:
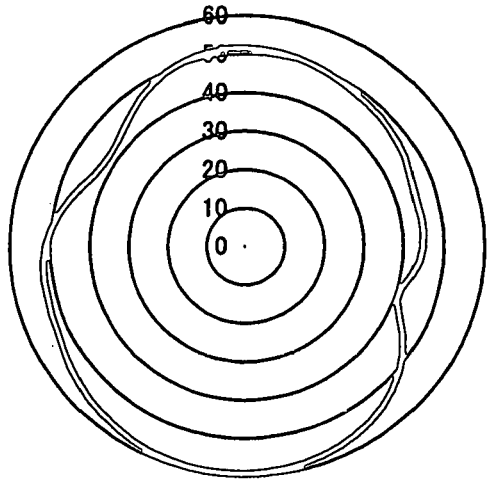
Figure 6U:
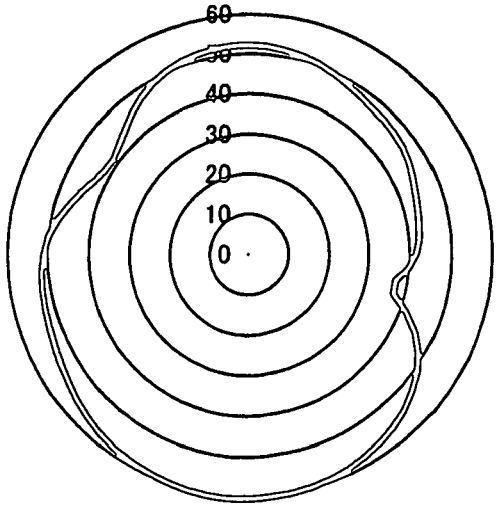

FIGS. 6A–6U show the sensitivity and directivity for the glass antenna device having the inductor 26, the inductance L thereof being 2.2 μH, respectively.

Figure 7A:
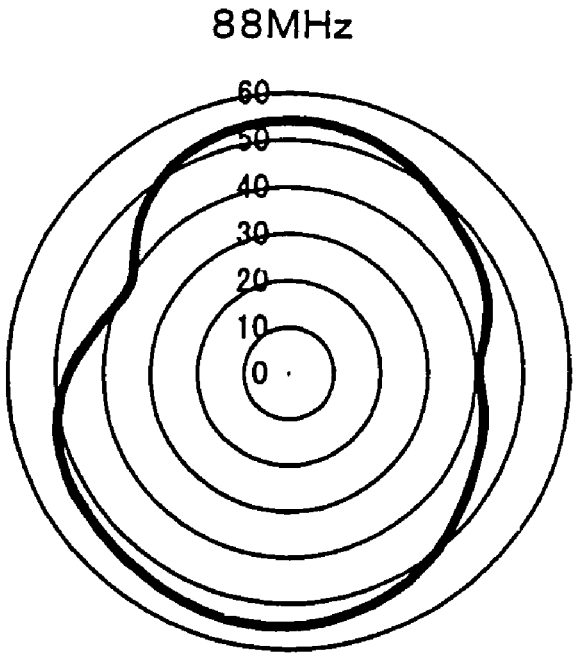
FIGS. 7A–7U show the measured directivity for a glass antenna device having an inductor of 3.9 μH, respectively.
Figure 7B:
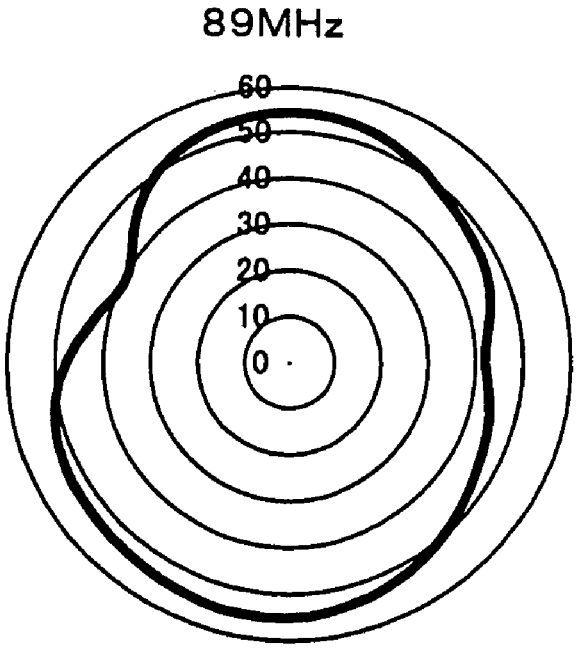
Figure 7C:
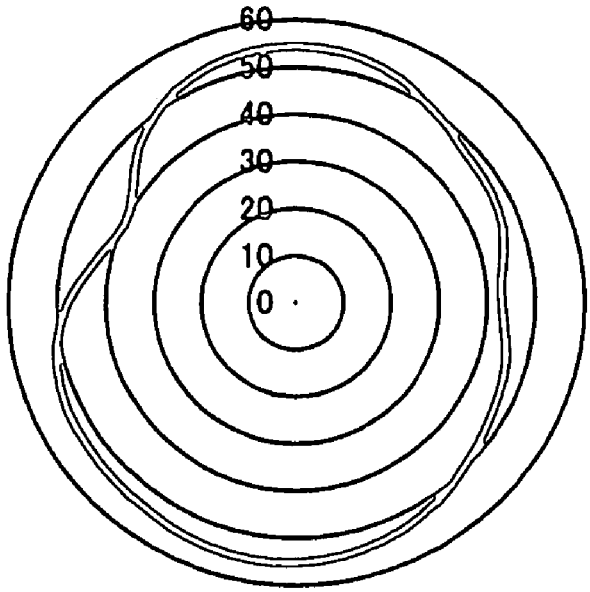
Figure 7D:
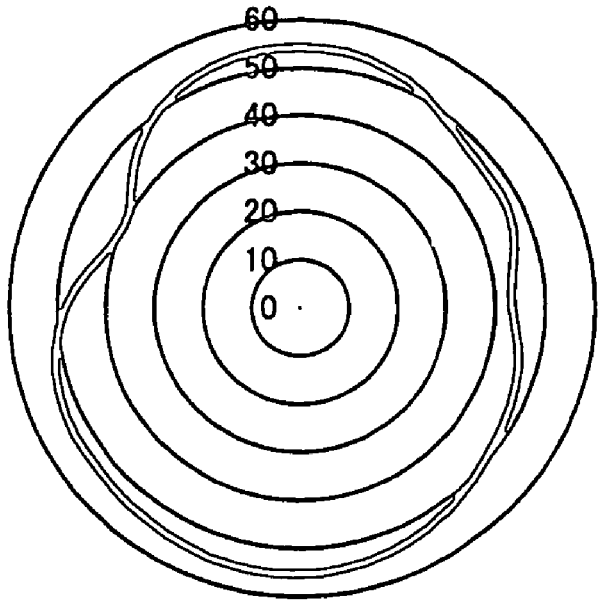
Figure 7E:
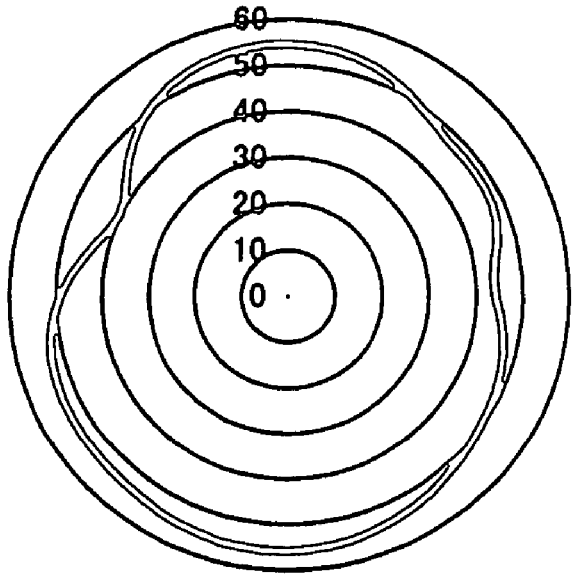
Figure 7F:
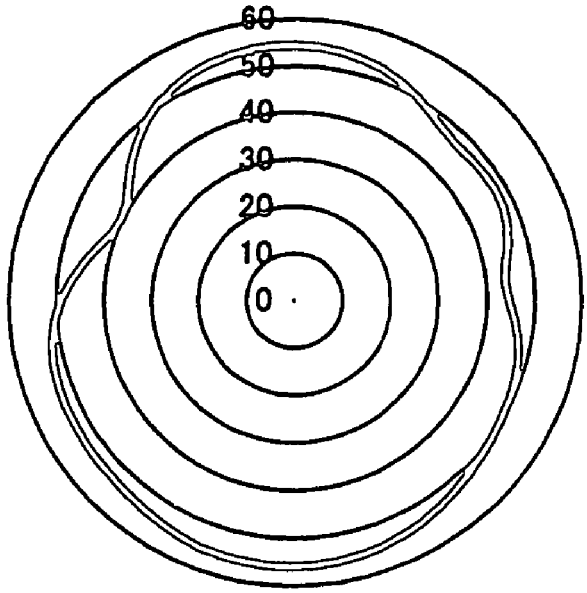
Figure 7G:
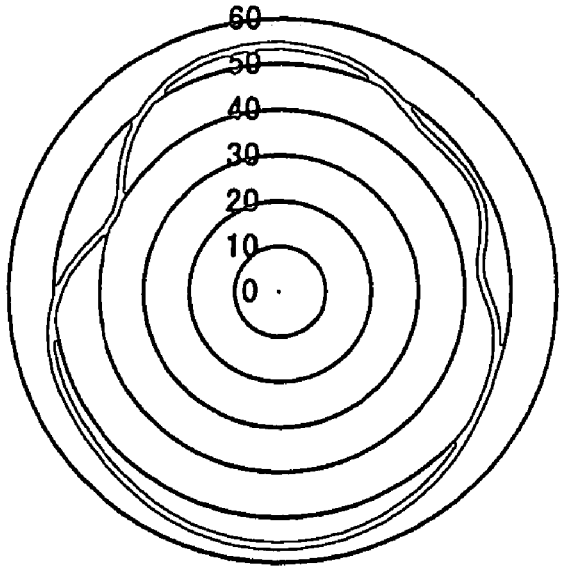
Figure 7H:
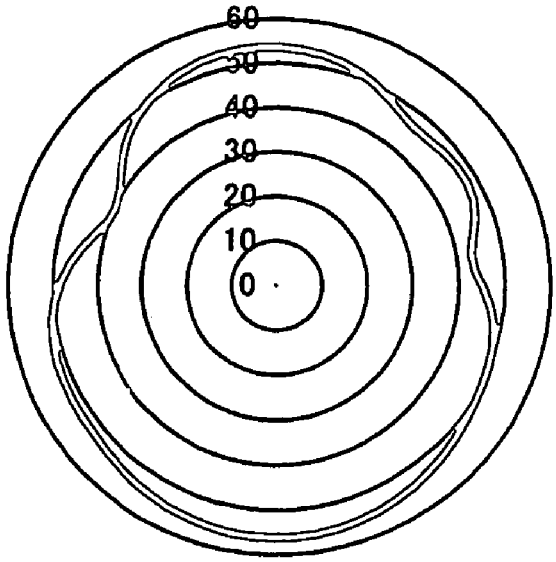
Figure 7I:
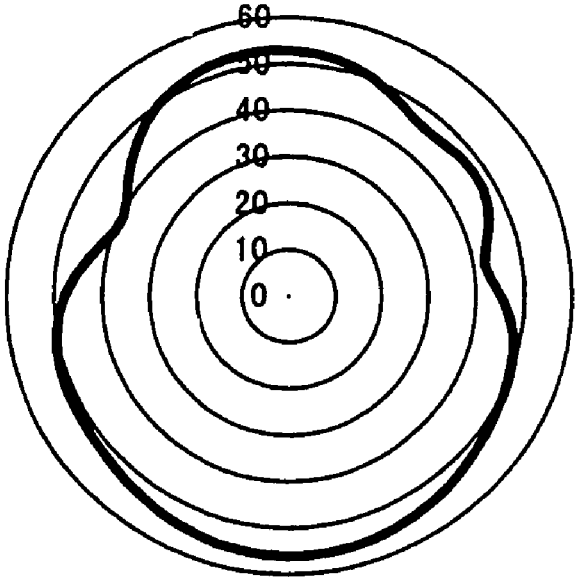
Figure 7J:
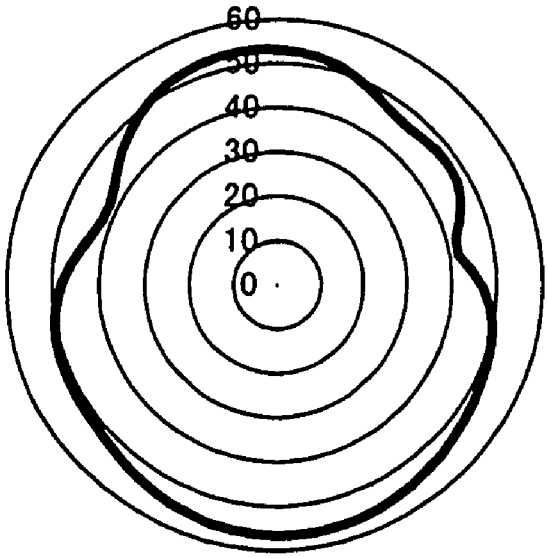
Figure 7K:
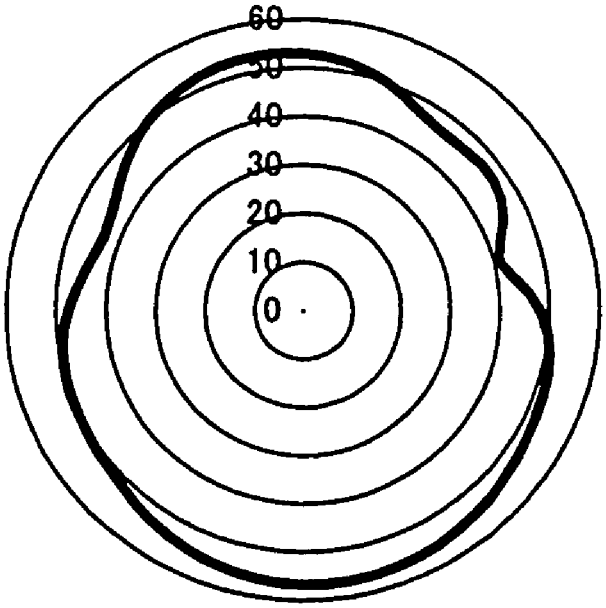
Figure 7L:
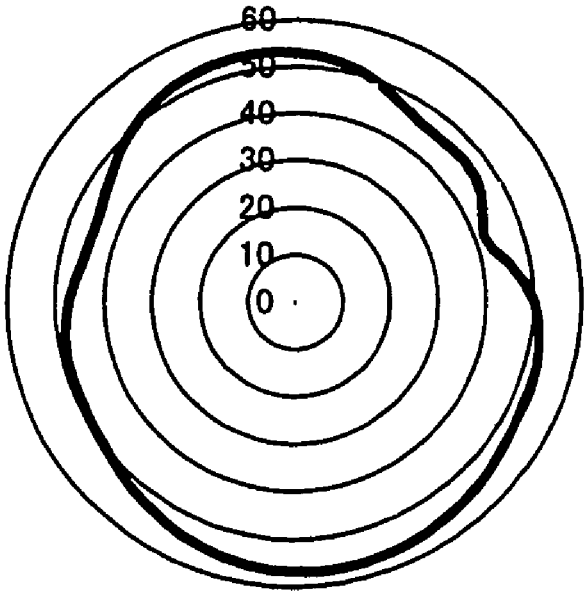
Figure 7M:
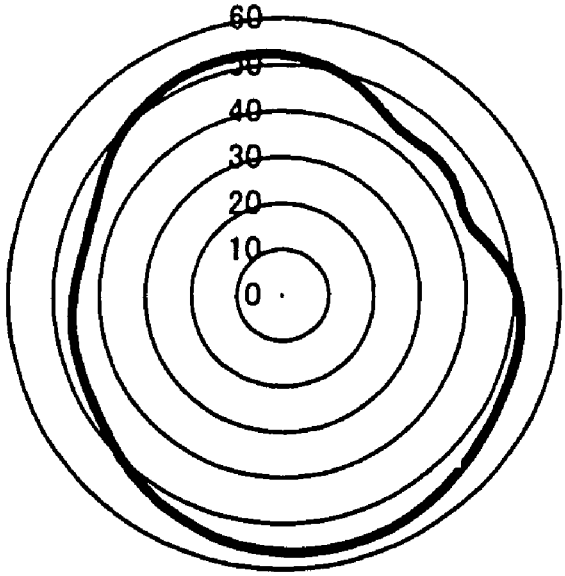
Figure 7N:
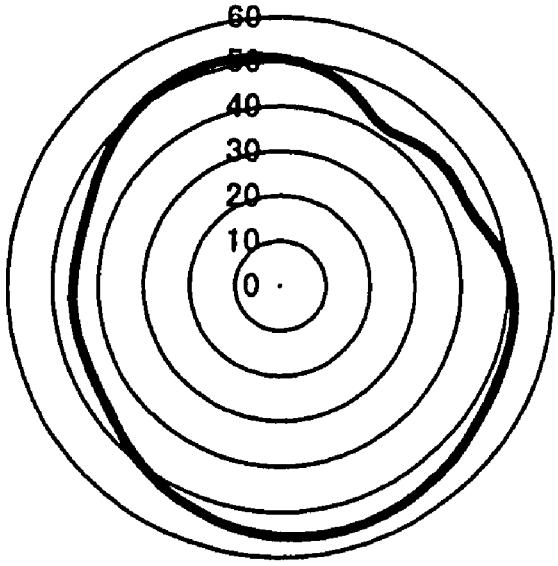
Figure 70:
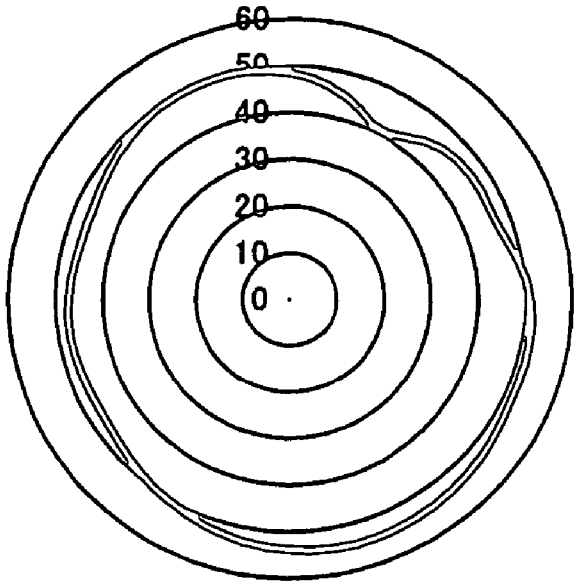
Figure 7P:
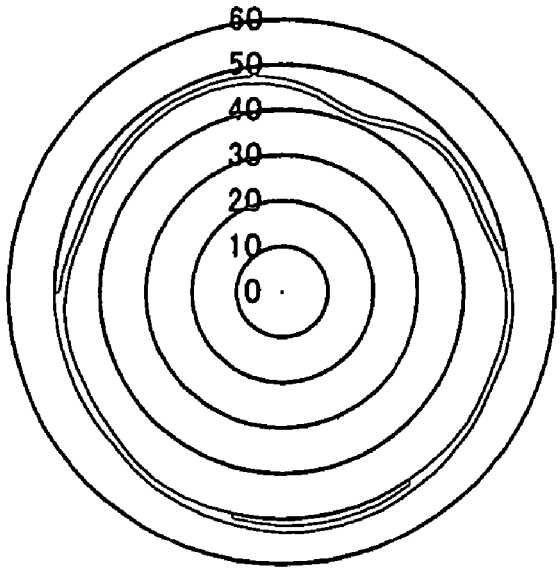
Figure 7Q:
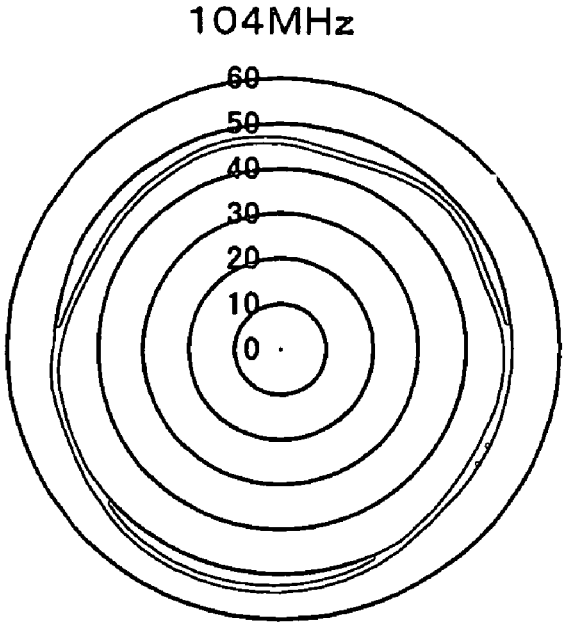
Figure 7R:
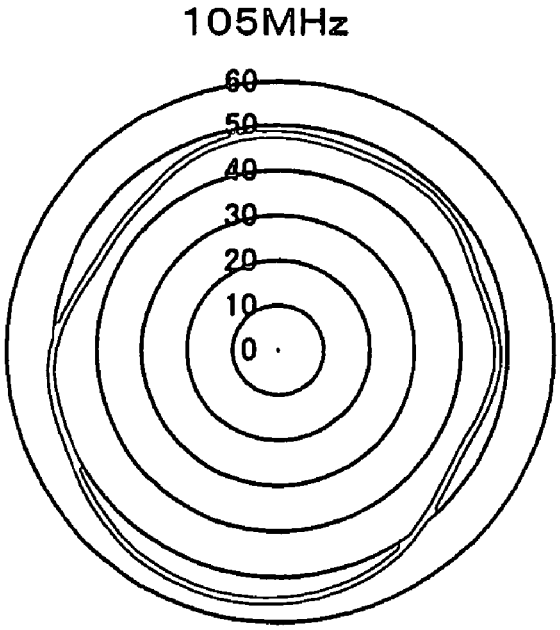
Figure 7S:
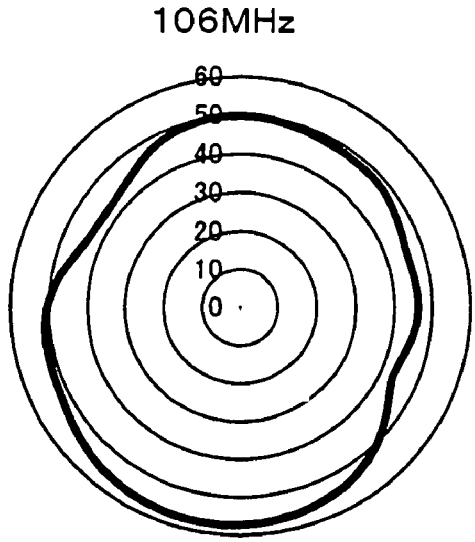
Figure 7T:
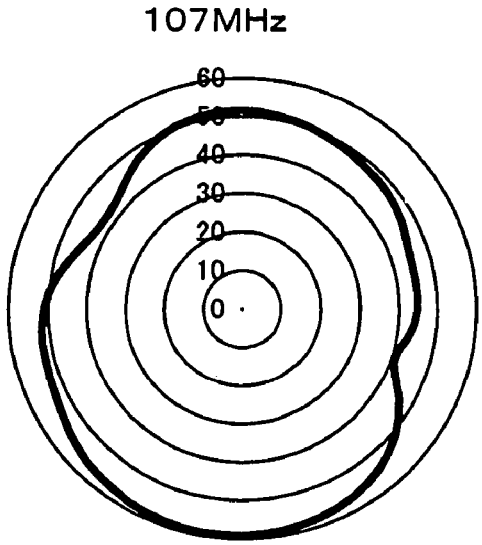
Figure 7U:
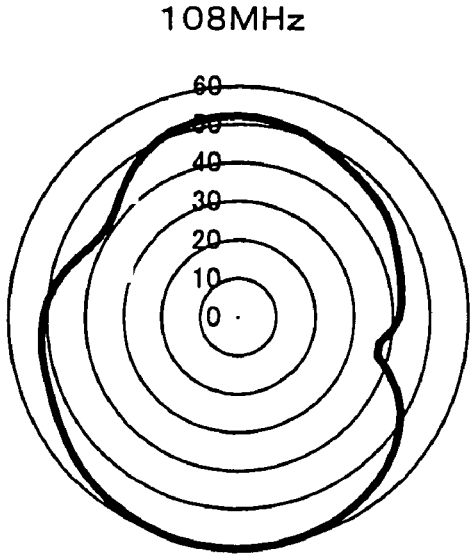

FIGS. 7A–7U show the sensitivity and directivity for the glass antenna device having the inductor 26, the inductance L thereof being 3.9 μH, respectively.

Figure 8A:
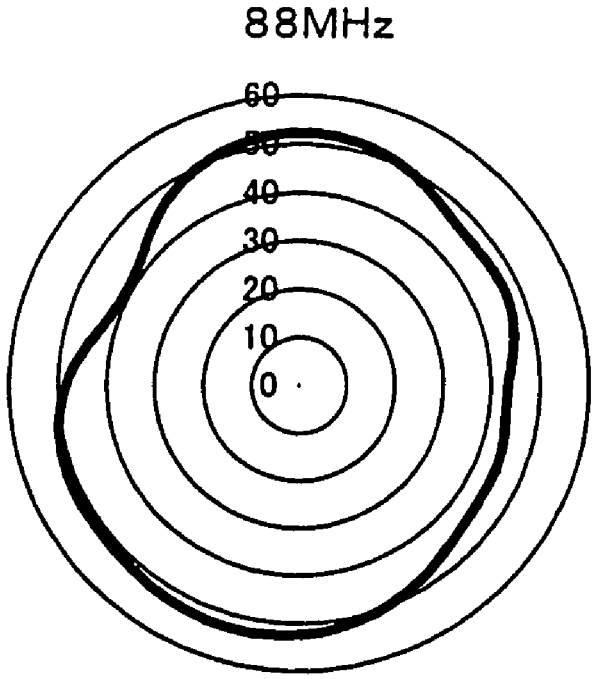
FIGS. 8A–8U show the measured directivity for a glass antenna device having an inductor of 6.8 μH, respectively.
Figure 8B:
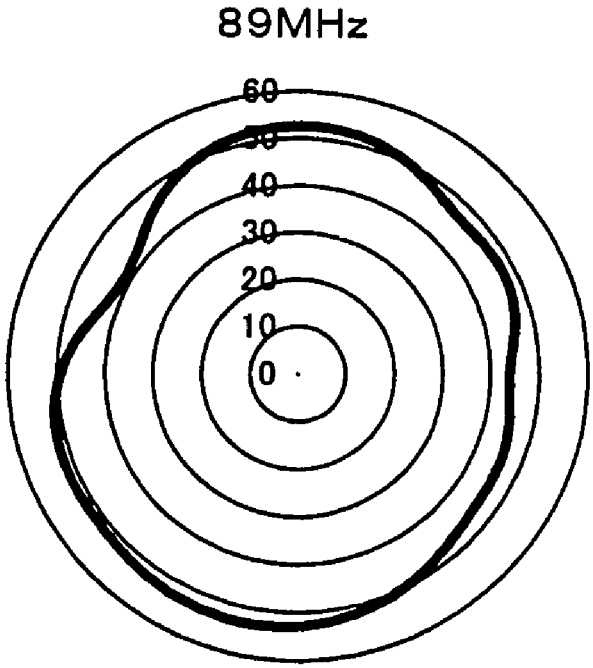
Figure 8C:
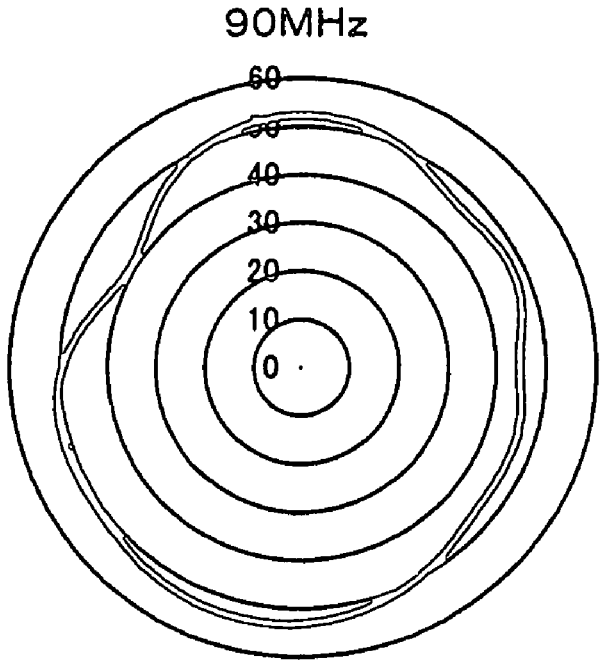
Figure 8D:
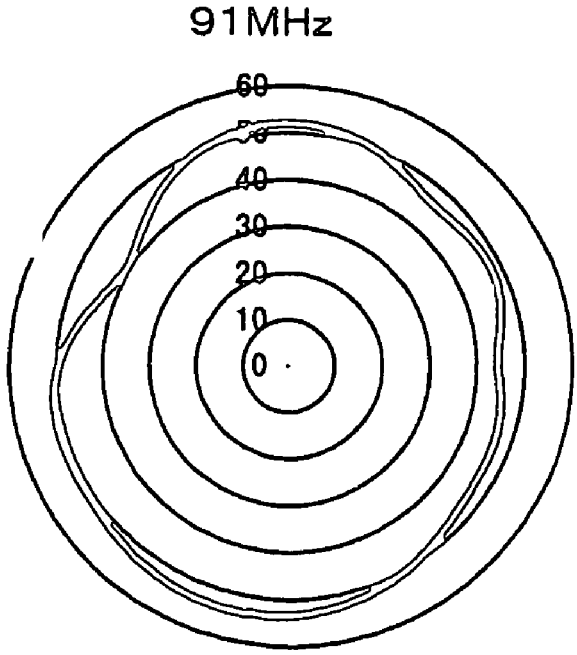
Figure 8E:
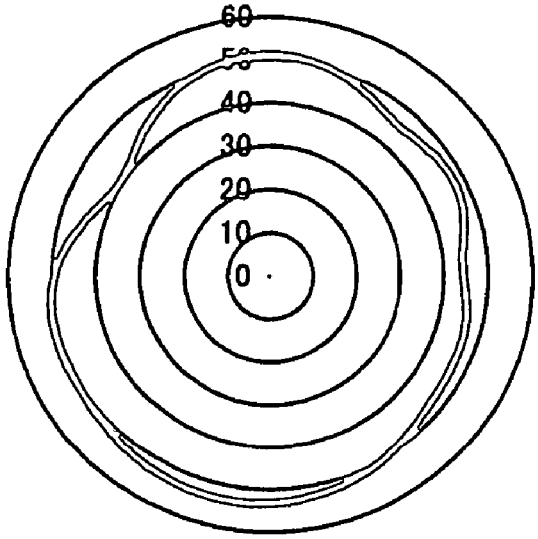
Figure 8F:
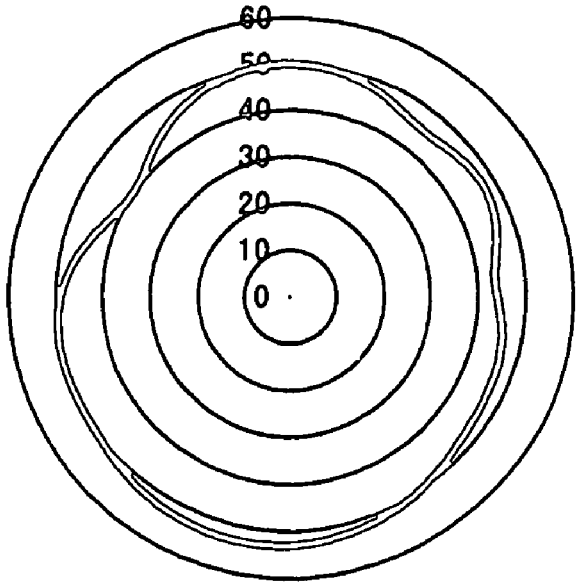
Figure 8G:
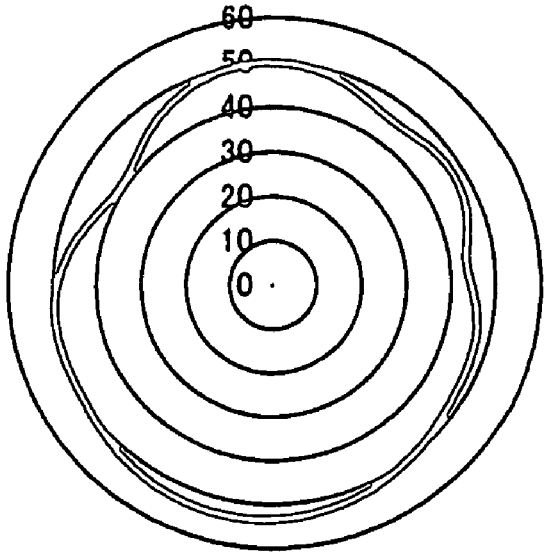
Figure 8H:
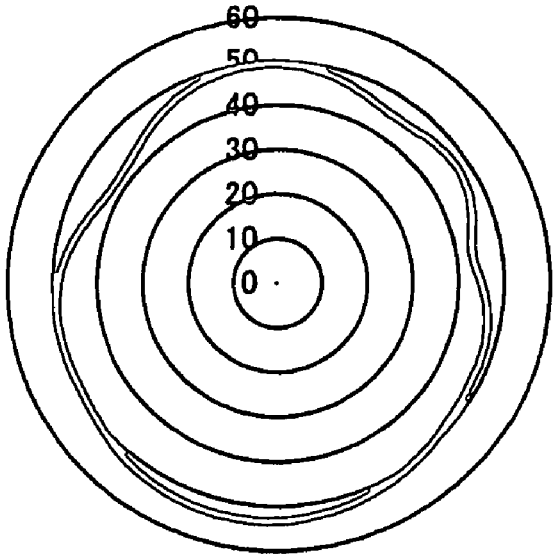
Figure 8I:
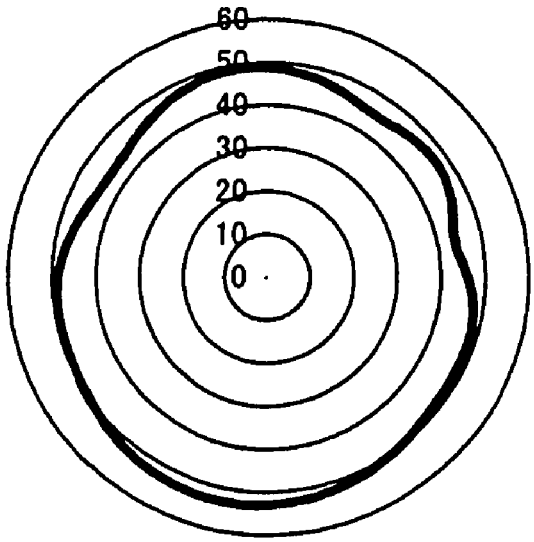
Figure 8J:
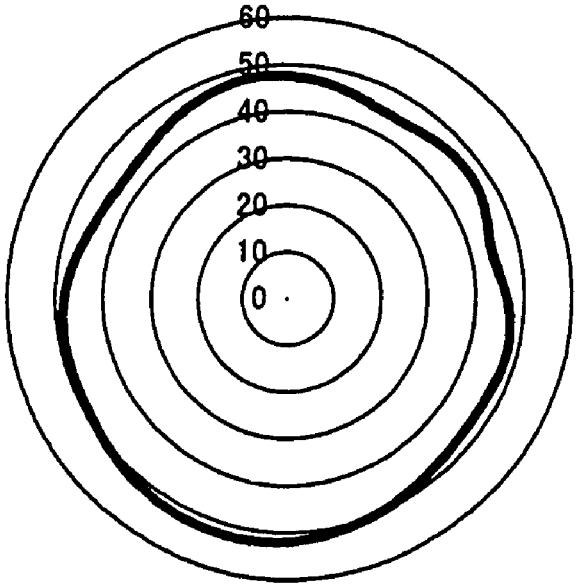
Figure 8K:
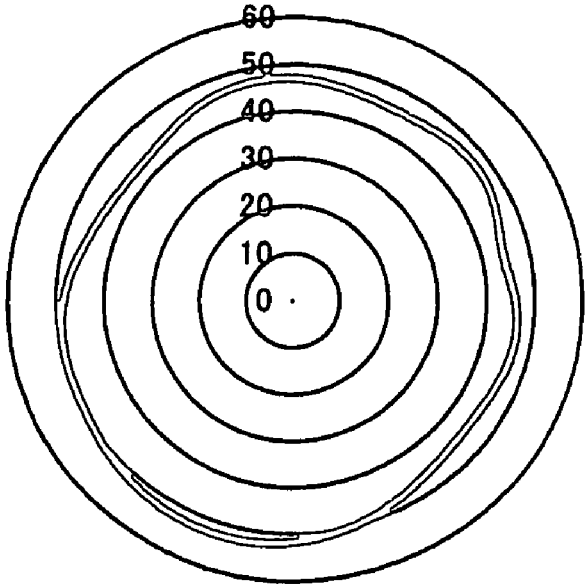
Figure 8L:
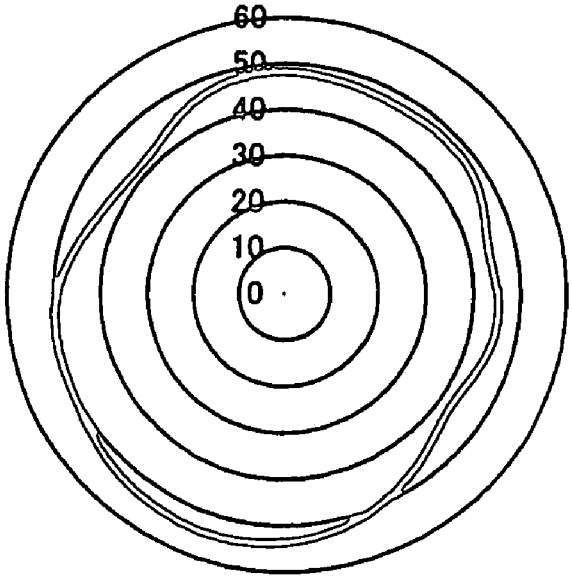
Figure 8M:
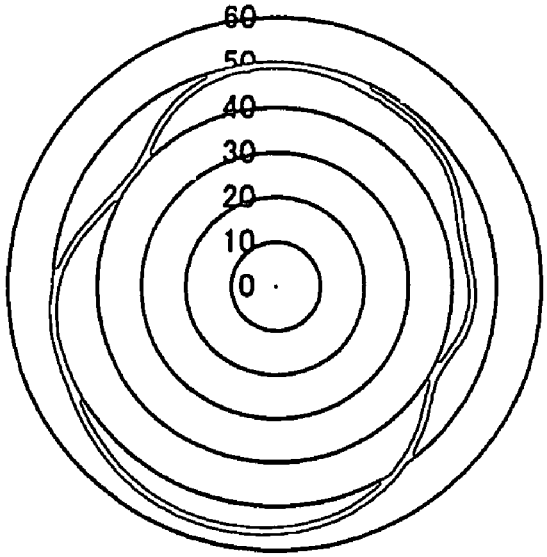
Figure 8N:
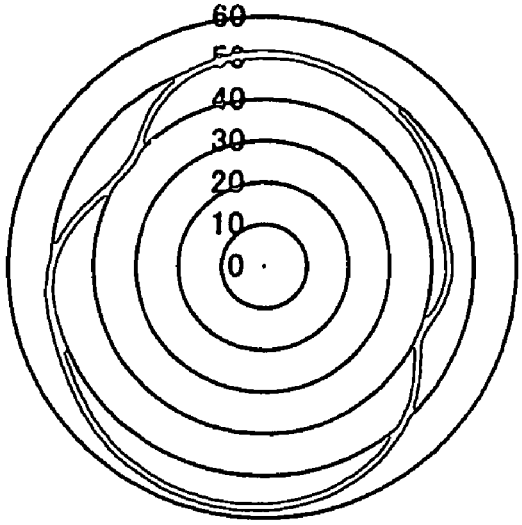
Figure 80:
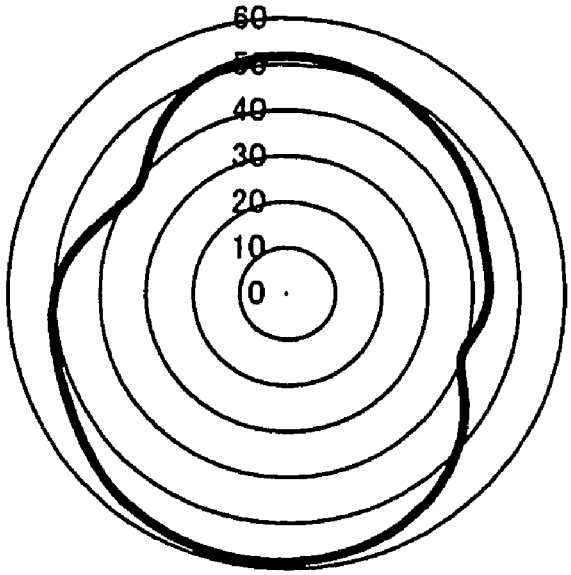
Figure 8P:
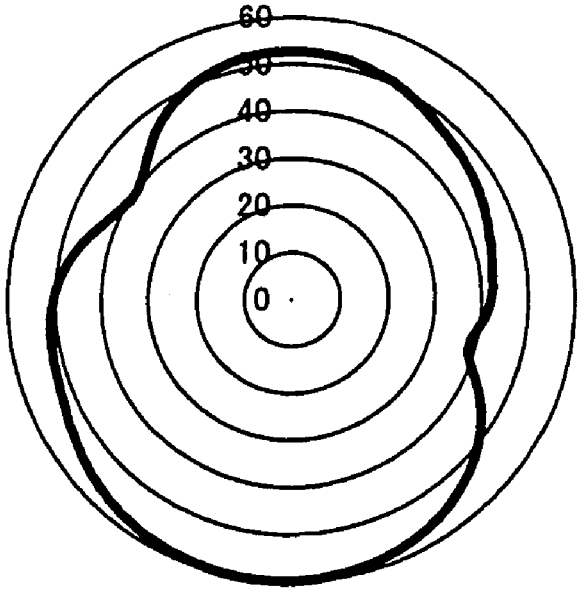
Figure 8Q:
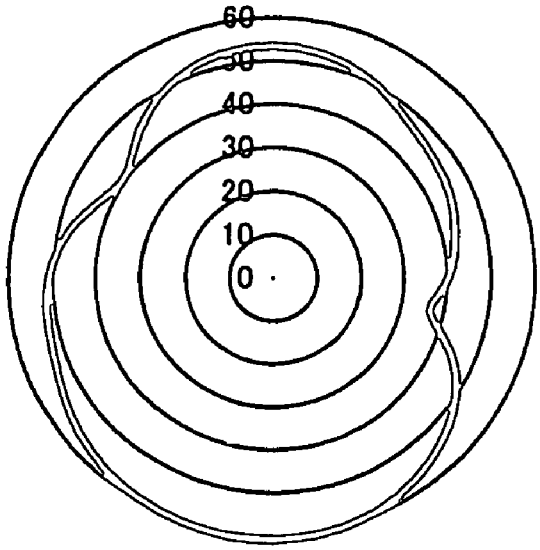
Figure 8R:
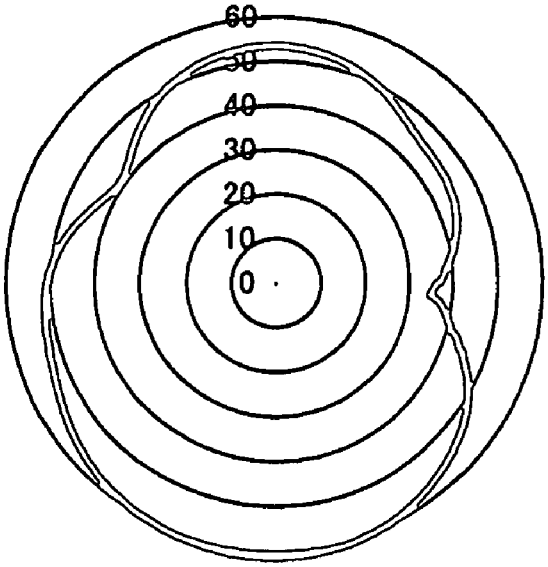
Figure 8S:
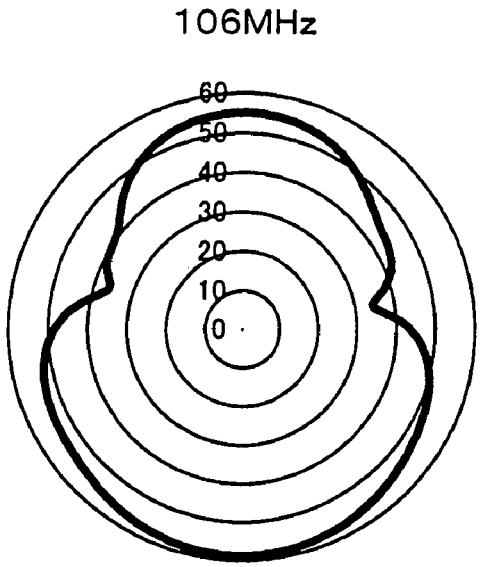
Figure 8T:
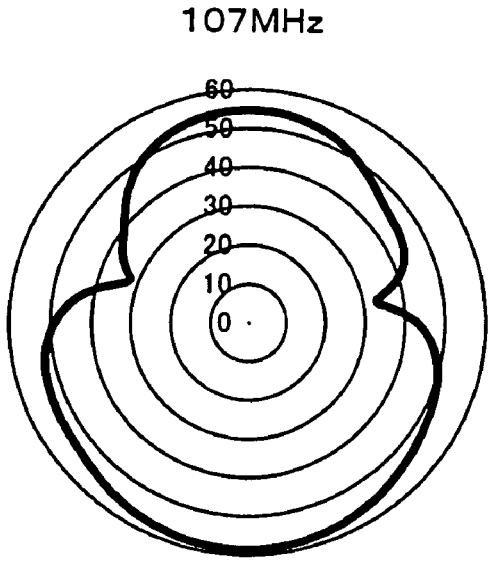
Figure 8U:
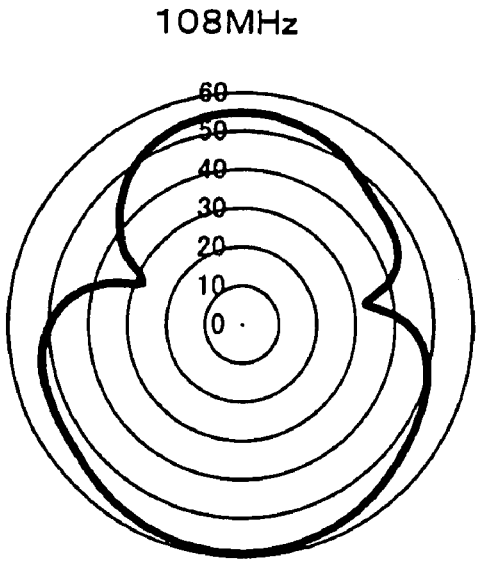

FIGS. 8A–8U show the sensitivity and directivity for the glass antenna device having the inductor 26, the inductance L thereof being 6.8 μH, respectively.

Figure 9A:
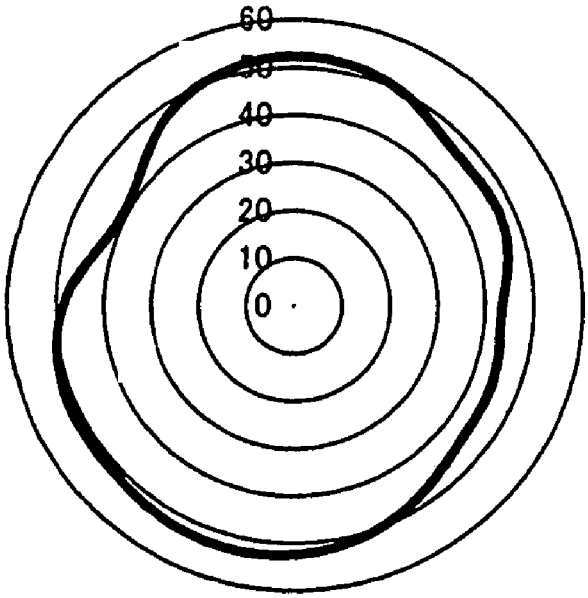
FIGS. 9A–9U show the measured directivity for a glass antenna device having an inductor of 8.2 μH, respectively.
Figure 9B:
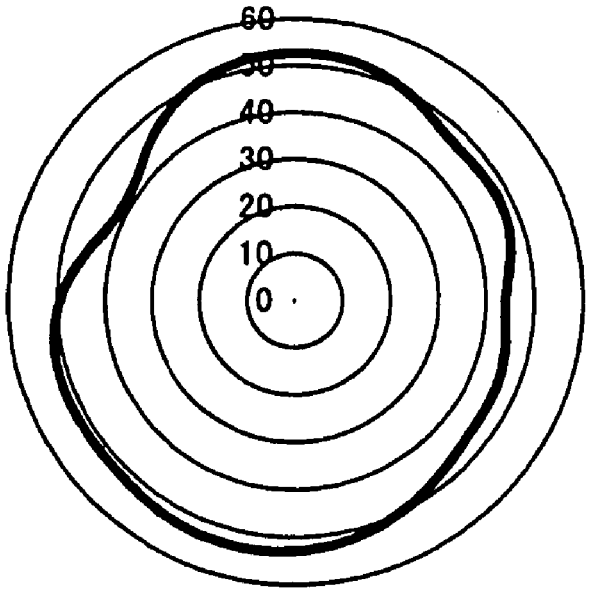
Figure 9C:
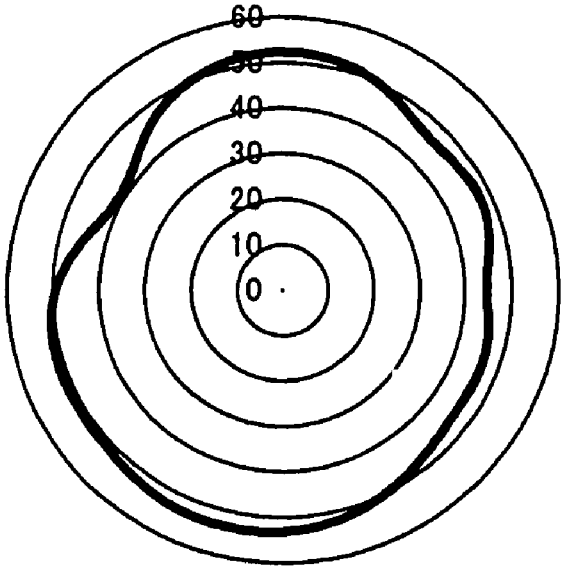
Figure 9D:
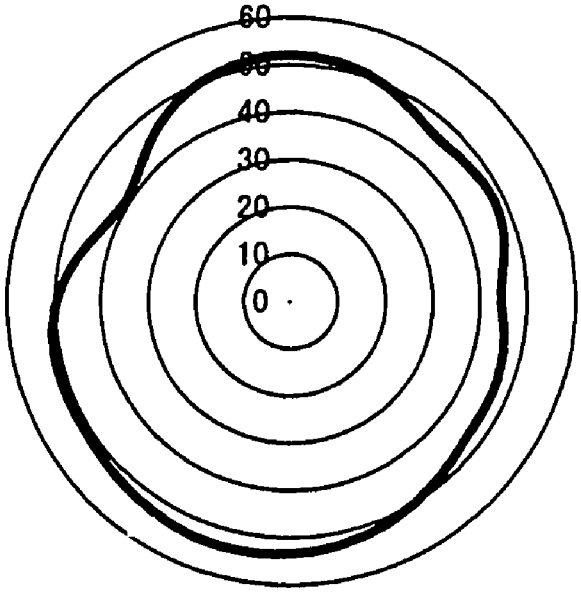
Figure 9E:
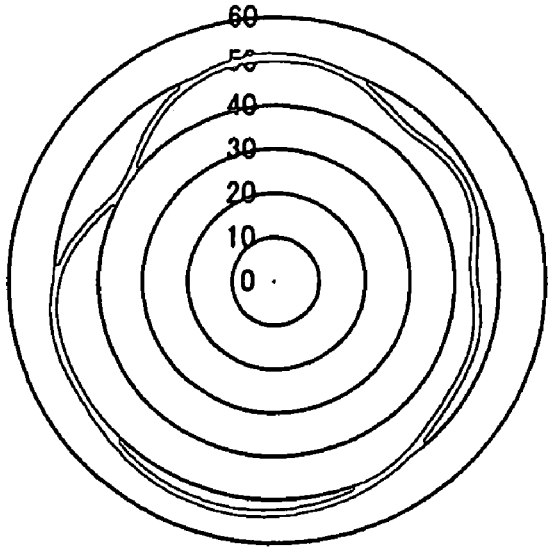
Figure 9F:
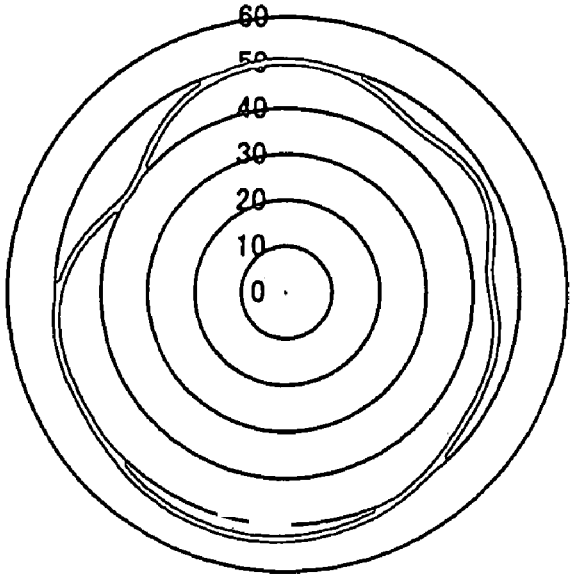
Figure 9G:
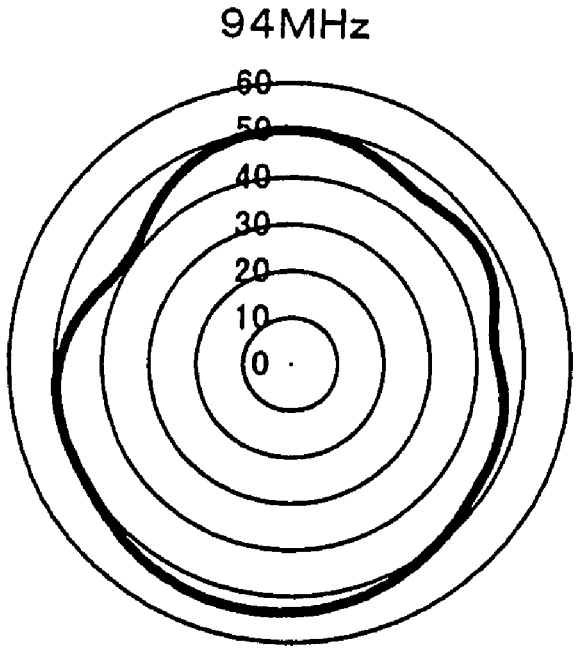
Figure 9H:
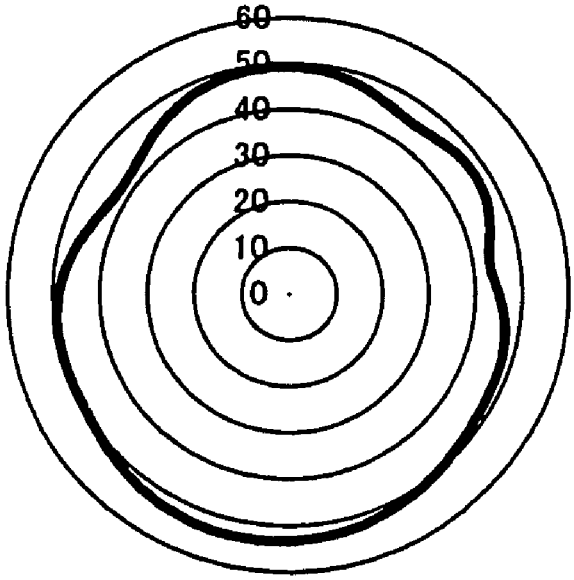
Figure 9I:
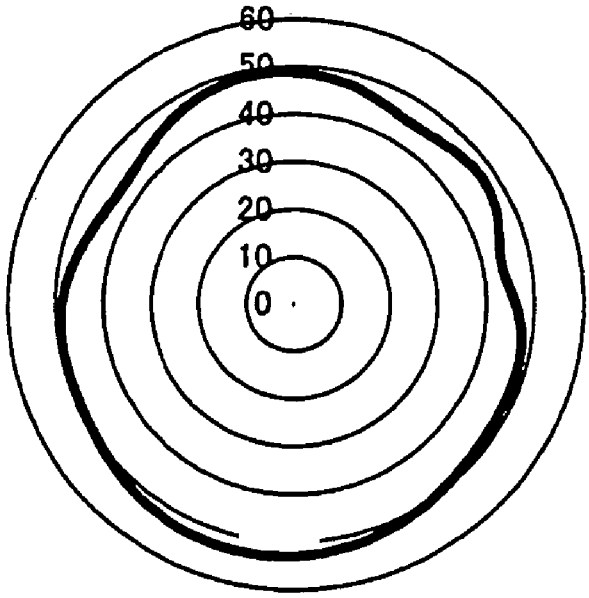
Figure 9J:
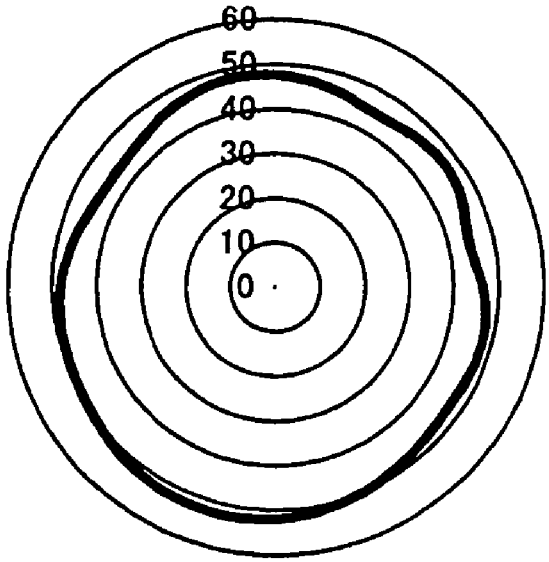
Figure 9K:
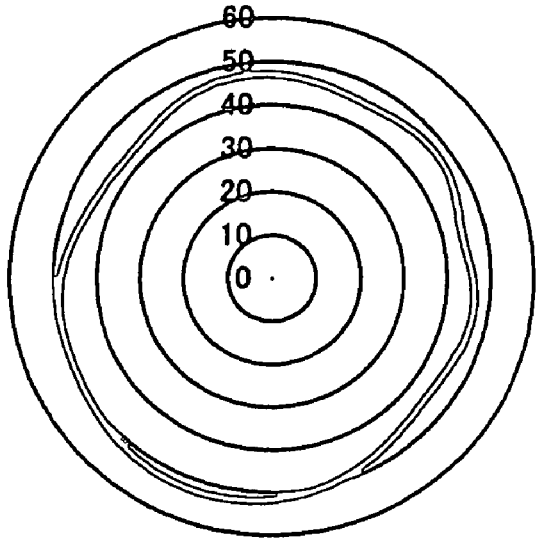
Figure 9L:
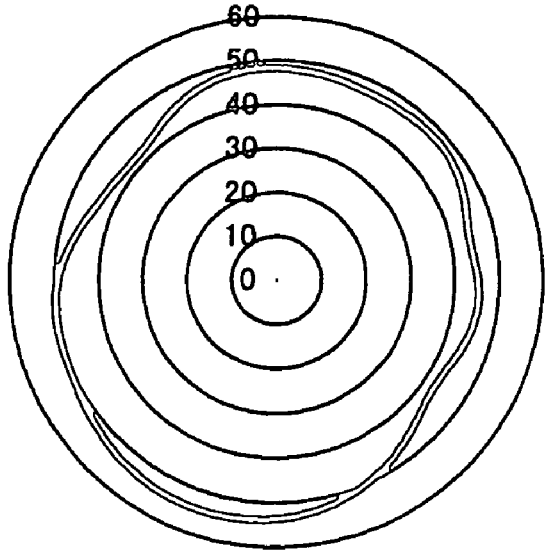
Figure 9M:
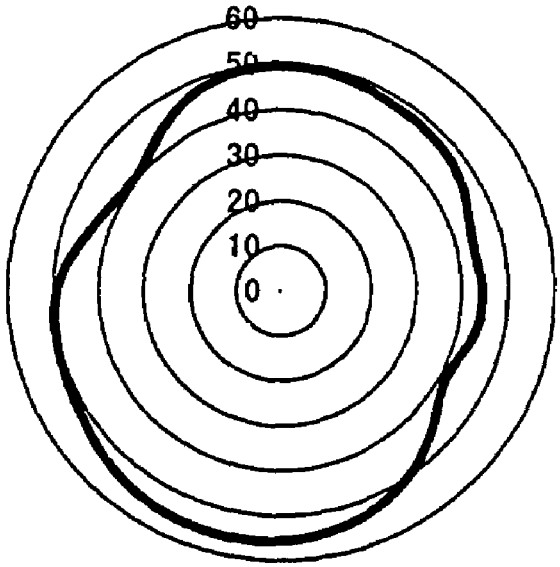
Figure 9N:
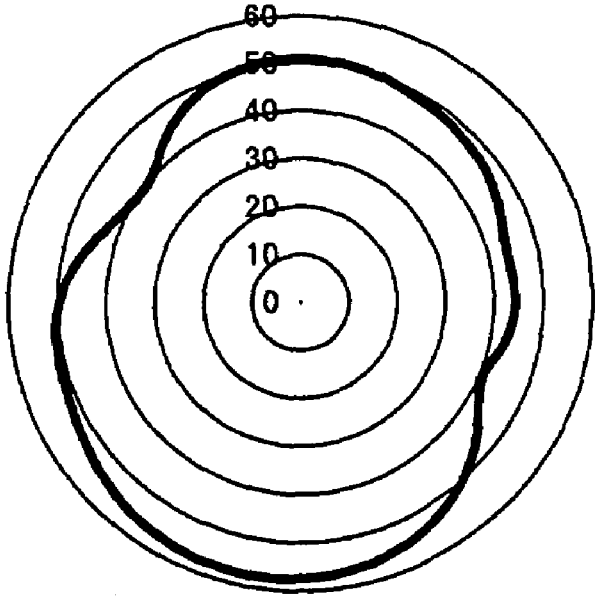
Figure 90:
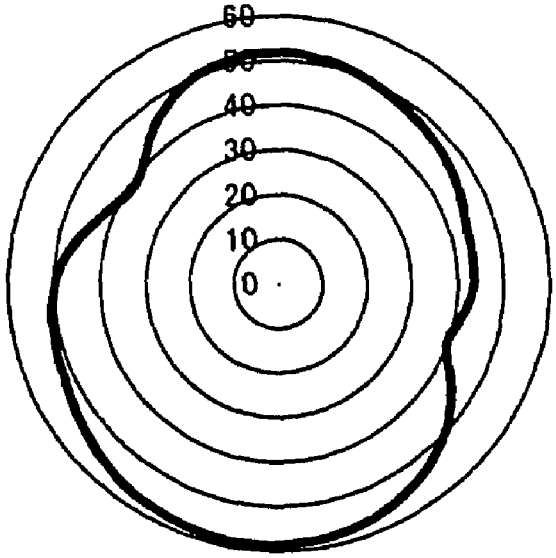
Figure 9P:
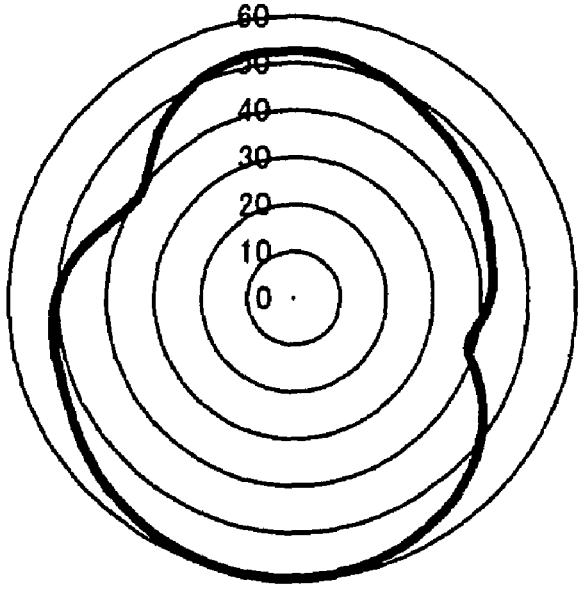
Figure 9Q:
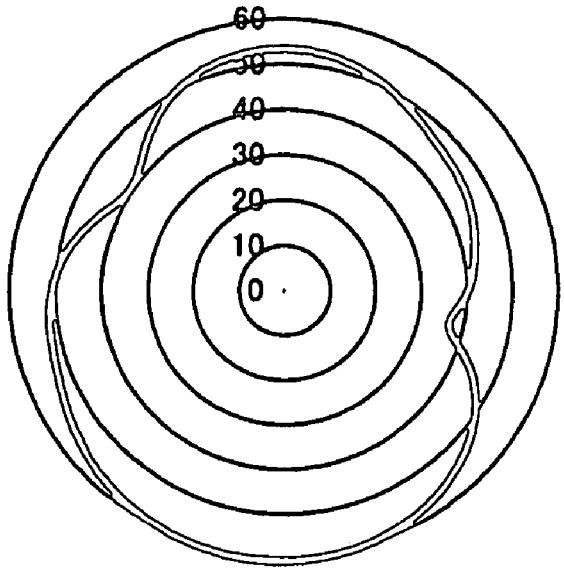
Figure 9R:
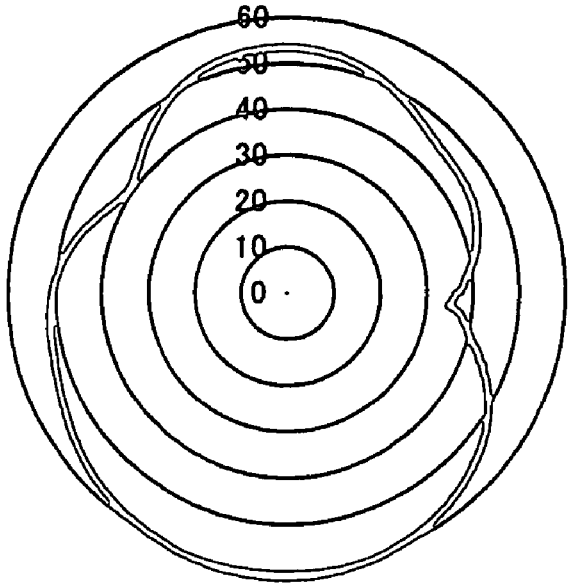
Figure 9S:
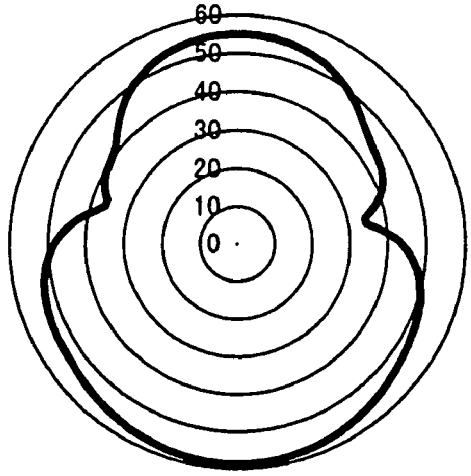
Figure 9T:
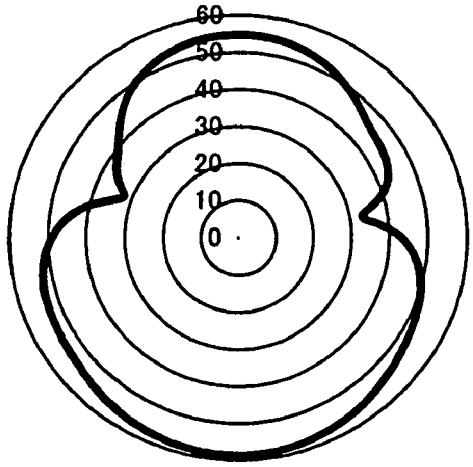
Figure 9U:
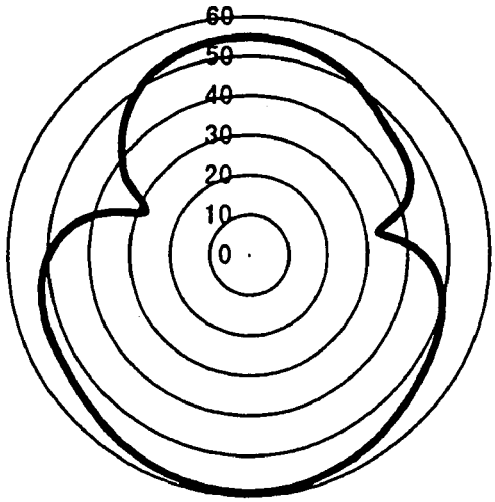
Figure 10:
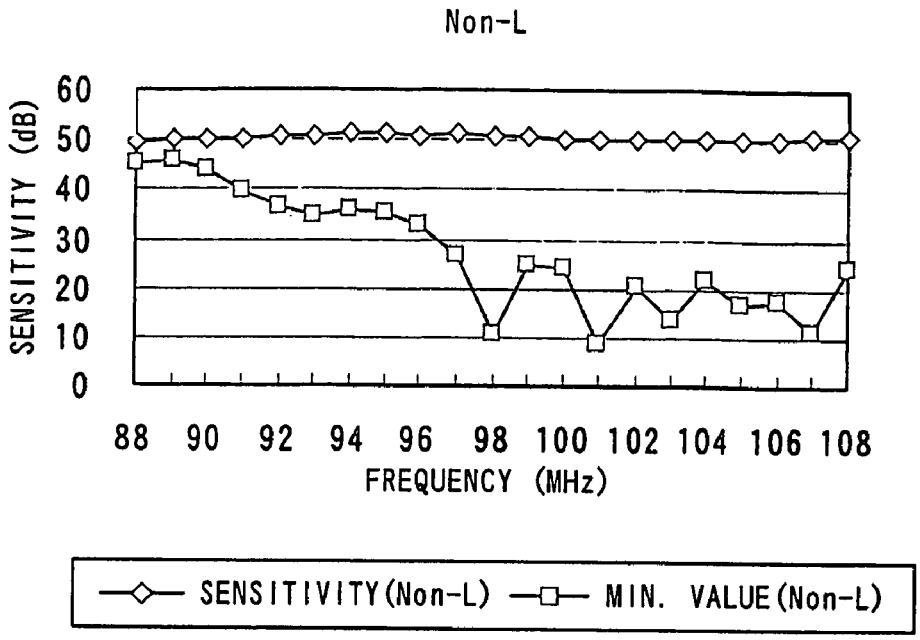
FIG. 10 shows measured sensitivity for a glass antenna device having no inductor.
Figure 11:
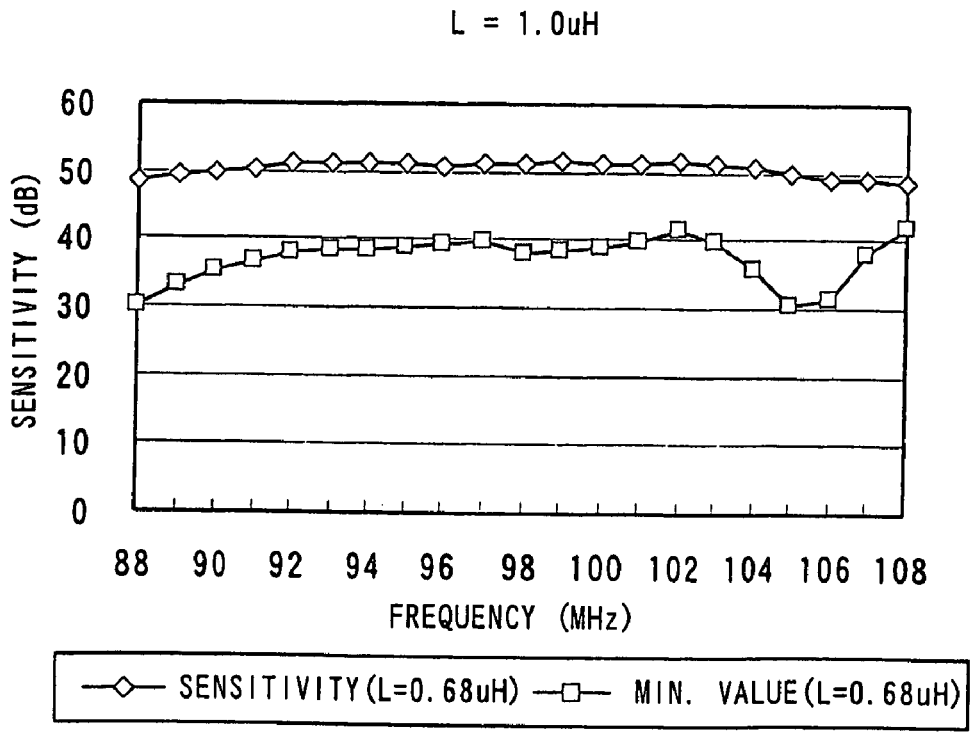
FIG. 11 shows measured sensitivity for a glass antenna device having an inductor of 0.68 μH
Figure 12:
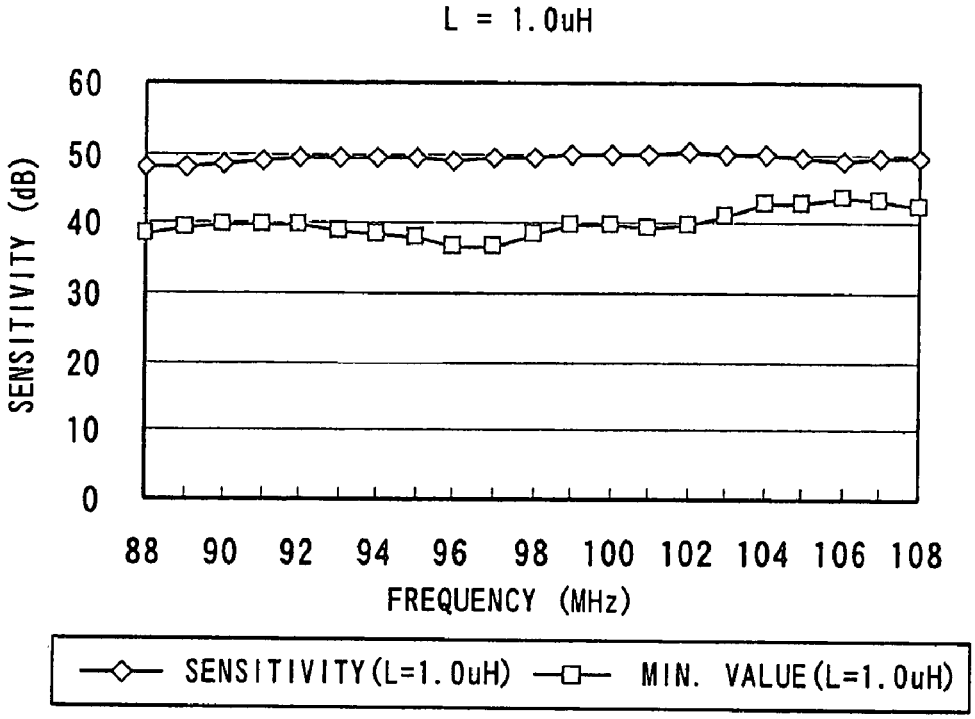
FIG. 12 shows measured sensitivity for a glass antenna device having an inductor of 1.0 μH
Figure 13:
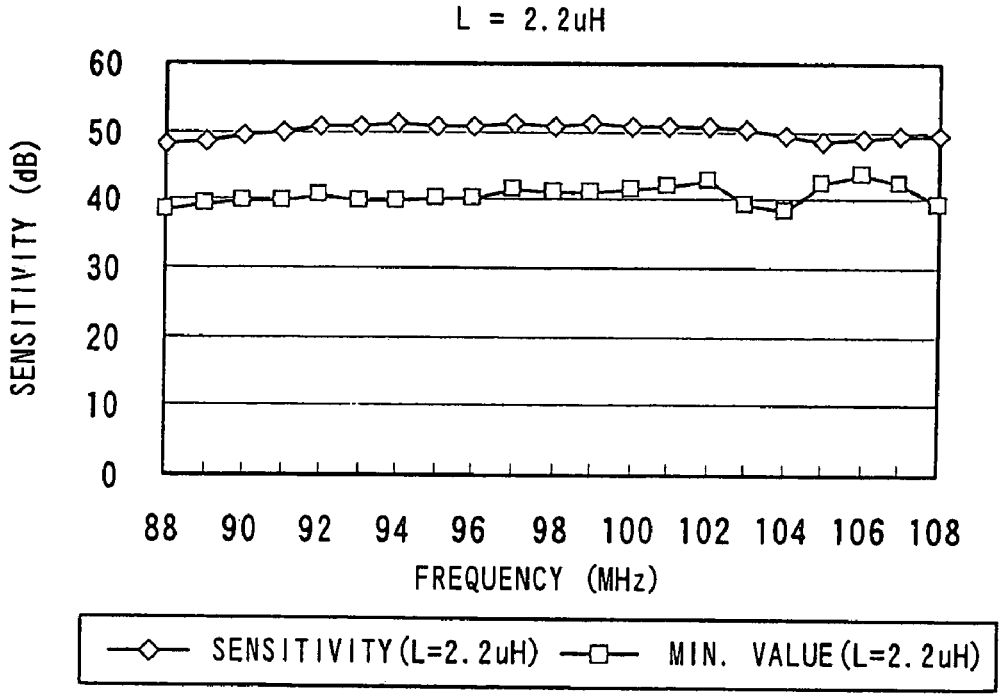
FIG. 13 shows measured sensitivity for a glass antenna device having an inductor of 2.2 μH
Figure 14:
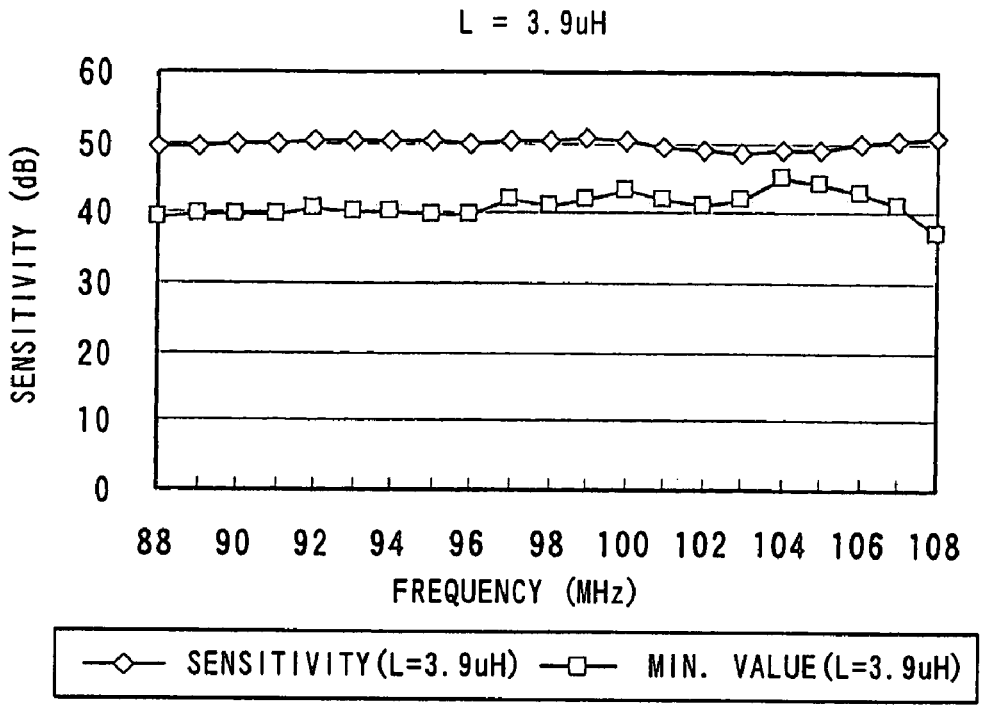
FIG. 14 shows measured sensitivity for a glass antenna device having an inductor of 3.9 μH
Figure 15:
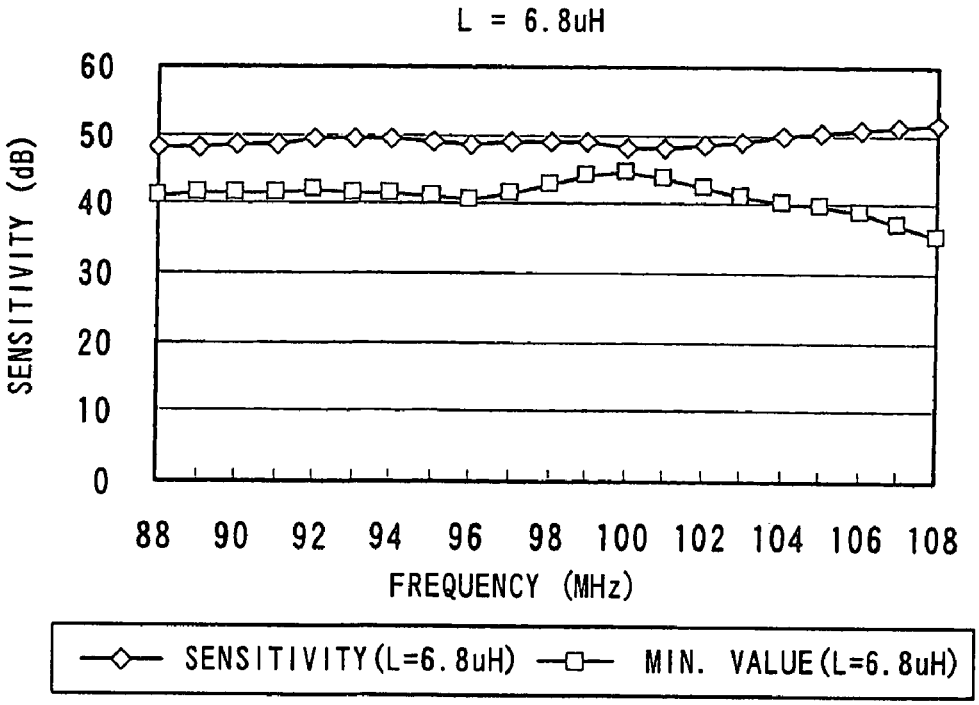
FIG. 15 shows measured sensitivity for a glass antenna device having an inductor of 6.8 μH
Figure 16:
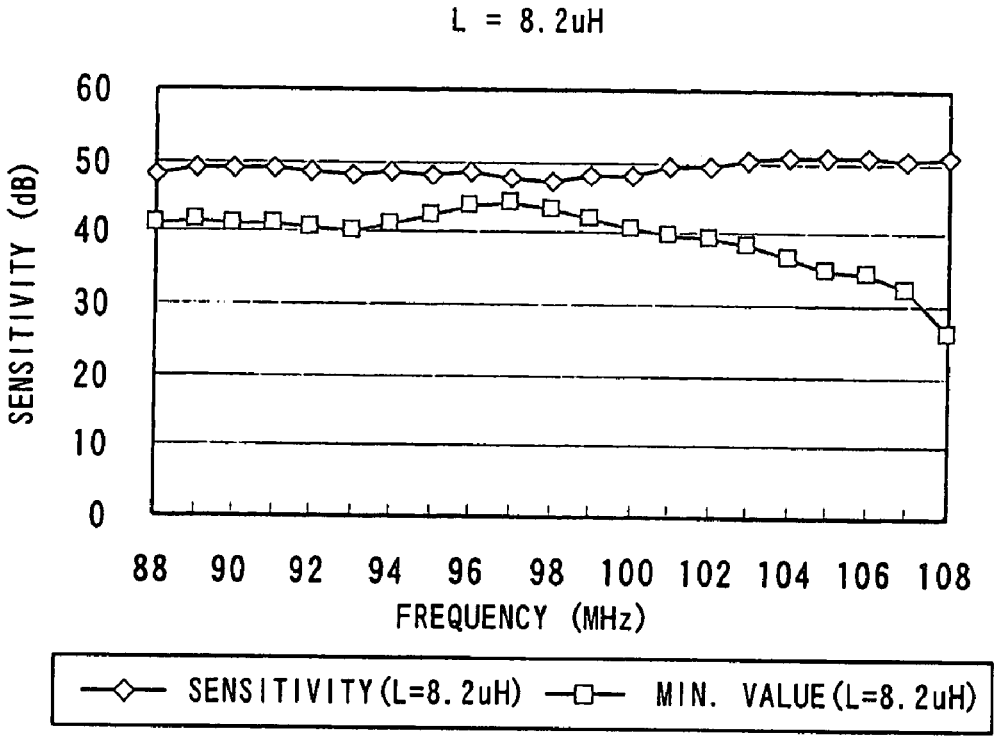
FIG. 16 shows measured sensitivity for a glass antenna device having an inductor of 8.2 μH

FIGS. 9A–9U show the sensitivity and directivity for the glass antenna device having the inductor 26, the inductance L thereof being 8.2 μH, respectively.

FIGS. 10–16 show the graphs illustrating the measured values. Also, the measured results are shown in TABLE 1.

Average sensitivity/Minimum data for an inductor (L)

[dB]

| | Non-L | | L = 0.68 uH | | L = 1.0 uH | | L = 2.2 uH | | L = 3.9 uH | | L = 6.8 uH | | L = 8.2 uH | |
|---|---|---|---|---|---|---|---|---|---|---|---|---|---|---|
| f(MHz) | Sensitivity (non-L) | Min. value (non-L) | Sensitivity (L = 0.68 uH) | Min. value (L = 0.68 uH) | Sensitivity (L = 1.0 uH) | Min. value (L = 1.0 uH) | Sensitivity (L = 2.2 uH) | Min. value (L = 2.2 uH) | Sensitivity (L = 3.9 uH) | Min. value (L = 3.9 uH) | Sensitivity (L = 6.8 uH) | Min. value (L = 6.8 uH) | Sensitivity (L = 8.2 uH) | Min. value (L = 8.2 uH) |
| 88 | 49.6 | 44.9 | 48.6 | 30.1 | 47.9 | 38.5 | 48.0 | 38.5 | 49.3 | 39.4 | 47.9 | 41.2 | 48.2 | 40.9 |
| 89 | 50.1 | 45.9 | 49.3 | 33.0 | 48.3 | 39.4 | 48.7 | 39.3 | 49.6 | 39.5 | 48.2 | 41.5 | 48.8 | 41.3 |
| 90 | 50.3 | 43.7 | 49.9 | 35.1 | 48.6 | 39.7 | 49.3 | 39.8 | 49.8 | 39.8 | 48.5 | 41.4 | 48.8 | 41.0 |
| 91 | 50.1 | 39.6 | 50.3 | 36.4 | 48.8 | 39.6 | 49.8 | 39.9 | 50.0 | 39.9 | 48.7 | 41.4 | 48.9 | 40.9 |
| 92 | 50.6 | 36.2 | 51.0 | 37.9 | 49.4 | 39.5 | 50.6 | 40.4 | 50.5 | 40.4 | 49.3 | 41.8 | 48.5 | 40.7 |
| 93 | 50.6 | 34.4 | 51.1 | 38.4 | 49.4 | 39.0 | 50.8 | 39.9 | 50.5 | 40.3 | 49.3 | 41.5 | 48.1 | 40.3 |
| 94 | 51.2 | 36.0 | 51.3 | 38.4 | 49.6 | 38.6 | 51.1 | 39.8 | 50.5 | 40.1 | 49.4 | 41.4 | 48.4 | 41.1 |
| 95 | 51.1 | 35.0 | 51.0 | 38.8 | 49.2 | 37.8 | 50.9 | 40.0 | 50.2 | 39.9 | 49.0 | 41.2 | 48.3 | 42.2 |
| 96 | 50.9 | 32.6 | 50.8 | 39.2 | 48.9 | 36.7 | 50.6 | 40.3 | 49.9 | 39.5 | 48.6 | 40.8 | 48.4 | 43.7 |
| 97 | 51.1 | 26.4 | 51.2 | 39.9 | 49.3 | 36.6 | 51.0 | 41.3 | 50.4 | 41.7 | 48.9 | 41.6 | 47.8 | 43.9 |
| 98 | 50.8 | 10.7 | 51.3 | 37.8 | 49.4 | 38.3 | 50.9 | 40.9 | 50.5 | 41.1 | 48.8 | 42.7 | 47.4 | 43.2 |
| 99 | 50.9 | 24.6 | 51.6 | 38.3 | 49.9 | 39.8 | 51.1 | 41.1 | 50.6 | 41.7 | 48.9 | 44.2 | 47.9 | 42.0 |
| 100 | 50.4 | 24.2 | 51.3 | 38.9 | 49.8 | 39.6 | 50.8 | 41.6 | 50.1 | 43.2 | 48.3 | 44.4 | 48.3 | 40.6 |
| 101 | 50.1 | 8.9 | 51.3 | 39.8 | 49.8 | 39.1 | 50.7 | 41.8 | 49.5 | 41.9 | 47.9 | 43.7 | 49.2 | 39.8 |
| 102 | 50.3 | 20.3 | 51.5 | 41.4 | 50.1 | 39.8 | 50.8 | 42.7 | 49.1 | 41.0 | 48.4 | 42.5 | 49.6 | 39.4 |
| 103 | 50.0 | 13.5 | 51.1 | 39.8 | 49.9 | 41.0 | 50.2 | 39.3 | 48.5 | 42.0 | 48.8 | 41.1 | 50.2 | 38.5 |
| 104 | 50.2 | 21.9 | 50.9 | 35.7 | 49.8 | 42.8 | 49.4 | 38.6 | 48.8 | 44.8 | 49.7 | 40.3 | 50.8 | 36.7 |
| 105 | 50.2 | 17.0 | 49.9 | 30.4 | 49.2 | 42.7 | 48.7 | 42.5 | 49.1 | 44.2 | 50.1 | 39.9 | 50.9 | 34.8 |
| 106 | 50.3 | 17.2 | 49.0 | 31.4 | 49.1 | 43.7 | 48.8 | 43.8 | 49.7 | 42.8 | 50.7 | 39.0 | 50.6 | 34.5 |
| 107 | 50.6 | 11.4 | 48.8 | 37.8 | 49.5 | 43.4 | 49.3 | 42.3 | 50.5 | 40.9 | 51.3 | 37.2 | 50.4 | 32.1 |
| 108 | 50.5 | 24.3 | 48.7 | 41.8 | 49.6 | 42.4 | 49.2 | 39.2 | 50.6 | 37.0 | 51.4 | 35.3 | 50.6 | 25.9 |
| Ave. | 50.5 | 27.1 | 50.5 | 37.2 | 49.3 | 39.9 | 50.0 | 40.6 | 49.9 | 41.0 | 49.1 | 41.1 | 49.1 | 39.2 |
| Max. | 51.2 | 45.9 | 51.6 | 41.8 | 50.1 | 43.7 | 51.1 | 43.8 | 50.6 | 44.8 | 51.4 | 44.4 | 50.9 | 43.9 |
| Min. | 49.6 | 8.9 | 48.6 | 30.1 | 47.9 | 36.6 | 48.0 | 38.5 | 48.5 | 37.0 | 47.9 | 35.3 | 47.4 | 25.9 |

In FIGS. 10–16 and TABLE 1, the minimum value designates the dropped value of the directivity. It is appreciated that the inductance L of the inductor 26 is preferably in the range of 1.0–6.8 μH.

Figure 17:
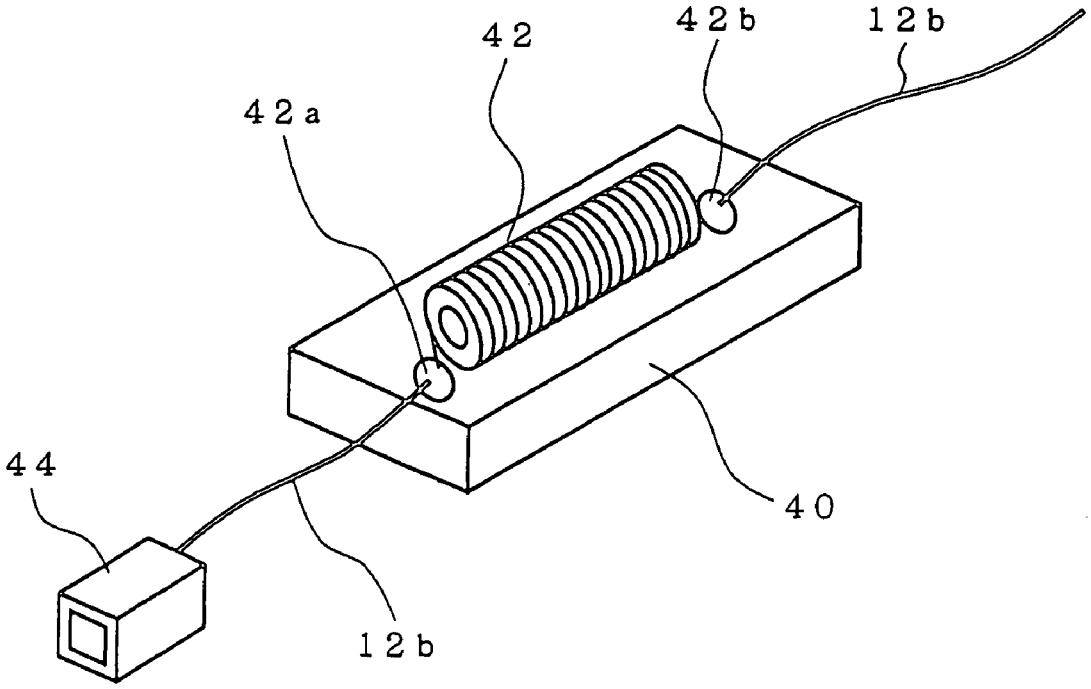
FIG. 17 shows an example of the mounting of an inductor.

Next, the structure of the lead wire 12*b* will now be described. Reference to FIG. 17, there is shown the structure of the lead wire 12*b* in which an inductor 42 is inserted. The inductor 42 is mounted on a glass epoxy resin substrate 40 by means of soldering and is inserted in the lead wire 12*b*. Reference numerals 42*a* and 42*b* show the soldered parts, respectively. The end of the lead wire 12*b* toward the antenna is connected to a connector 44. The connector 44 is coupled to a connector (not shown) provided to the AM feeding terminal 12*a*. As an example, the length of the lead wire 12*b* from the soldered part 42*a* to the connector 44 is 3.5 cm, and the length of lead wire 12*b* from the soldered part 42*b* to the amplifier 22 is 19 cm. The length of the inductor 42 is 0.5 cm.

Figure 18:
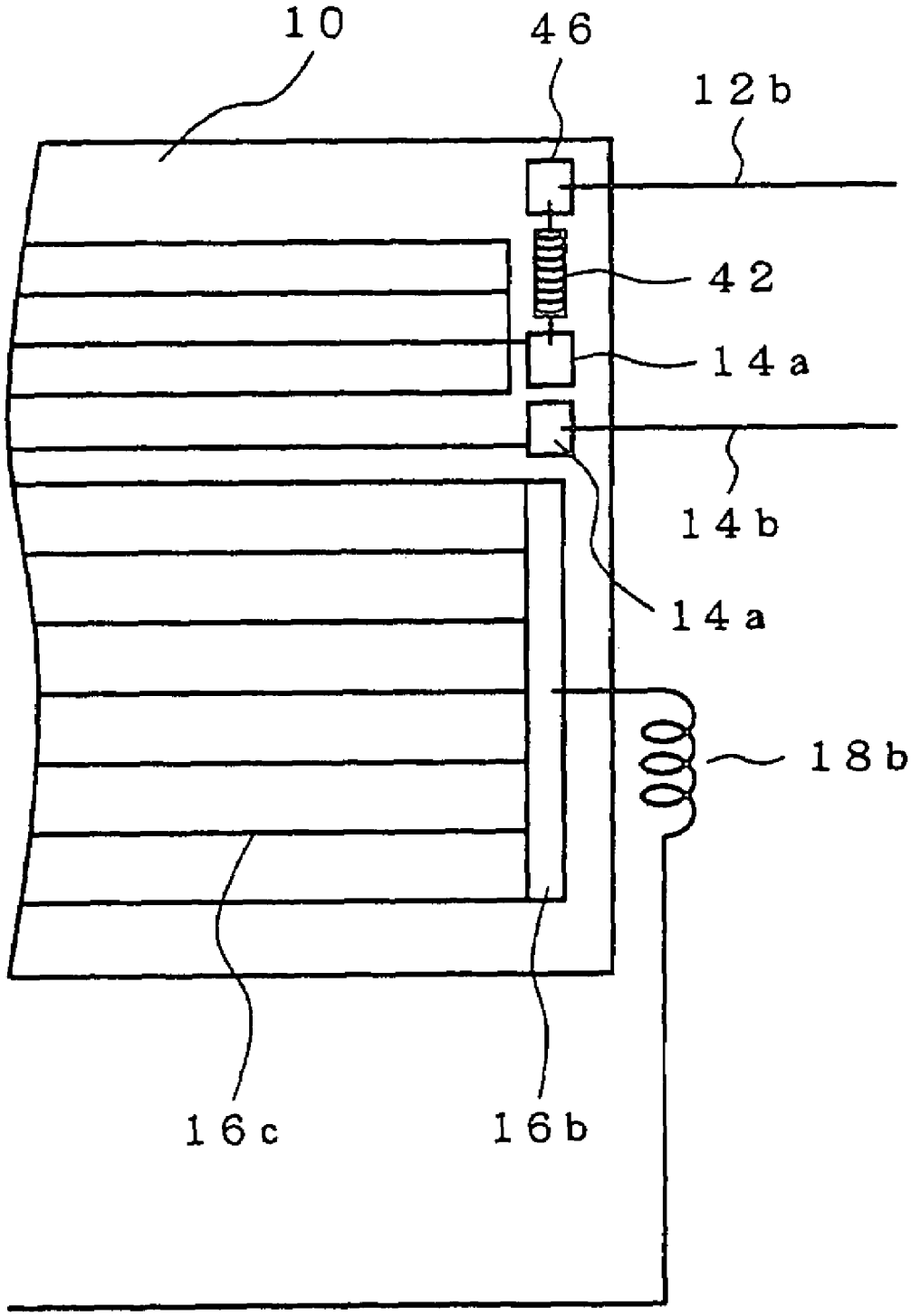
FIG. 18 shows another example of the mounting of an inductor.

FIG. 18 shows another example of the mounting of an inductor. The inductor 42 is soldered between a terminal base 46 formed on the rear window glass panel 10 and the AM feeding terminal 14. The AM lead wire 12*b* is extend from the terminal base 46.

Figure 19:
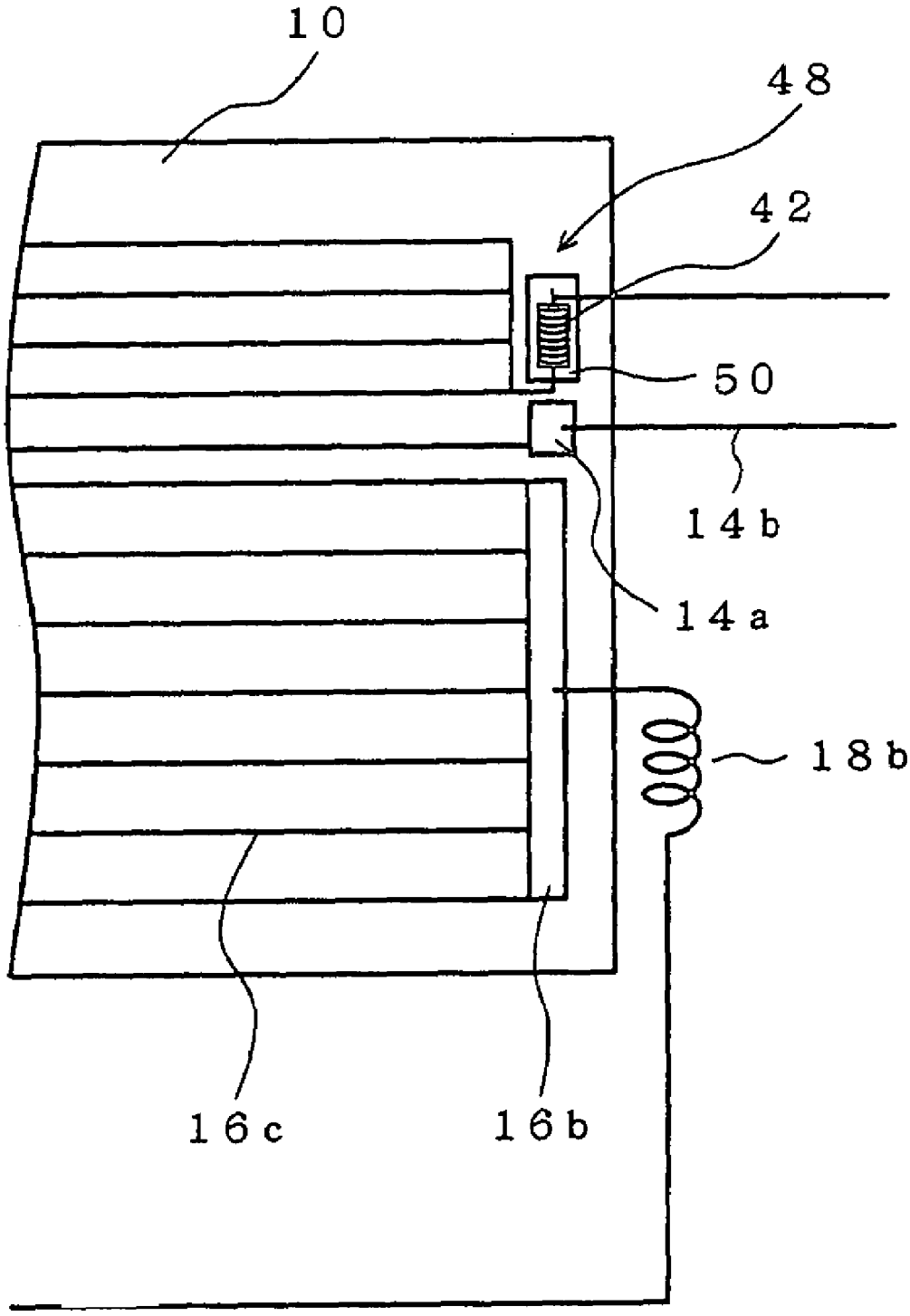
FIG. 19 shows a further example of the mounting of an inductor.

FIG. 19 shows a further example of the mounting of an inductor. A feeding terminal 48 is provided on the rear glass window panel 10. The feeding terminal 48 comprises the inductor 42 mounted on one terminal base 50.

The invention claimed is:

1. An antenna device for a motor vehicle comprising:

a defogger provided on a rear window glass panel of the motor vehicle;

an AM antenna provided in a space other than the defogger on the rear window glass panel;

an FM antenna provided in a space between the defogger and the AM antenna on the rear window glass panel;

a two-input amplifier for amplifying signals received by the AM and FM antennas;

an AM lead wire for connecting between a feeding terminal of the AM antenna and the amplifier;

an FM lead wire for connecting between a feeding terminal of the FM antenna and the amplifier, a capacitive coupling being formed between the AM and FM lead wires; and an inductor inserted in the AM lead wire near to the AM feeding terminal;

wherein the inductor opens the AM lead wire in a high frequency to cut off a signal from the AM antenna when a signal received by the FM antenna is amplified by the amplifier.

2. An antenna device for a motor vehicle according to claim 1, wherein the inductor is inserted in the AM lead wire near to the AM feeding terminal to minimize an effect on the FM antenna of the capacitive coupling between the AM and FM lead wires.

3. The glass antenna device according to claim 2, wherein the inductance of the inductor is in the range of 1.0 μH–6.8 μH.

4. An antenna device for a motor vehicle comprising:

a defogger provided on a rear window glass panel of the motor vehicle;

an AM antenna provided in a space other the defogger on the rear window glass panel;

an FM antenna provided in a space between the defogger and the AM antenna on the rear window glass panel;

a two-input amplifier for amplifying signals received by the AM and FM antennas;

a terminal base provided near to the feeding terminal of the AM antenna on the rear window glass panel;

an inductor provided between the feeding terminal of the AM antenna and the terminal base;

an AM lead wire for connecting between the terminal base and the amplifier; and an FM lead wire for connecting between a feeding terminal of the FM antenna and the amplifier;

wherein the inductor opens the AM lead wire in a high frequency to cut off a signal from the AM antenna when a signal received by the FM antenna is amplified by the amplifier.

5. An antenna device for a motor vehicle comprising:

a defogger provided on a rear window glass panel of the motor vehicle;

an AM antenna provided in a space other than the defogger on the rear window glass panel;

an FM antenna provided in a space between the defogger and the AM antenna on the rear glass window panel;

a two-input amplifier for amplifying signals received by the AM and FM antennas;

a feeding terminal of the AM antenna provided with an inductor;

an AM lead wire for connecting between a feeding terminal of the AM antenna and the amplifier; and an FM lead wire for connecting between a feeding terminal of the FM antenna and the amplifier;

wherein the inductor opens the AM lead wire in a high frequency to cut off a signal from the AM antenna when a signal received by the FM antenna is amplified by the amplifier.

6. The glass antenna device according to claim 4 or 5, wherein the inductance of the inductor is in the range of 1.0 μH–6.8 μH.

* * * * *